US008192098B1

(12) United States Patent
Olsen

(10) Patent No.: US 8,192,098 B1
(45) Date of Patent: Jun. 5, 2012

(54) AUTOMATICALLY LOADING PRINTING DEVICE AND METHOD OF PRINTING

(75) Inventor: Kevin Olsen, Louisville, KY (US)

(73) Assignee: Stalsen LLC, Louisville, KY (US)

( * ) Notice: Subject to any disclaimer, the term of this patent is extended or adjusted under 35 U.S.C. 154(b) by 730 days.

(21) Appl. No.: 12/140,713

(22) Filed: Jun. 17, 2008

(51) Int. Cl.

| | |
|---|---|
| ***B41J 1/56*** | (2006.01) |
| ***B41J 1/60*** | (2006.01) |
| ***B44B 5/02*** | (2006.01) |
| ***B41B 1/22*** | (2006.01) |

(52) U.S. Cl. ..... 400/171; 101/29; 276/45

(58) Field of Classification Search ..... 400/171, 400/132, 135, 138, 153, 154, 154.1; 101/13, 101/15, 16, 29; 276/2, 44, 45
See application file for complete search history.

(56) References Cited

U.S. PATENT DOCUMENTS

| | | | | |
|---|---|---|---|---|
| 199,460 | A | | 1/1878 | Morgans |
| 422,594 | A | | 3/1890 | James |
| 513,007 | A | | 1/1894 | Dubeux |
| 584,565 | A | | 6/1897 | Snow |
| 879,814 | A | | 2/1908 | Donning |
| 1,078,601 | A | | 11/1913 | Mathews |
| 1,128,225 | A | | 2/1915 | Choate |
| 1,176,162 | A | * | 3/1916 | O'Kane ..... 101/400 |
| 1,376,830 | A | | 5/1921 | Putnam et al. |
| 1,406,537 | A | | 2/1922 | Choate |
| 1,443,928 | A | | 1/1923 | Putnam |
| 1,878,516 | A | | 9/1932 | Heene |
| 1,912,927 | A | | 6/1933 | Weingartner |
| 1,979,640 | A | | 11/1934 | Roberts, Jr. |
| 1,987,370 | A | | 1/1935 | Pleger |
| 1,994,384 | A | | 3/1935 | Bradshaw |
| 2,076,198 | A | | 4/1937 | Honnolke |
| 2,106,306 | A | | 1/1938 | Putnam et al. |
| 2,336,325 | A | | 12/1943 | Weber |
| 2,684,026 | A | | 7/1945 | Randolph, Sr |
| 2,619,030 | A | | 11/1952 | Doyle |
| 2,651,400 | A | | 9/1953 | Young et al. |
| 2,687,795 | A | | 8/1954 | Wise |
| 2,720,829 | A | | 10/1955 | Berggren |
| 3,054,494 | A | | 9/1962 | Rizzetti |
| 3,124,067 | A | | 3/1964 | Morgan |
| 3,163,106 | A | | 12/1964 | Failor |
| 3,187,665 | A | | 6/1965 | Kingsley |
| 3,209,681 | A | | 10/1965 | Sanborn |
| 3,301,370 | A | | 1/1967 | Miller |
| 3,351,003 | A | | 11/1967 | McCoy |
| 3,353,645 | A | | 11/1967 | Palmer |
| 3,358,599 | A | | 12/1967 | Douglass, Sr |
| 3,366,041 | A | | 1/1968 | Krynytzky |
| 3,447,656 | A | | 6/1969 | Nyquist |
| 3,561,355 | A | | 2/1971 | Rapparlie |
| 3,585,540 | A | | 6/1971 | Schuttloffel |

(Continued)

*Primary Examiner* — Judy Nguyen
*Assistant Examiner* — Blake A Tankersley
(74) *Attorney, Agent, or Firm* — Eric Killmeier; James R. Higgins; Middleton Reutlinger

(57) ABSTRACT

A printing device is provided with a print die storage rack, a pickup head, a print head, and a printing surface. The print die storage rack is adapted to hold a multitude of print dies. The pickup head is provided to move one or more print dies to and from the storage rack and the print head. The print head is adapted to hold one or more print dies and move them between the pickup head and the printing surface. The printing surface is provided to hold and secure print media. The device is capable of any form of printing, embossing, debossing, foil stamping and the like. A method of printing is also provided.

15 Claims, 62 Drawing Sheets

U.S. PATENT DOCUMENTS 3,765,325 A 10/1973 Warren
3,828,666 A 8/1974 Apicella
3,911,813 A 10/1975 Schaeffer
3,927,613 A 12/1975 Nantz
4,015,699 A 4/1977 Kondur, Jr.
4,023,490 A 5/1977 Marozzi
4,027,591 A 6/1977 Gubela
4,037,532 A 7/1977 Plaza et al.
4,044,665 A 8/1977 Kuhne et al.
4,074,798 A 2/1978 Berger
4,126,400 A 11/1978 Suzuki et al.
4,147,438 A 4/1979 Sandrone et al.
4,161,912 A 7/1979 Usui et al.
4,202,637 A 5/1980 Tummolo
4,277,186 A 7/1981 Takahashi
4,308,794 A 1/1982 Adamoli et al.
4,327,635 A 5/1982 Kelly et al.
4,373,436 A 2/1983 Shenoha
4,392,430 A 7/1983 Siegal
4,416,199 A 11/1983 Davison
4,443,124 A 4/1984 Ozawa
4,494,458 A 1/1985 Price, Jr.
4,509,872 A 4/1985 Shimogawara
4,516,493 A 5/1985 Schemenauer
4,536,775 A 8/1985 Calmek et al.
4,541,746 A 9/1985 Bobart et al.
4,542,690 A 9/1985 Kikuchi
4,544,289 A 10/1985 McGourty et al.
4,545,695 A 10/1985 Agata
4,620,808 A 11/1986 Kurtin et al.
4,647,234 A 3/1987 Isobe
4,673,304 A 6/1987 Liu et al.
4,709,632 A 12/1987 Samuels et al.
4,764,038 A 8/1988 Nakajima
4,893,555 A * 1/1990 Leyland et al. ..... 101/29
4,930,911 A 6/1990 Sampson et al.
4,967,654 A 11/1990 Strong et al.
4,967,659 A 11/1990 Goodwin et al.
5,163,759 A 11/1992 Jambor et al.
5,173,313 A 12/1992 Sato et al.
5,239,926 A 8/1993 Nubson et al.
5,308,235 A 5/1994 Kamitakahara et al.
D351,412 S 10/1994 Nooman et al.
D354,303 S 1/1995 Nooman et al.
5,413,422 A 5/1995 Gray et al.
D360,220 S 7/1995 Nooman et al.
5,441,589 A 8/1995 Groswith, III et al.
D362,459 S 9/1995 Nooman et al.
5,479,859 A 1/1996 Lindner et al.
5,664,894 A 9/1997 Gray et al.
5,665,193 A 9/1997 Groswith, III et al.
5,738,449 A 4/1998 Groswith, III et al.
5,810,489 A * 9/1998 Nakagaki et al. ..... 400/152
5,913,267 A 6/1999 Britsch
5,913,623 A 6/1999 Yamaguchi et al.
6,027,265 A 2/2000 Parker et al.
6,065,884 A 5/2000 Parker et al.
6,149,326 A 11/2000 Groswith, III et al.
6,200,044 B1 3/2001 Berger
6,398,435 B1 6/2002 Kozakai et al.
6,579,019 B2 6/2003 Ansell et al.
6,615,713 B1 9/2003 Goda et al.
6,623,189 B2 9/2003 Ansell et al.
6,669,383 B2 12/2003 Ansell et al.
6,672,357 B2 1/2004 Yokozawa et al.
6,716,017 B2 4/2004 Papadopoulas
D493,490 S 7/2004 Vogel
6,814,830 B2 11/2004 Yokozawa et al.
2001/0020425 A1 * 9/2001 Gottling et al. ..... 101/247
2003/0121739 A1 7/2003 Lumpkin
2005/0126406 A1 6/2005 Fawcett et al.

* cited by examiner

Figure #1

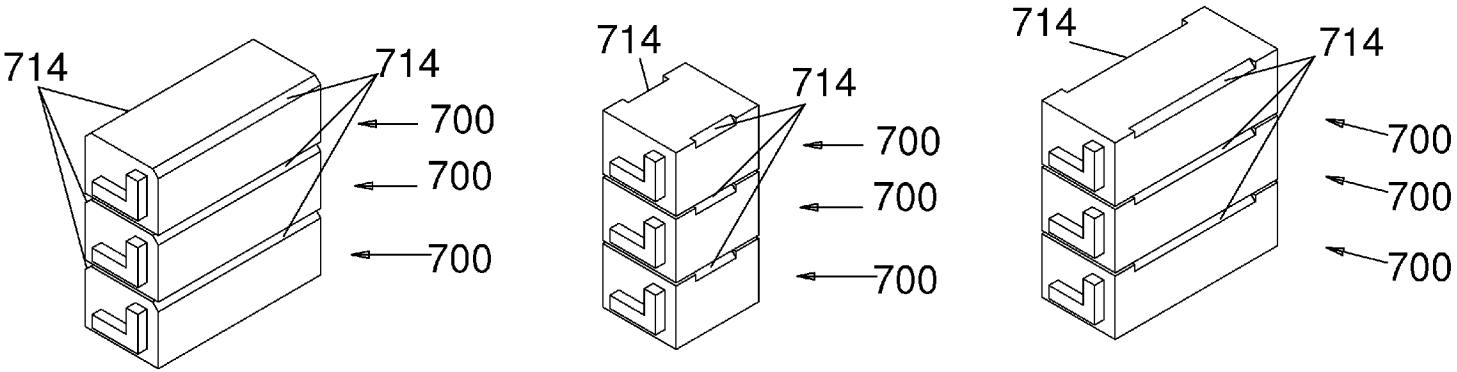
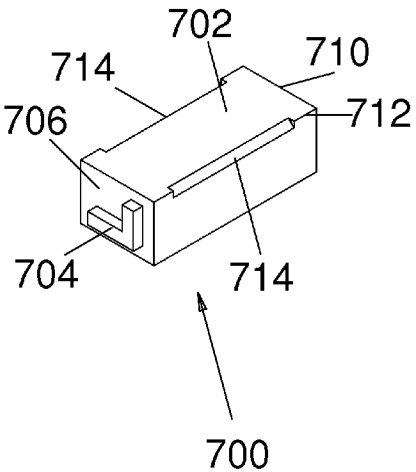
Fig. 7D
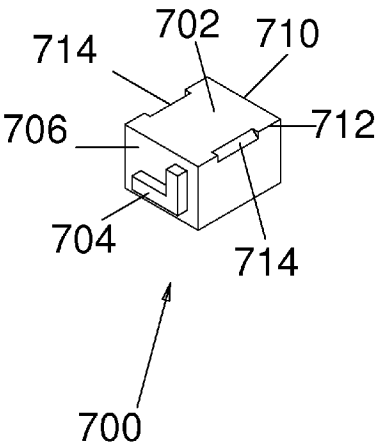
Fig. 7C
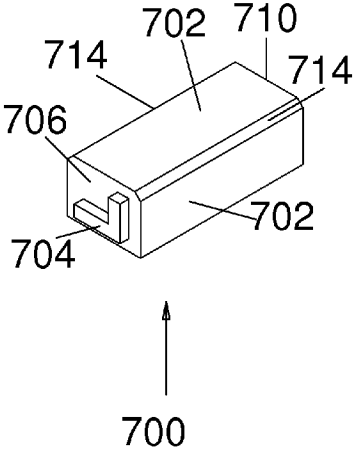
Fig. 7B

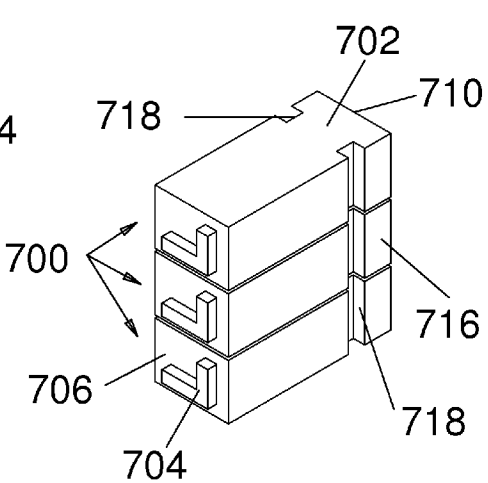
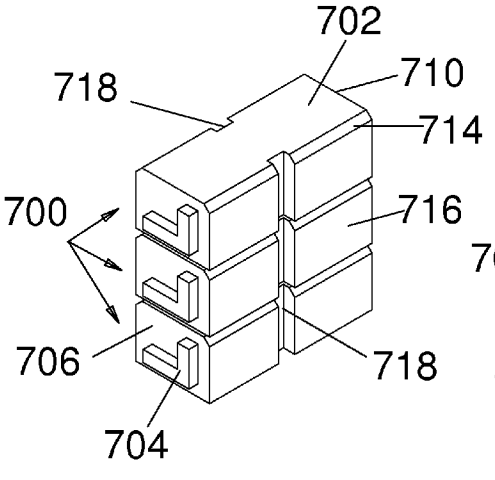
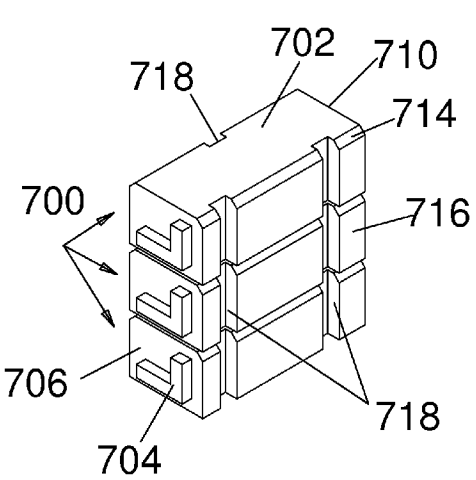
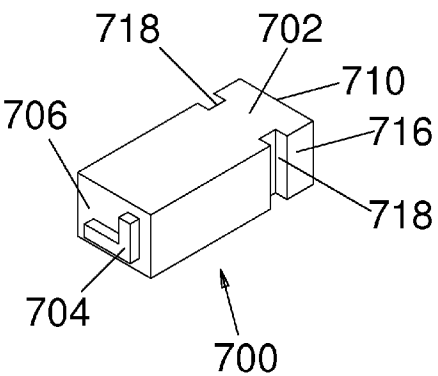
Fig. 10C
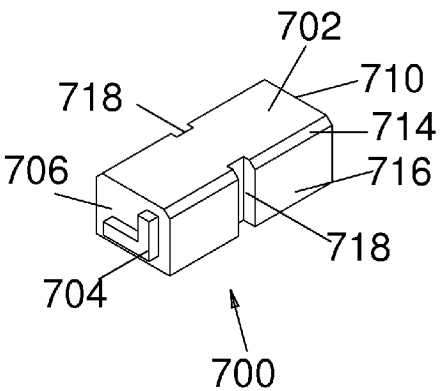
Fig. 10B
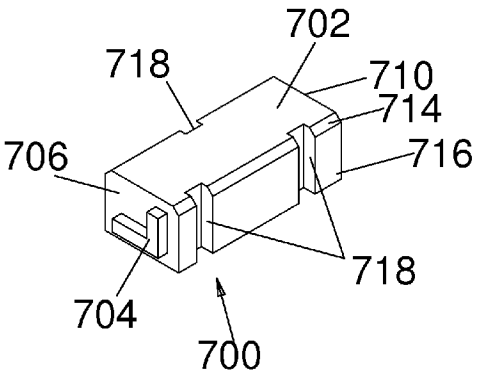
Fig. 10A

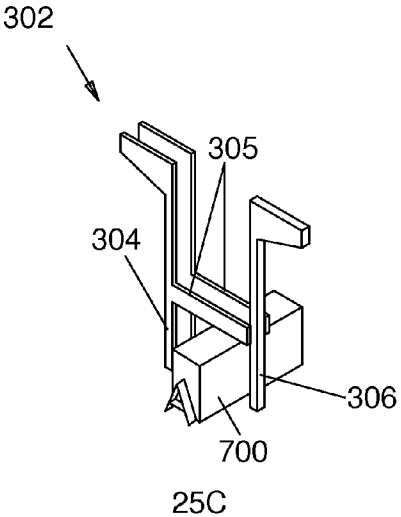
25C
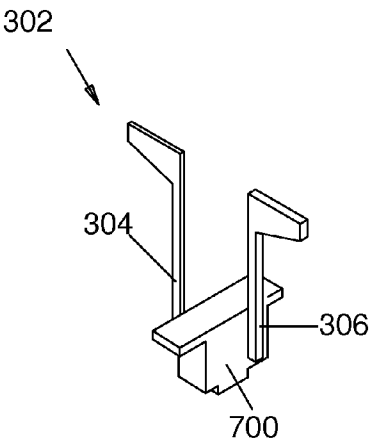
25B
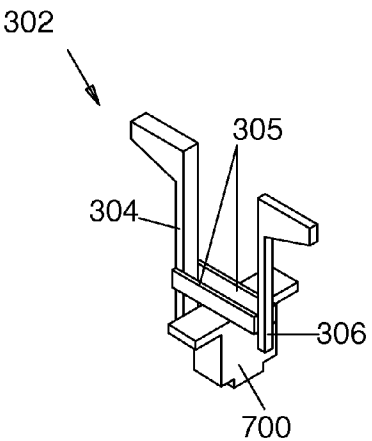
25A
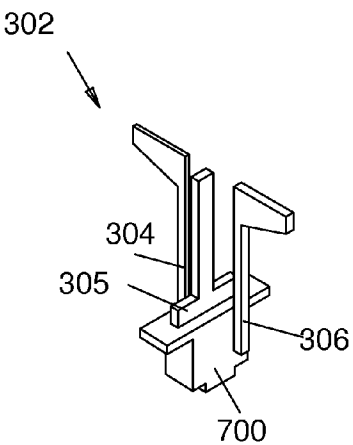
25E
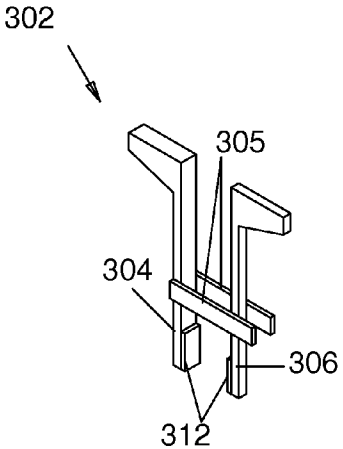
25D

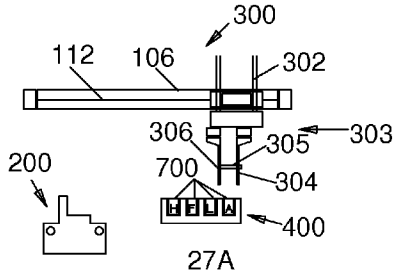
27A
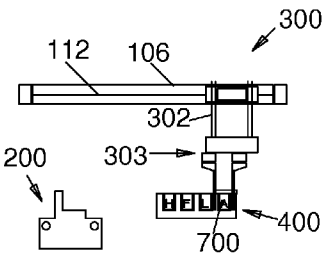
27B
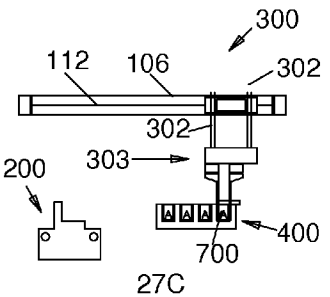
27C
27D
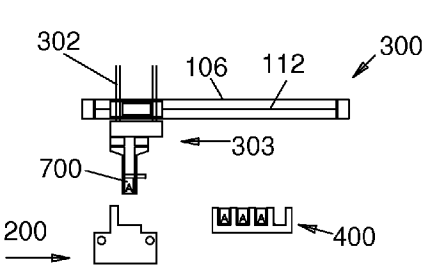
27E
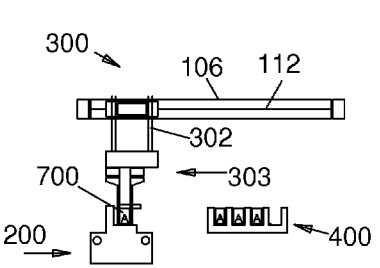
27F
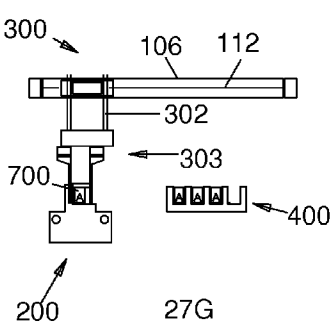
27G
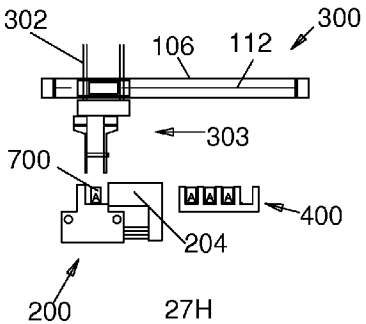
27H
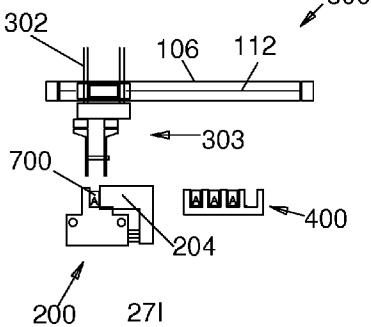
27I

| | |
|---|---|
| T | T__ _____ _____ T___T__ |
| H | TH_ _____ _____ TH__T__ |
| E | THE _____ _____ THE_TE_ |
| A | THE A_A__ _____ THEATE_ |
| W | THE AWA__ W____ THEATE_ |
| R | THE AWAR_ W_R__ THEATER |
| D | THE AWARD W_R__ THEATER |
| O | THE AWARD WOR__ THEATER |
| K | THE AWARD WORK_ THEATER |
| S | THE AWARD WORKS THEATER |

Figure 37A

| | |
|---|---|
| THE | THE _____ _____ THE__T__ |
| E | THE _____ _____ THE_TE_ |
| A | THE A_A__ _____ THEATE_ |
| W | THE AWA__ W____ THEATE_ |
| R | THE AWAR_ W_R__ THEATER |
| D | THE AWARD W_R__ THEATER |
| O | THE AWARD WOR__ THEATER |
| K | THE AWARD WORK_ THEATER |
| S | THE AWARD WORKS THEATER |

Figure 37B

AUTOMATICALLY LOADING PRINTING DEVICE AND METHOD OF PRINTING

TECHNICAL FIELD

The field of the present invention relates to printing devices and methods for printing.

BACKGROUND

Customized printing on framing mattes, invitations, awards, and the like can be accomplished by a variety of means, such as, stamping, ink printing, foil stamping, serial printing, embossing, debossing, steel stamping, or letterpress printing. Typically, these operations involve individual print die physically contacting the print media. Custom print shops often charge for the task of changing out the print die to create customized text. This task is typically labor intensive and makes customized printing for small orders cost prohibitive.

SUMMARY

One embodiment of the present invention provides a printing device with a print die storage rack adapted to hold a multitude of print dies, and a print head adapted to hold one or more print dies. The device is further adapted to transport the print head and die to a printing surface. A pickup head is provided to hold one or more of the multitude of print dies and transport it between the print die storage rack and the print head. A printing surface is also provided to hold and secure print media.

Another embodiment of the present invention provides a process of printing a text string having one or more series of letters. Each of the one or more series of letters has one or more letters that are identical to each other and unique to that series. The process involves printing a first series of the one or more series of letters; printing a subsequent series of the one or more series of letters. The subsequent series is not printed until an immediately preceding series of the one or more series of letters has been completely printed.

Another embodiment of the present invention provides another method of printing a text string having a plurality of characters. One or more locations with the text string is associated with each character of the plurality of characters. The method involves selecting a first character from the plurality of letters; printing the first character at each of the one or more locations associated with the first character; selecting a second character that is different than the first character from the plurality of letters; printing the second character that is different than the first character at each of the one or more locations associated with the second character that is different than the first character.

In yet another embodiment of the present invention, another method of printing a text string having a plurality of characters is provided. One or more locations with the text string is associated with each character of the plurality of characters. The method comprises the steps of providing a printing press having a print die storage rack; a plurality of print die characters stored in the storage rack; a pickup head; a print head; and a print station. The method also comprises securing a stock of print media to the print station; moving the pickup head relative to the print die storage rack; and removing from the storage rack and clamping in the pickup head a first print die character of the plurality of print die characters. In addition, the method also comprises the steps of moving the first print die character in the pickup head relative to the storage rack and relative to the print head, placing and clamping the first print die character in the print head; moving the first print die character in the print head relative to the print media; and pressing the print die character into the print media. Moving the first print die character in the print head relative to the print media and relative to the pickup head, and clamping the first print die character in the pickup head. Moving the first print die character in the pickup head relative to the print die storage rack, releasing the first print die character from the pickup head, and returning the first print die character to the storage rack.

In still another embodiment of the present invention, a print die holder for holding a print die having a prismatic body and having one or more flanges extending from a surface of the prismatic body is provided. The print die holder is provided with a first horizontal surface adapted to support the one or more flanges, a first vertical surface, and a second vertical surface, a first clamp for securing the print die against the first vertical surface, and a second clamp for securing the print die against the second vertical surface. The second vertical surface is perpendicular to the first vertical surface. The second horizontal surface is adapted to limit the print die against vertical travel.

In yet another embodiment of the present invention, a print die holder for holding a print die having a prismatic body is provided. The print die holder is provided with a horizontal surface adapted to support the print die, a first vertical surface, a first clamp for securing the print die against the first vertical surface, and a second vertical surface adapted to limit the print die against horizontal travel. The second vertical surface is perpendicular to the first vertical surface.

In still yet another embodiment of the present invention, a print die holder is provided with a plurality of shims arranged in a serial parallel fashion, each with a first opening and a second opening. Each of the second openings has a perimeter shape, and the perimeter shape of each of the second openings is unique from the perimeter shape of every other of the second openings of the plurality of shims. The die holder is further provided with an alignment rod extending through the first opening of each of the plurality of shims, and a positioning rod having a plurality of protrusions corresponding to the number of the plurality of shims and extending through each of the second openings. Each of the protrusions has an angular position about the positioning rod that is unique from the angular position about the positioning rod of every other of the protrusions.

In still yet another embodiment of the present invention, a print die holder is provided with a base portion, a horizontal reference surface, a vertical reference surface, and a plurality of shims arranged in a serial parallel fashion, each with a first opening and a second opening. Each of the second openings has a perimeter shape, and the perimeter shape of each of the second openings is unique from the perimeter shape of every other of the second openings of the plurality of shims. The print die holder is also provided with an alignment rod extending through the first opening of each of the plurality of shims. A positioning rod having a plurality of protrusions corresponding to the number of the plurality of shims and extending through each of the second openings is also provided to the die holder. Each of the protrusions has a size and position that is unique from the size and position of every other of the protrusions.

BRIEF DESCRIPTION OF THE ILLUSTRATIONS

FIGS. 7-10 are views of embodiments of a printing die of the present invention that are provided with various features to aid in picking and placing the die.

FIGS. 25A-25G are embodiments of fingers for a pick-up head for a printing device of the present invention.

FIGS. 27A-27I is a side view of a rotational moving pick-up head for a printing device of the present invention.

FIGS. 37A and 37B depicts the progression of a printed text string.

DETAILED DESCRIPTION

Figure 1:
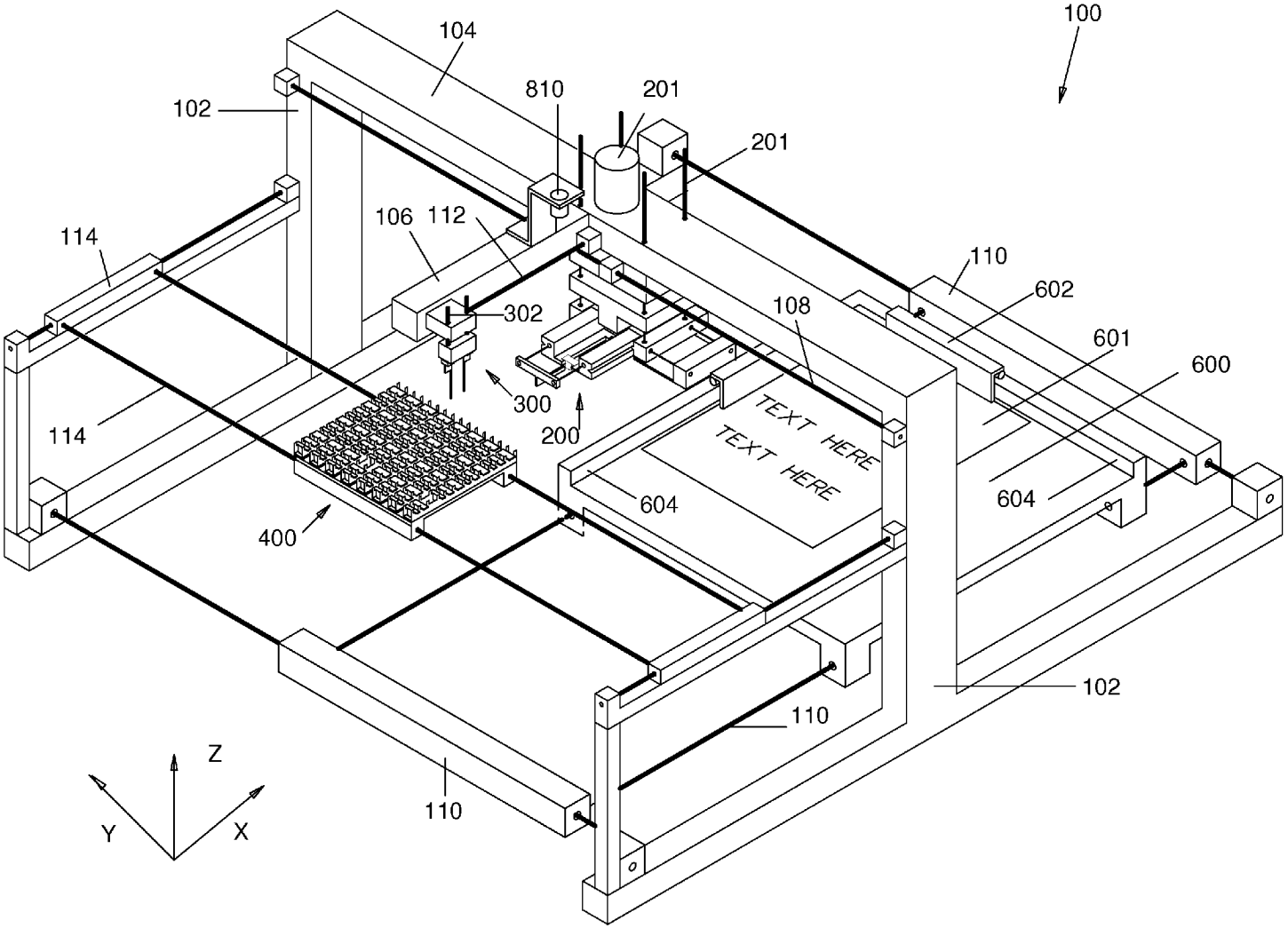
FIG. 1 illustrates a particular embodiment of a printing device of the present invention, which is adapted to print on a horizontal surface.

While the present invention will be described more fully hereinafter with reference to the accompanying drawings in which particular embodiments and methods are shown, it is to be understood from the outset that persons of ordinary skill in the art may modify the invention herein described while achieving the functions and results of this invention. Accordingly, the description that follows is to be understood as illustrative and exemplary of specific embodiments within the broad scope of the present invention and not as limiting the scope of the invention. In the following descriptions, like numbers refer to similar features or like elements throughout.

As used herein, the terms "print" or "printing" may refer to printing, stamping, ink printing, foil stamping, serial printing, embossing, debossing, steel stamping, letterpress printing (printing with inked die), blind embossing (printing without inked die), rubber stamping, roll printing, or any type of printing generally known in the art. Also as used herein, the term "die" may refer to any one of the following: die, type, print type, high type, standard type, letterpress type, service type, linotype. The die may be made of brass, steel, copper, cast magnesium, rubber, silicone or other polymer, or any combination thereof. Further, the die may be photo-etched, engraved, soft, hardened, flat or curved.

In addition, any drive system mentioned herein shall be understood to incorporate any motion controlled driving mechanism generally known in the art. For example, any motion controlled driving mechanisms generally known in the art may comprise pneumatic cylinders, hydraulic cylinders, linear motors, solenoids, rotary motors, any other electrical, mechanical or electro-mechanical means generally known in the art, or any combination thereof. Furthermore, any linear motion may be achieved by a rotary device coupled to an appropriate transmission. Likewise, any rotary motion may be achieved by a linear device coupled to an appropriate transmission. Such devices are understood to be controlled by any means generally known in the art, such as, for example, a CPU controlled computer, and the like. Further, any motion described herein shall be understood to be actuated by any of the previously stated examples.

Referring now to FIGS. 1-4, and 39A-39D, a printing device 100 of the present invention is provided with a frame 102 that a supports a print head 200, a pick-up head 300, a die storage rack 400 and a print station or printing surface 600.

Referring specifically to FIG. 1, a print head 200 may be supported by a first structure 104. The first structure 104 may be a beam supported at opposite ends, as shown, but may be a simple cantilever similar to the second structure 106. The frame 102 may also be provided with a print head drive system 108 capable of moving the print head 200 relative to the print station 104 and the first structure 104. Also as shown in FIG. 1, the print head drive system 108 is capable of moving the print head 200 in a single direction that is substantially parallel to the y-axis. However, a print head drive system 108 may also be provided to move the print head 200 in two directions. The print head 200 is also provided with a drive system 201 capable of moving the print head 200 in a single direction substantially parallel to the z-axis.

The frame 102 may be provided with printing surface 600. The printing surface may be provided with mechanical clamps 602 to secure print media 601 to the surface 600. In addition to, or in replacement of, mechanical clamps 602, the printing surface 600 may be provided with a vacuum source, or other means generally known, to hold print media 600 in place. The printing surface 600 may also be provided with reference surfaces 604 to serves as datum for the print media 601. The frame is may be provided with a printing surface drive system 110 that moves the printing surface 600 in at least one direction and relative to the print head 200. In the shown embodiment, the printing surface drive system 110 is capable of moving the printing surface 600 along two directions that are substantially parallel to both the x and y axes.

Also as shown in FIG. 1, a pick-up head 300 may be supported by a second structure 106. The second structure 106 may be a simple cantilever, as shown, but may be a beam supported at opposite ends, similar to the first structure 104. The frame 102 may also be provided with a pick-up head drive system 112 capable of moving the pick-up head 300 relative to the second structure 106, the print head 200, and the die storage rack 400. The pick-up head drive system 112 may be capable of moving the pick-up head 300 in a single direction that is substantially parallel to the x-axis. However, a pick-up head drive system 108 may also be provided to move the pick-up head 300 in two directions. The pick-up head 300 is also provided with a drive system 302 capable of moving the pick-up head 300 in a single direction substantially parallel to the z axis.

The frame 102 may also be provided with a die storage rack 400. The die storage rack 400 is adapted to secure and store a plurality of printing die 700. The frame 102 may be provided with a storage rack drive system 114 that moves the storage rack 400 in at least one direction and relative to the pick-up head 300. In the shown embodiment, the storage rack drive system 114 is capable of moving the storage rack 400 along two directions that are substantially parallel to both the x and y axes.

The printing device 100 prints by contacting a single print die 700 with the print media 601. The pick-up head 300 is capable of moving a single print die 700 at a time from the die storage rack 400, to the print head 200, and back to the die storage rack 400. The print head 200 is capable of securing a print die 700 and moving it into the print media. Details of each component's function are explained in greater detail herein. However, the movements may be accomplished by the relative movement between the print head 200, the pick-up head 300, the die storage rack 400, and the printing surface 600, substantially as described herein.

Figure 2:
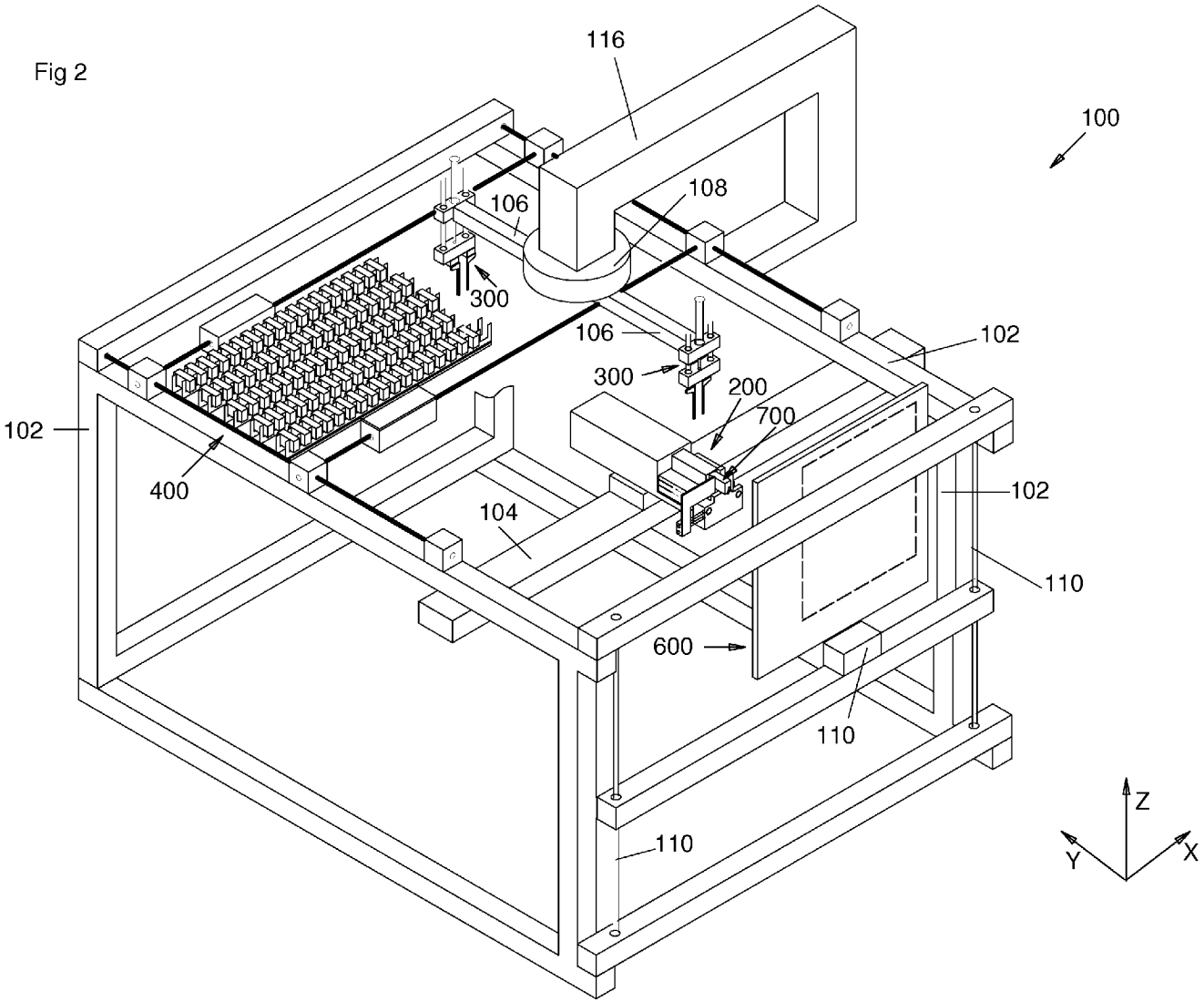
FIG. 2 illustrates another embodiment of a printing device of the present invention, which is adapted to print on a vertical surface.

Referring now to FIG. 2, another embodiment of a printing device 100 capable of printing on a vertical surface is provided. The printing device 100 is provided with a die storage rack 400 and a vertically oriented printing surface 600. The printing surface, however, may be at an angle between vertical and horizontal. The printing device 100 is also provided with a print head 200 supported by a first structure 104, and two pickup heads 300 mounted on second structures 106.

Each pick-up head 300 is substantially as described with reference to FIG. 1, except for the exception that each is also rotationally mounted to a third structure 116 of the frame 102 via a respective second structure 106. Each pick-up head 300 is also movable with a pickup head drive system 112 that moves the pickup heads 300 relative to the second structure 106, the print head 200, and the die storage rack 400. The two rotationally mounted pick-up heads give the printing device the capability to have one pick-up head 300 pick and/or place a print die in the print head 200, while the other pick-up head 300 can pick and/or place a print die in the die storage rack 400. Thus, reducing the total time required to change a print die 700 out of the print head 200.

In addition, the printing device 100 is provided with a print surface drive system 110 that is capable of moving the printing surface 600 relative to the print head 200 and in two directions that are generally parallel to the x and z axes.

Figure 3:
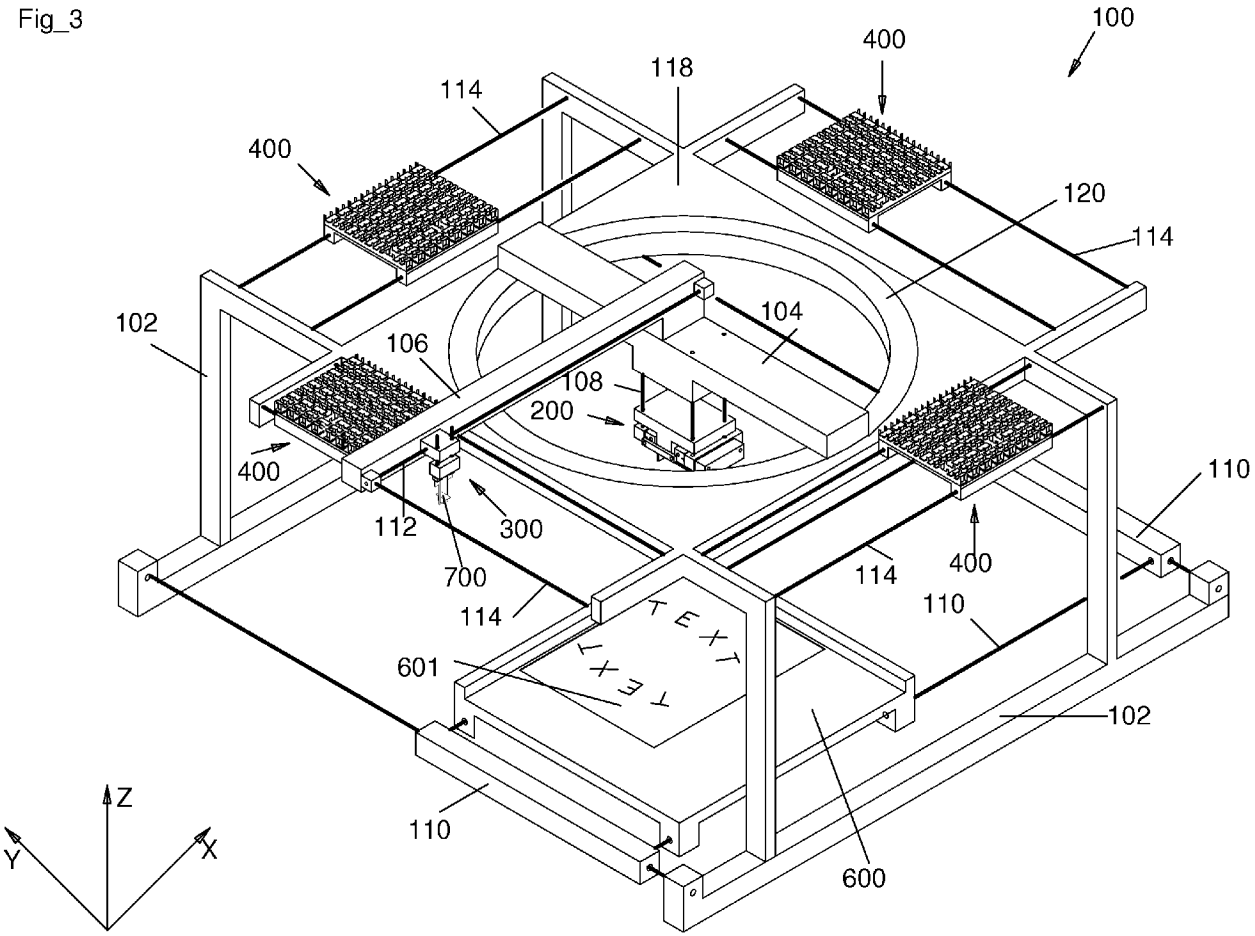
FIG. 3 is an embodiment of a printing device of the present invention adapted to move rotationally.
Figure 4:
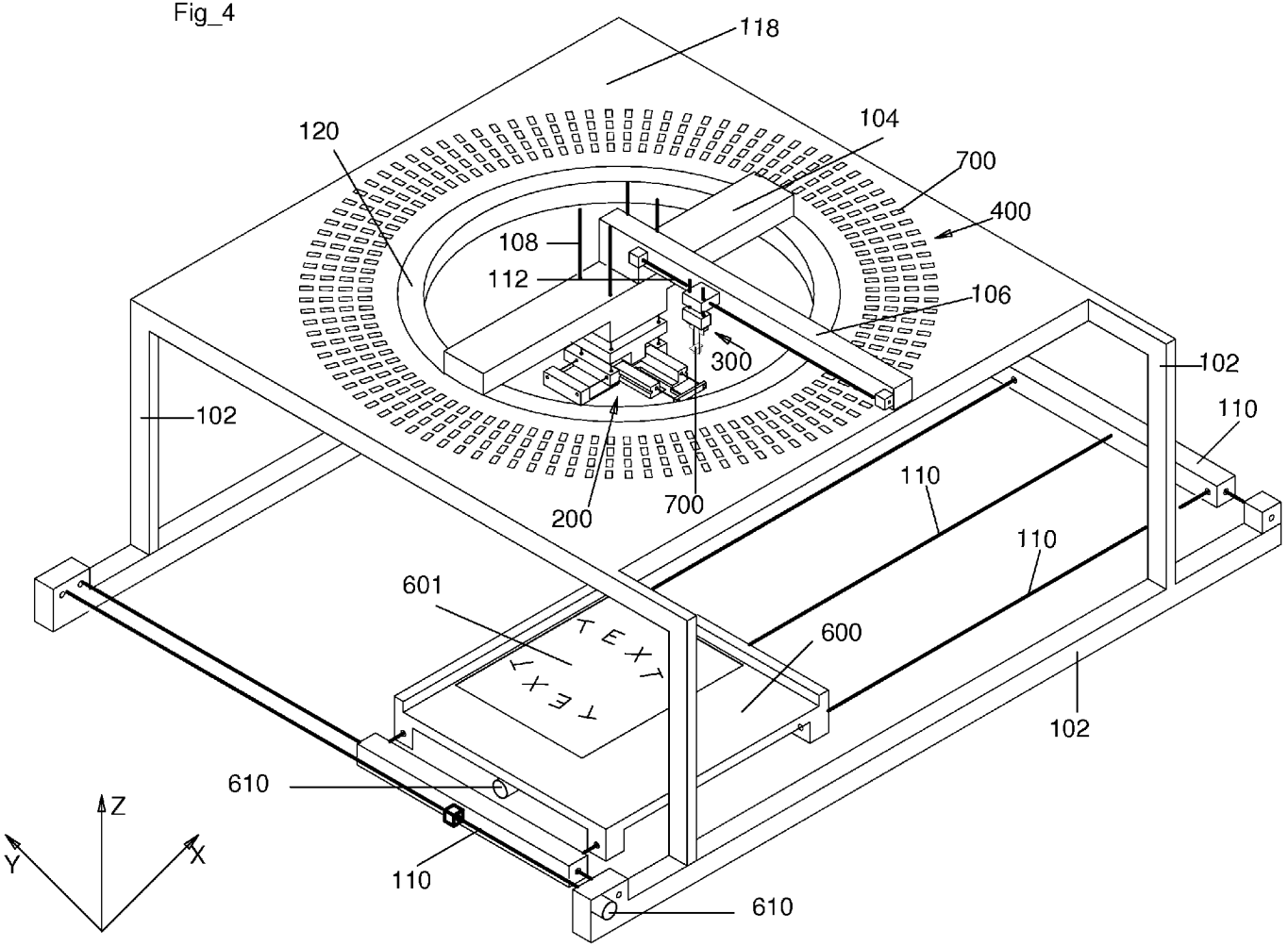
FIG. 4 is another embodiment of a printing device of the present invention adapted to move rotationally.

Referring to FIGS. 3 and 4, another embodiment of a printing device 100 of the present invention is provided with a frame 102 having a first structure 104 to support a print head 200 and a second structure 106 to support a pick-up head 300. The printing device is also provided with a frame base 118 that supports one or more die storage racks 400 and a printing surface 600. The first structure 104 is rotationally mounted to the frame base 118. The printing device 100 is also provided with a frame drive system 120 capable of rotating the first structure 104 relative to the frame base 118 and about an axis that is substantially parallel to the z axis.

The printing device 100 may be provided with a print head drive system 108 capable of moving the print head 200 relative to the first structure 104, and substantially parallel to a longitudinal axis of the first structure 104. The printing device may also be provided with a pick-up head drive system 112 capable of moving the pick-up head 300 relative to the second structure 106, and substantially parallel to a longitudinal axis of the second structure 106.

The printing device 100 is also provided with a horizontal printing surface 600, and is provided with a printing surface drive system 110 capable of moving the printing surface about along two substantially horizontal directions.

As shown in FIG. 3, the base frame 118 is provided with four die storage racks 400. These racks and contents may be identical, or the racks may contain different type sets. The base frame 118 may also be provided with storage rack drive systems 114, each capable of moving each storage rack 400 in a single, substantially horizontal direction. Alternatively, the drive systems 114 may move the storage racks 400 about one or more directions.

As shown in FIG. 4, the base frame 118 is provided with a large single die storage rack 400 that may be integrated with the base frame 118. The storage rack 400 is adapted to store print die 700 radially about a vertical axis. The print die 700 may be arranged radially about the same axis about which the first structure 104 rotates. The storage rack may contain a single or multiple die sets. As shown, the die storage rack is stationary, but it may alternatively be provided with a drive system to rotate it.

Figure 39A:
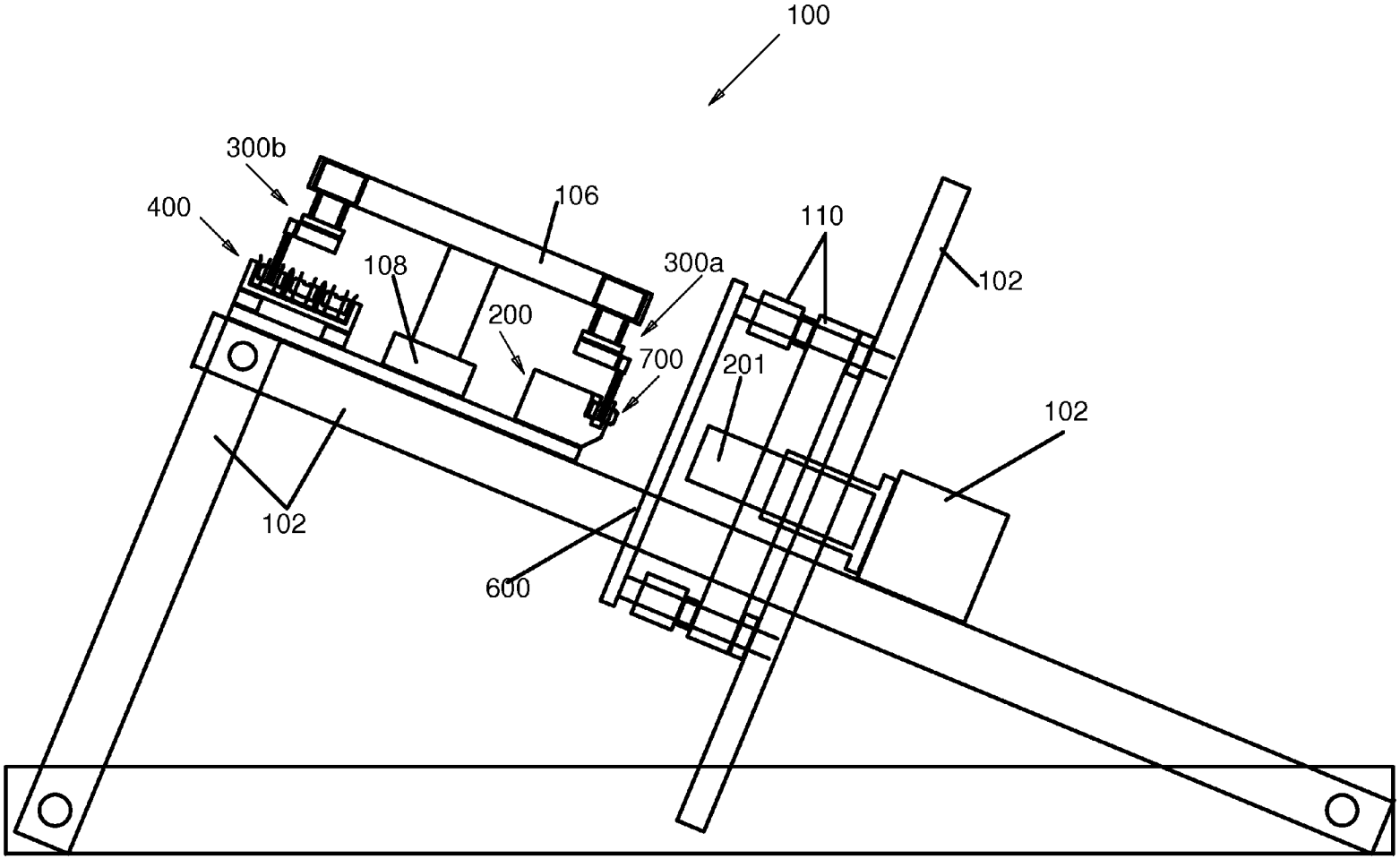
FIGS. 39A-39D illustrate a particular embodiment of a printing device of the present invention, which is adapted to print on an angled surface.
Figure 39B:
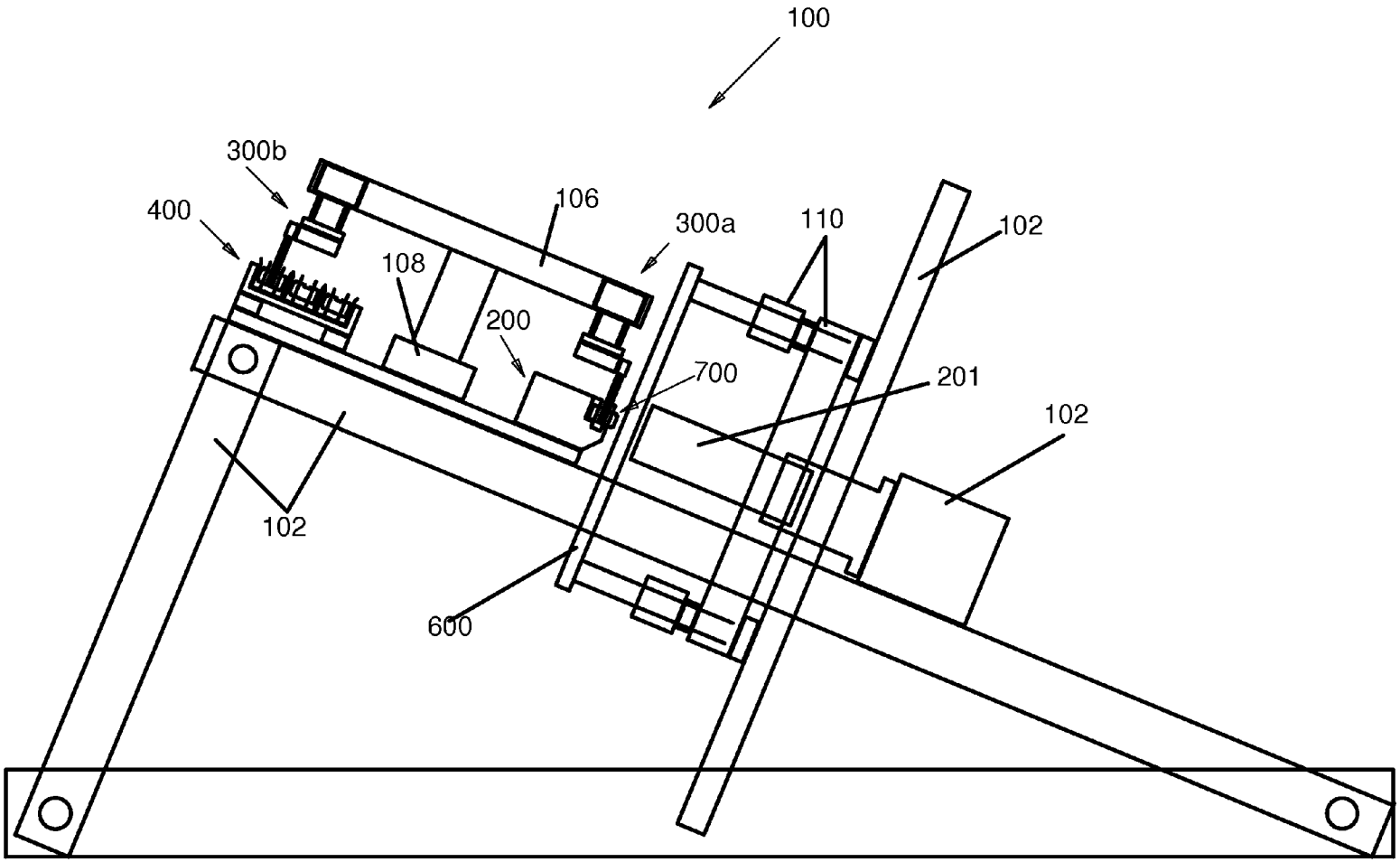
Figure 39C:
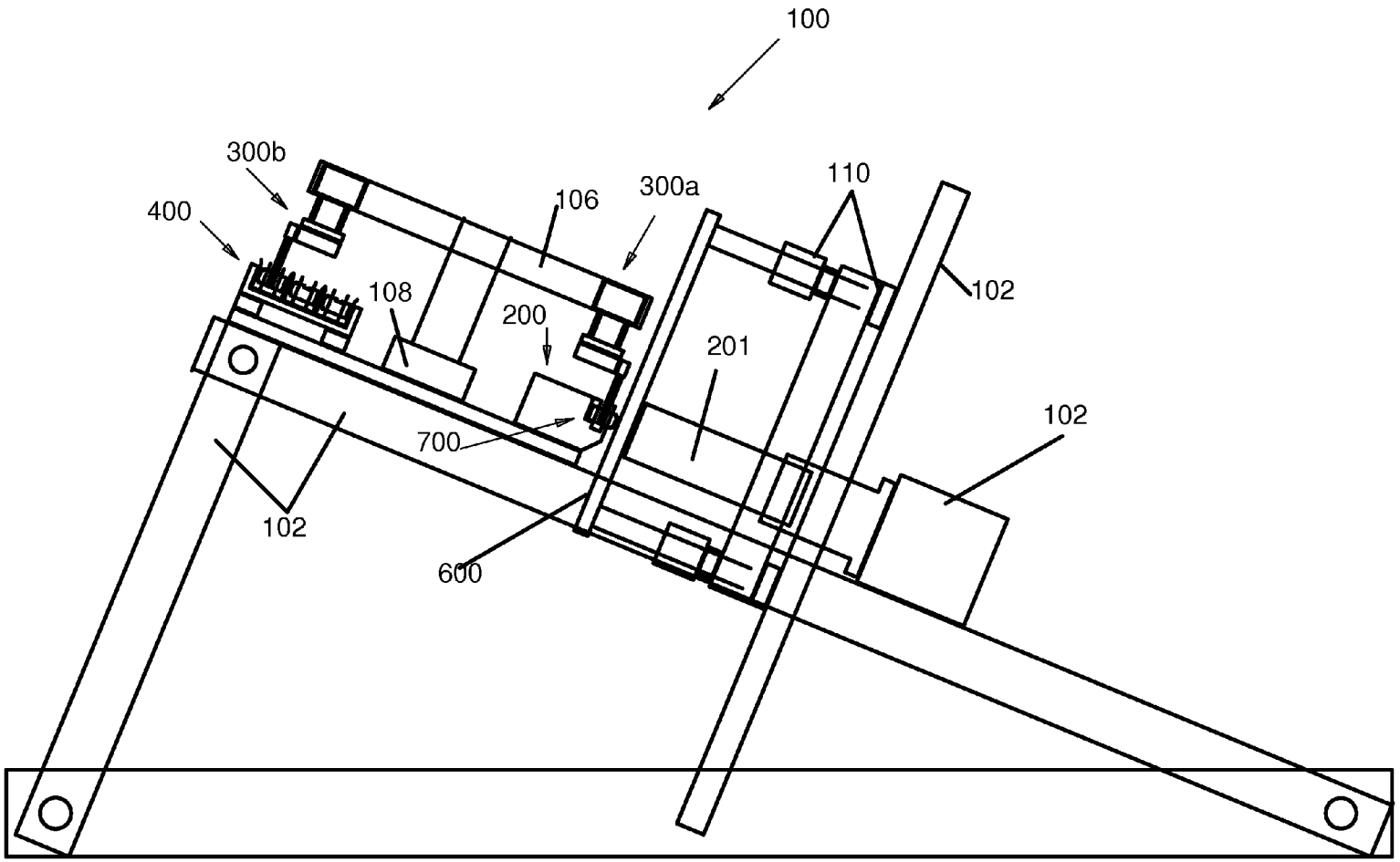
Figure 39D:
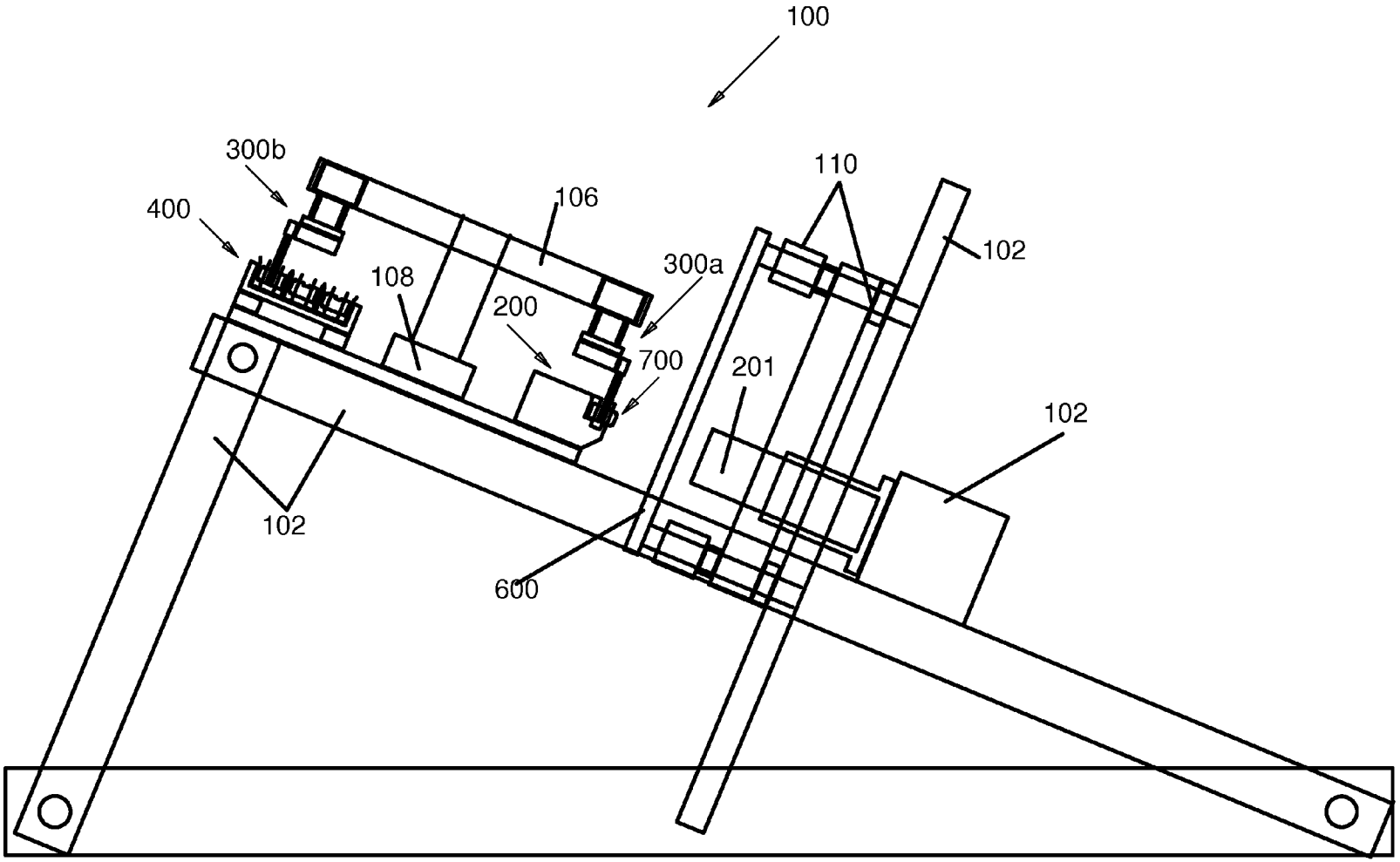

Referring now to FIGS. 39A-39D, the entire assembly 100 may be mounted at an angle between completely horizontal or vertical. Furthermore, the print media 601 may be moved relative to the printhead 200, while keeping the printhead 200 stationary FIG. 39A shows a print surface 600 in a first position, and 39B shows the print surface 600 in a second position in contact with a print die 700. FIG. 39C shows that the print surface 600 may be moved in a direction lateral to the position shown in FIG. 39B. FIG. 39D shows that the print surface 600 may be retracted in that different lateral position. The print surface 600 may also move in a direction in and out of the page (not shown).

The combined relative motions of the print head 200, the pick-up head 300, the die storage rack(s) 400, and the printing surface 600. Allow the printing device 100 to select individual die 700 and print them anywhere and in any orientation on the print media 601.

Referring now to FIGS. 5A-10C, print dies 700 of the present invention will now be discussed.

Figure 5A:
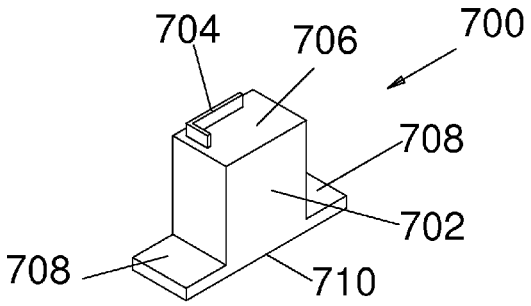
FIGS. 5A-5G show examples of embodiments of printing die of the present invention that may be used with the printing device of the present invention.
Figure 5B:
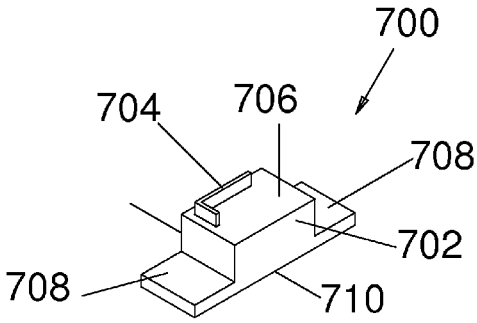
Figure 5C:
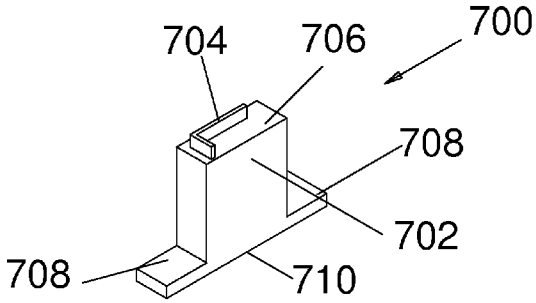
Figure 5D:
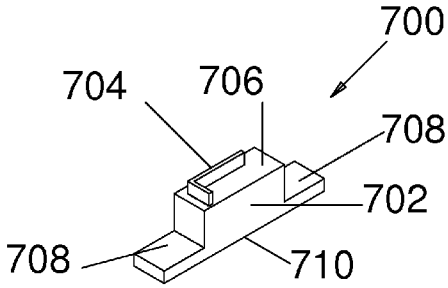
Figure 5E:
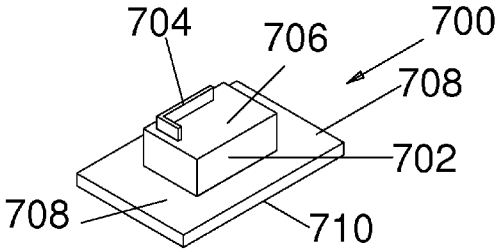
Figure 5F:
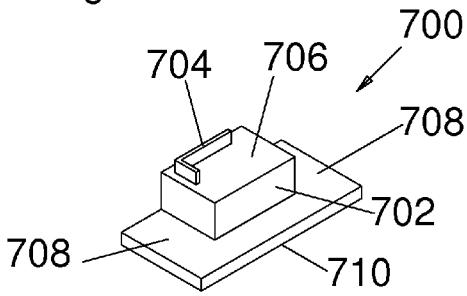
Figure 5G:
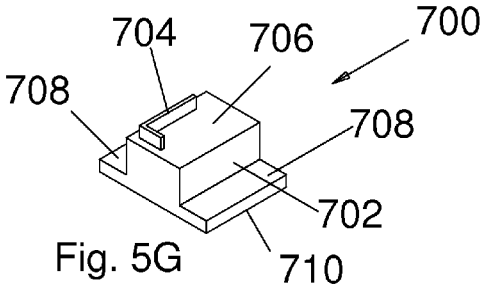

Referring specifically to FIGS. 5A-5G, a print die 700 associated with an embodiment of the present invention is provided with a rectangular prismatic body 702 with a raised character or word 704 on a first substantially planar surface 706. The die 700 is further provided with one or more planar extensions 708 extending from a substantially planar surface 710 opposite of and parallel to the first substantially planar surface 706. The planar extensions 708 generally extend away from the die main body 702 along a plane parallel to planar surfaces 706, 710. The extensions 708 may extend from two sides of the main body 702, as shown in FIGS. 5A-5D, and 5G, or extend from three or four sides of the main body 702 as shown in FIGS. 5E and 5F, respectively. In addition, the die may be made of a standard width, as shown in FIGS. 5A and 5B, or alternatively, the die width may be dependent upon the width of the character 704, as shown in FIGS. 5C and 5D.

Figure 6A:
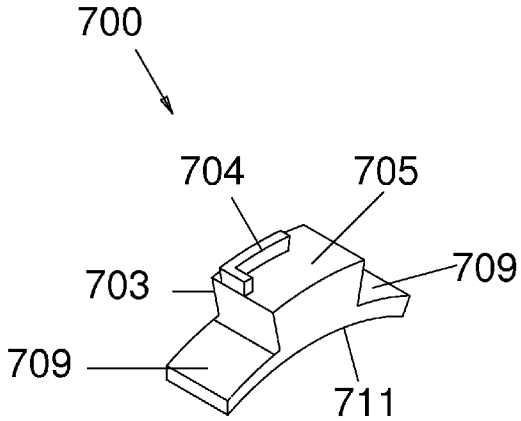
FIGS. 6A-6C show examples of embodiments of printing die of the present invention that may be used for roll printing with the printing device of the present invention.
Figure 6B:
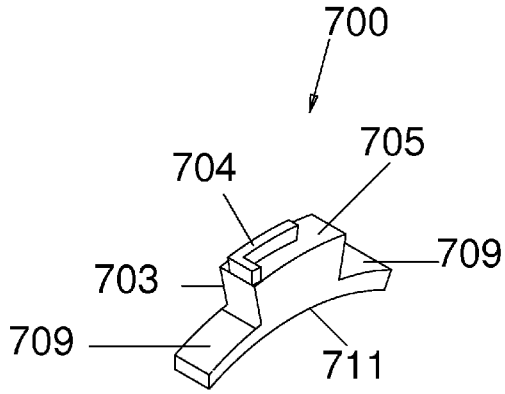
Figure 6C:
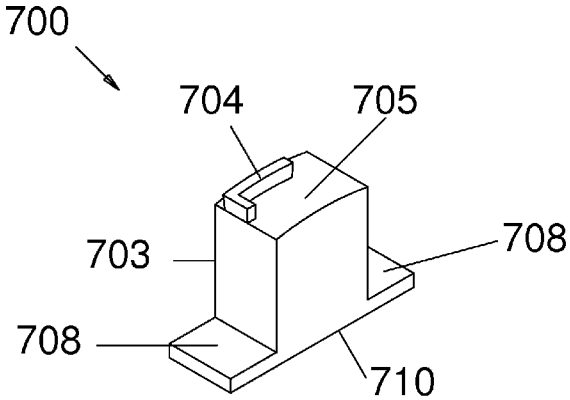

Referring now to FIGS. 6A and 6B, a die 700 may also be configured for roll printing (discussed in greater detail herein). The curved die 700 is provided with a solid main body 703 having a concavo-convex form with raised lettering 704 on the convex surface 705 and one or more concavo-convex extensions 709 extending from the concave surface 711. FIG. 6C depicts a die 700 with a main body 703 having raised lettering 704 on a convex surface 705 and an opposite substantially planar surface 710. The main body 703 has planar extensions 708 extending from the main body 703 and parallel to the planar surface 710.

Figure 7A:
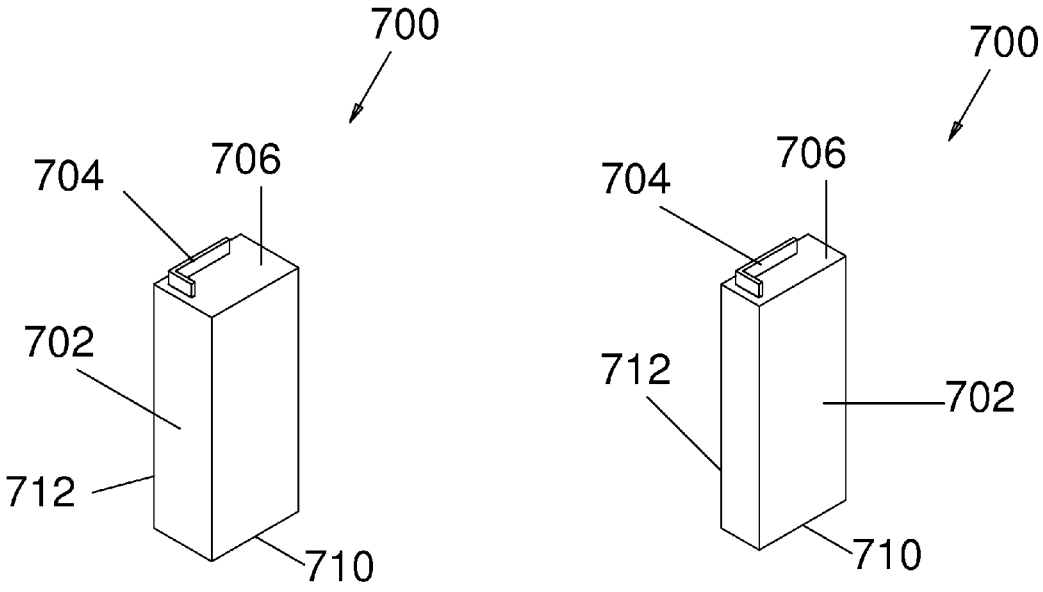

Referring now to FIGS. 7A-7C, a print die 700 is described for printing on a vertical surface. The print die 700 has a substantially rectangular prismatic body 702, with a raised character 704 extending from a first substantially planar surface 706. One or more edges 712 of the body are also provided with a transitional surface 714. The transitional surfaces 714 help distinguish one die 700 from another with they are in a stacked formation. This may also help separate one die 700 from a stack by mechanical devices, such as a printing 100 device of the present invention.

Figure 8B:
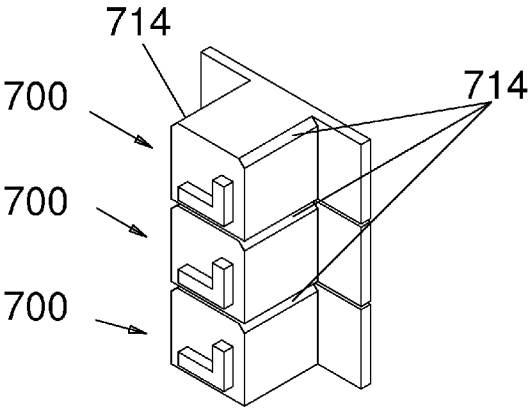
Figure 8D:
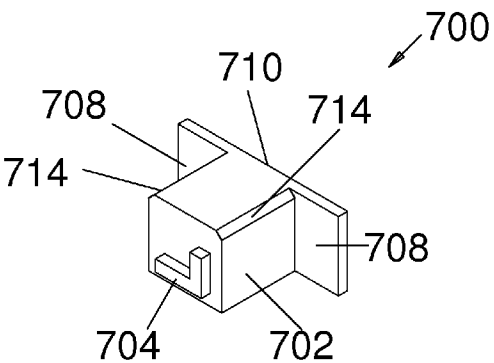
Figure 8A:
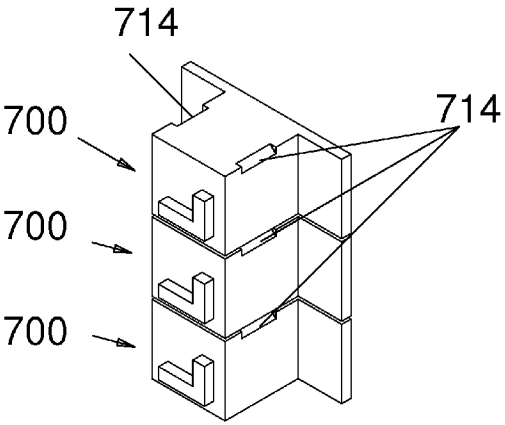
Figure 8C:
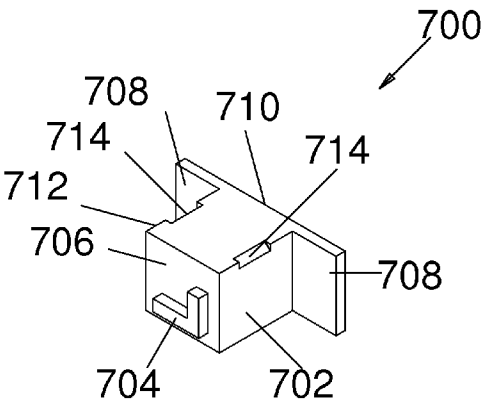
Figure 9B:
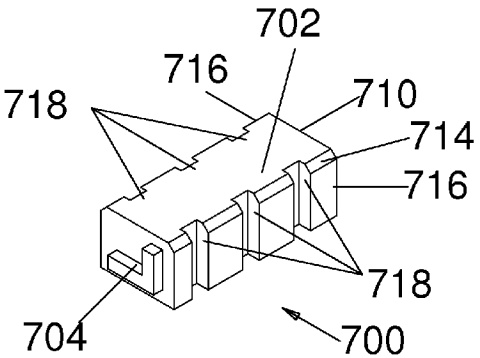
Figure 9D:
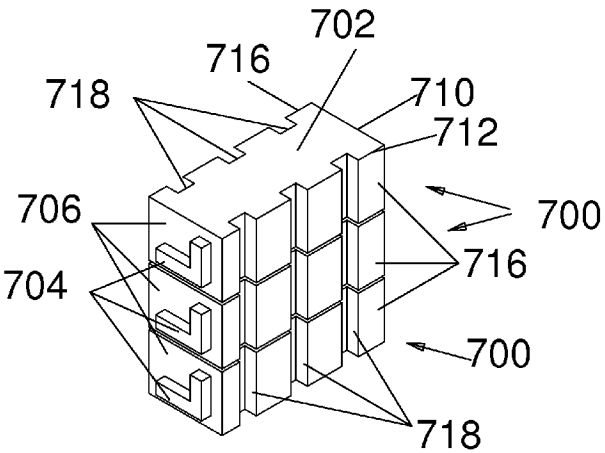
Figure 9A:
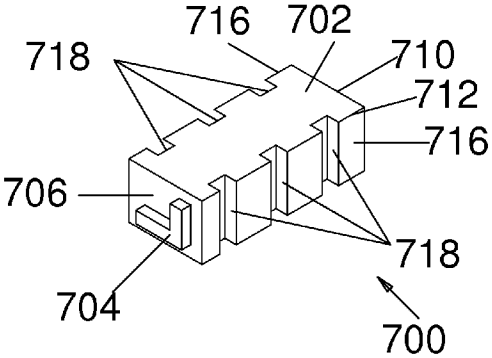
Figure 9C:
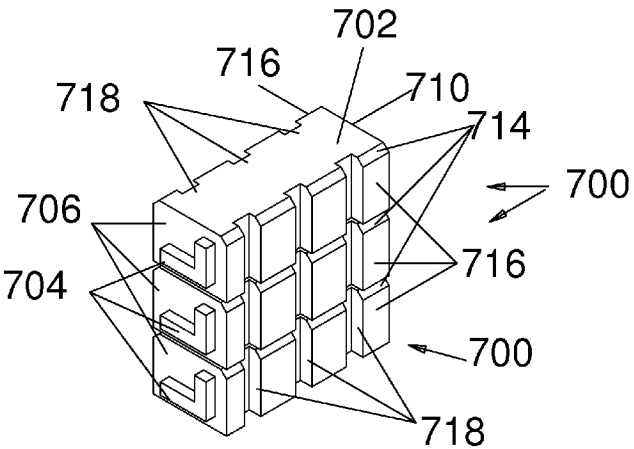

Referring now to FIGS. 8A-8B, a print die 700 is provided with a rectangular prismatic body 702 with a raised character 704 on a first substantially planar surface 706. The die 700 is further provided with one or more planar extensions 708 extending from a second substantially planar surface 710 opposite of and parallel to the first substantially planar surface. The planar extensions 708 generally extend away from the die main body 702 along a plane parallel to planar surfaces 706, 710. One or more edges 712 of the body are also provided with a transitional surface 714.

Referring now to FIGS. 9A-10C, a print die 700 for printing on a vertical surface is provided. The print die 700 has a substantially rectangular prismatic body 702, with a raised character 704 extending from a first substantially planar surface 706. One or more edges 712 of the body are also provided with a transitional surface 714. The body 702 is provided with substantially parallel side surfaces 716 that are substantially orthogonal to the first substantially planar surface 706. These side surfaces 716 may be provided with one or more channels 718 that extend substantially across the width of the side surfaces 716. The channels 718 may be oriented with uniform spacing or they may be offset from one another or from one end of the body 702. The transitional surfaces 714 help distinguish one die 700 from another with they are in a stacked formation. The transitional surfaces 714 and the channels 718 may also facilitate separating and grasping by a mechanical device, such as a printing 100 device of the present invention.

Referring now to FIGS. 11A-14F, an embodiment of a print head 200 of the present invention is provided with a print die holder 202, a first clamp 204, a second clamp 206, and a backing plate 208. The print head 200 may also be provided with a heater, located in the print die holder 202, the backing plate 208, or both.

The print die holder 202 is provided with a print head opening 220 surrounded by a flat support surface 222. A die 700 may be placed into the print head print die holder 202 by the pickup head 300 (which is explained in greater detail herein). The die main body 702 is positioned to extend through the opening 220 with the die arms 708 resting on the flat support surface 222. The opening 220 may further be provided with a side opening 224, allowing the pickup head 300 access into the main opening 220 to pickup and deposit die 700. The print die holder 202 may also be provided with reference datums to ensure reliable and repeatable positioning of the die 700 in the print die holder 202. For example, two vertical surfaces 226, 228 of the opening 220, or portions thereof, may be datums to ensure consistent horizontal placement of the die 700. Further, the flat support surface 222, or a portion thereof, may act as another datum to ensure consistent vertical placement of the die 700. The print die holder 202 may further be provided with a removable or integrated heater. The opening is preferably larger than the die main body 702 in order to accommodate a variety of die sizes.

After the die is placed in the opening 220, the first clamp 204 moves in a first direction and the second clamp 206 moves in a second direction. Both clamps 204, 206 move toward the die 700 to bias the die 700 against the vertical datums 226, 228. Prior to printing, the backer plate 208 also moves downward toward the die 710 to bias the die arms against the horizontal datum 222. The clamps 204, 206, and backer plate 208 may be actuated by drive mechanisms 230, for example, pneumatic cylinders, hydraulic cylinders, linear motors, solenoids, rotary motors coupled to a transmission that translates rotary motion into linear motion, any other electrical, mechanical or electro-mechanical means generally known in the art, or any combination thereof.

Figure 11A:
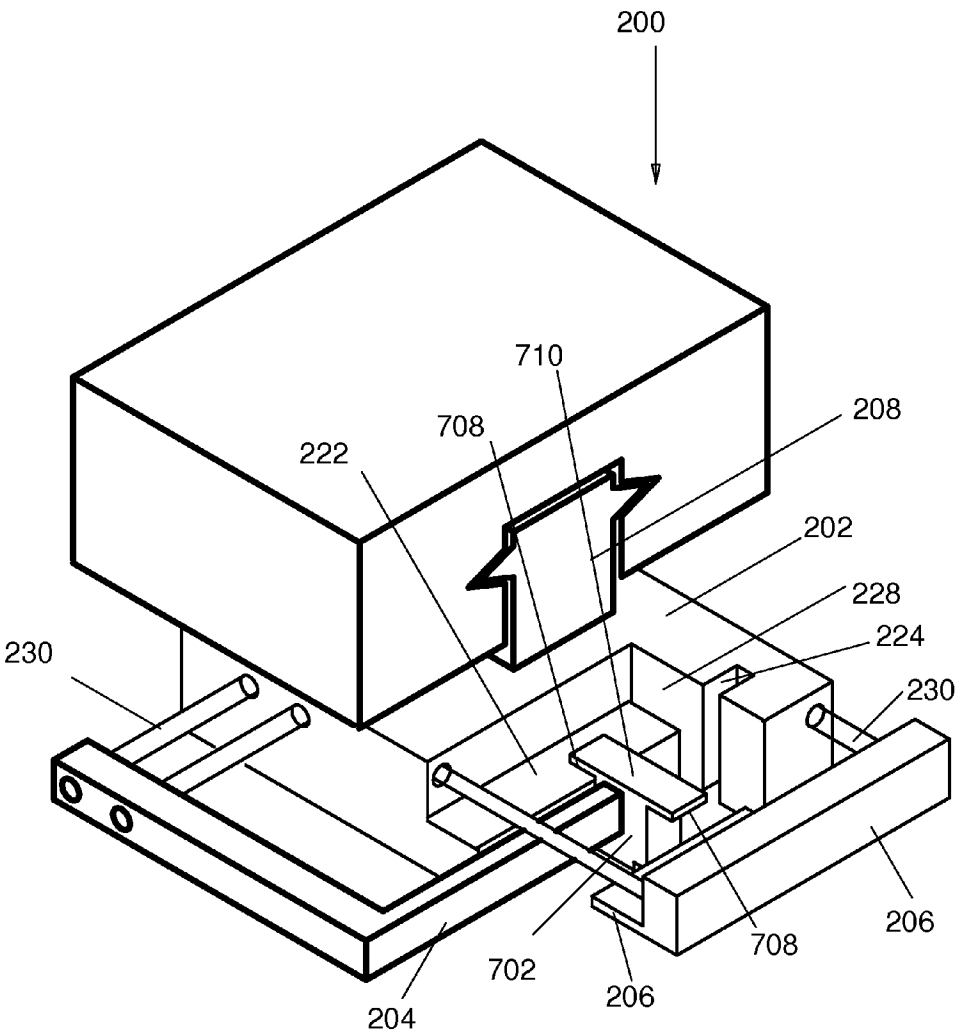
FIGS. 11A-11C illustrate an embodiment of a print head for a printing device of the present invention.
Figure 11B:
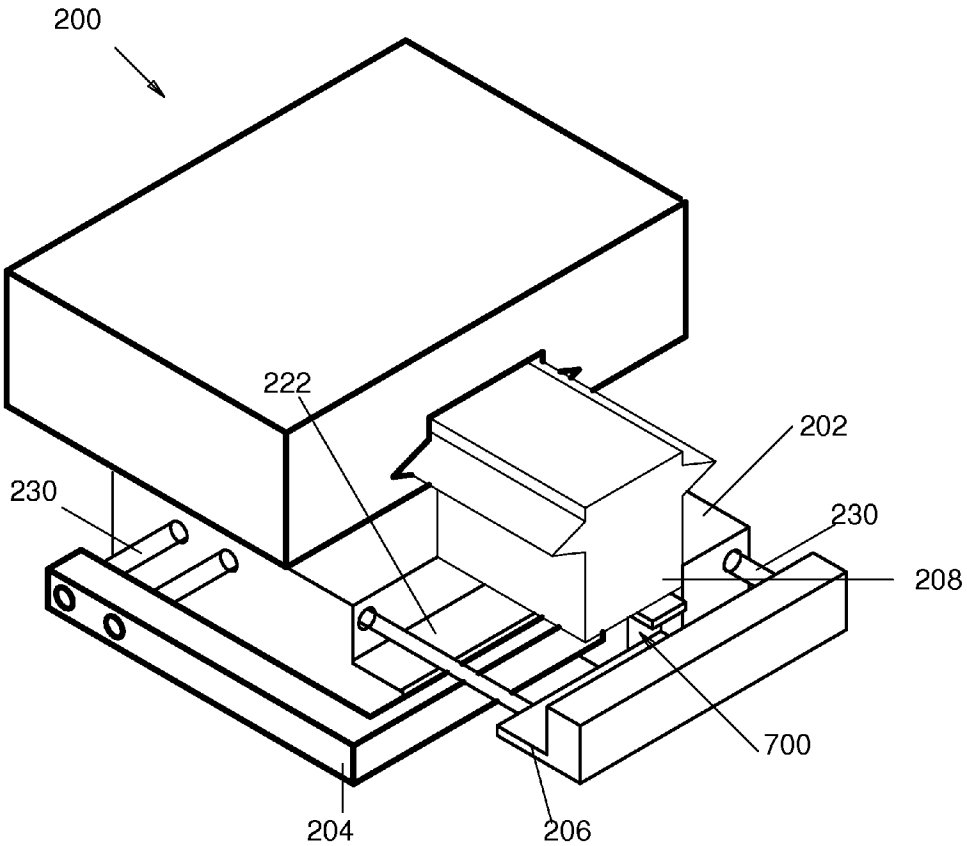
Figure 11C:
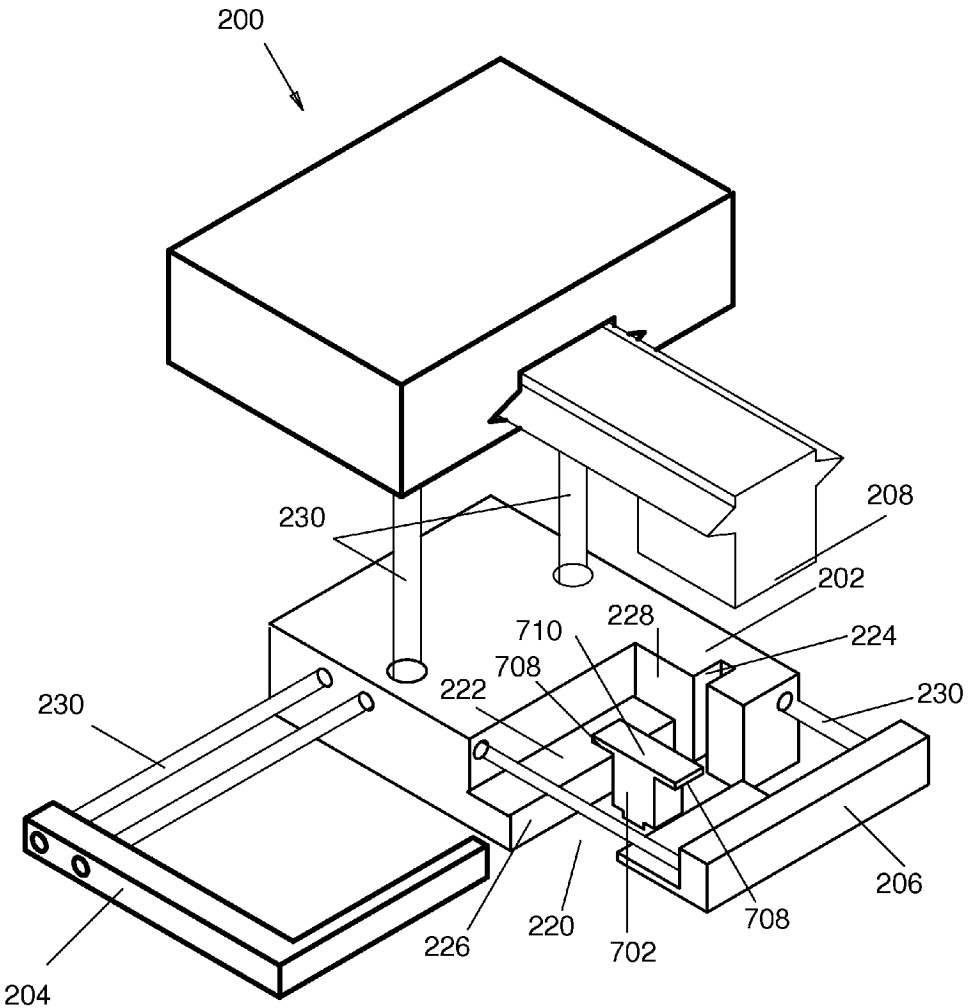
Figure 12A:
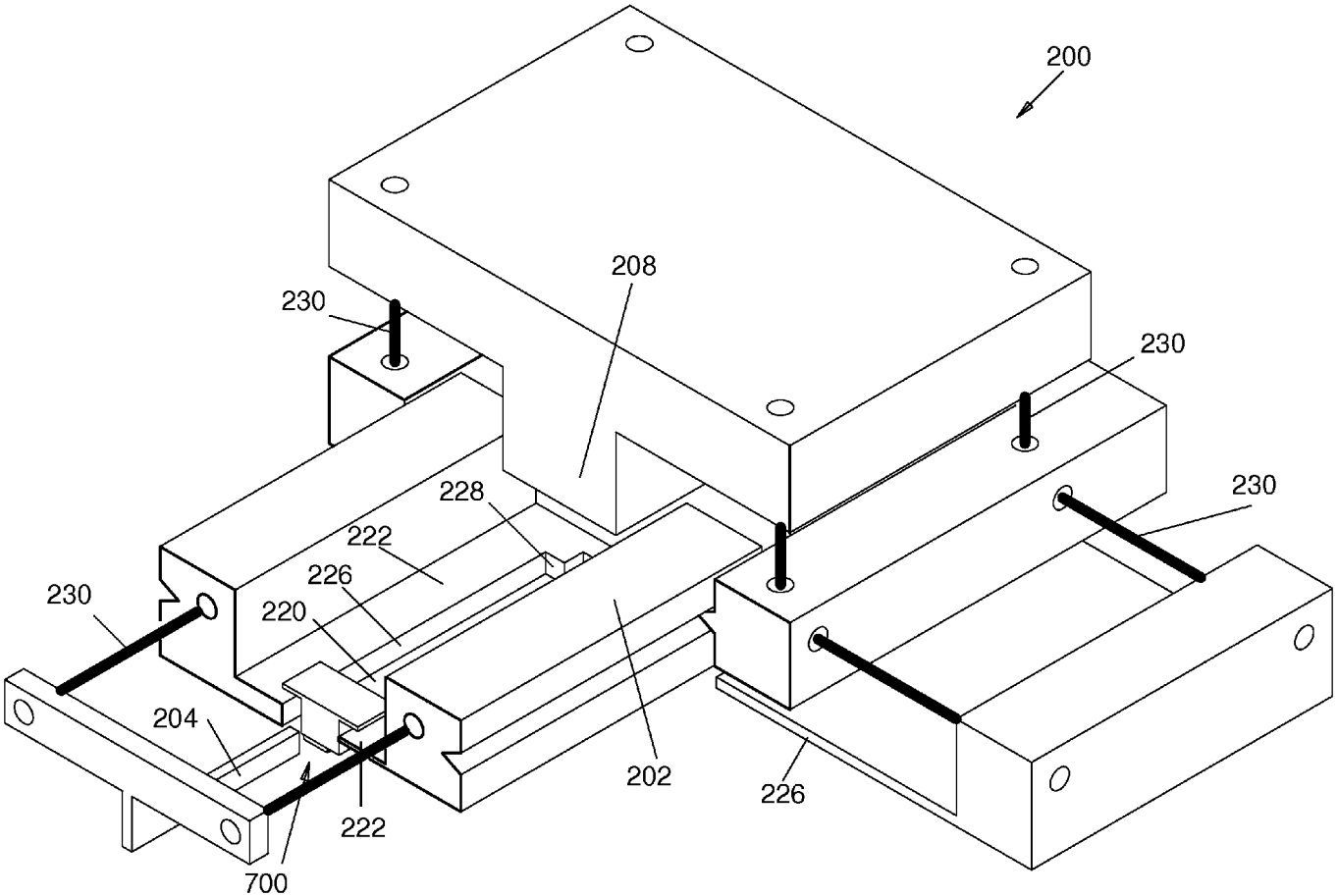
FIGS. 12A-12C illustrate another embodiment of a print head for a printing device of the present invention.
Figure 12B:
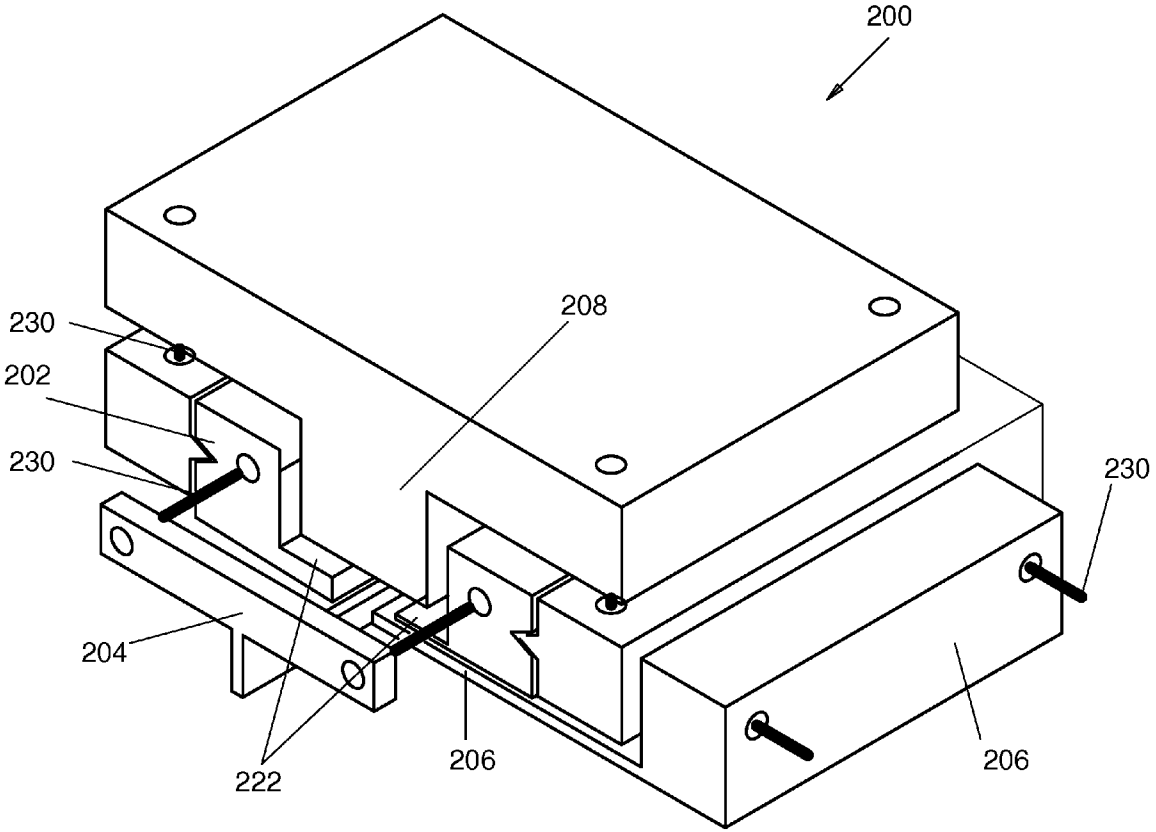
Figure 12C:
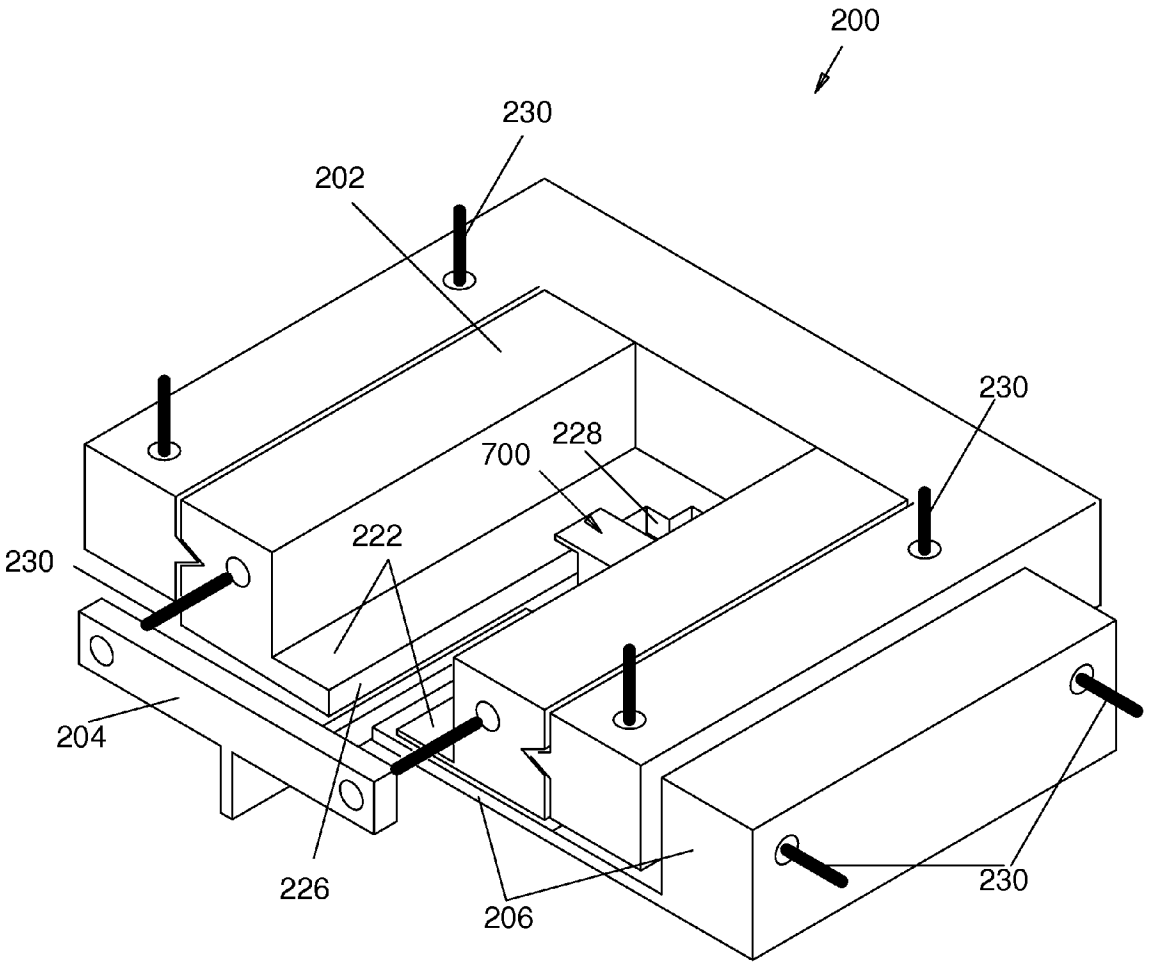
Figure 13:
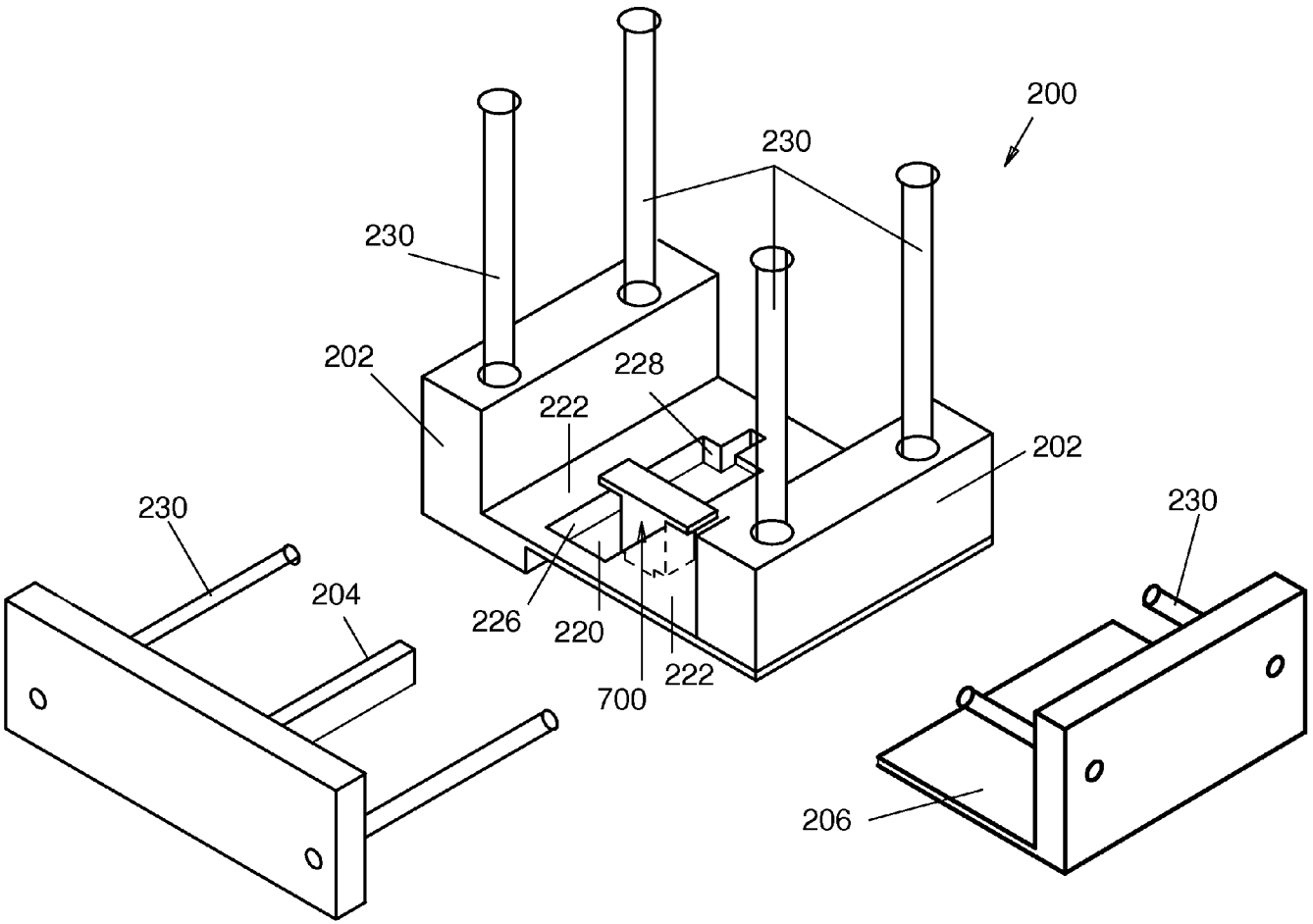
FIG. 13 illustrates an embodiment of a support plate of a print head of the present invention.

FIGS. 11A-11C show a print head 200 provided with a print head opening 220 with two open sides. FIGS. 12A-12C depict a print head 200 provided with a print head opening 220 with only one open side and two horizontal support surfaces 222. FIG. 13 depicts a print head 200 with a completely enclosed print head opening 220.

Referring now to FIGS. 14A-14E, and 38A-38D, an embodiment of a print head 200 is provided with an extended print head opening 220 to facility a plurality of print dies 700. This embodiment functions in a substantially similar manner to the embodiments shown and described in FIGS. 11A-13. However, because it is provided with a much longer print head opening 220, it presents unique challenges to removing the print dies 700 from the print head 200. The embodiment of FIGS. 14A-14E may be used with horizontal, angled, or vertical print media, while the embodiment shown in FIGS. 38A-38D may be used with print media at any orientation.

Figure 14A:
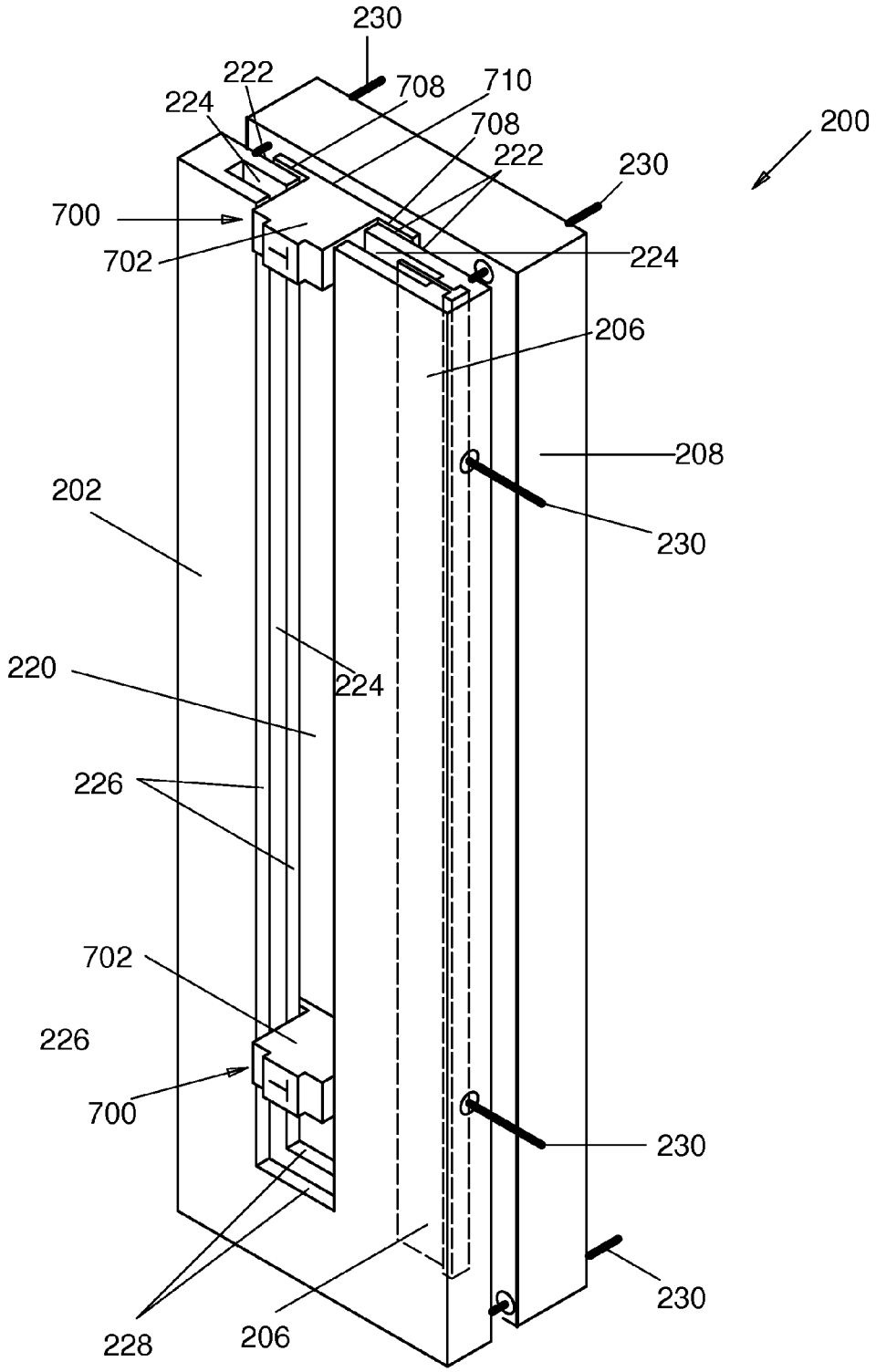
FIGS. 14A-14E show an embodiment of a print head for a printing device of the present invention, adapted to print with multiple print die.
Figure 14B:
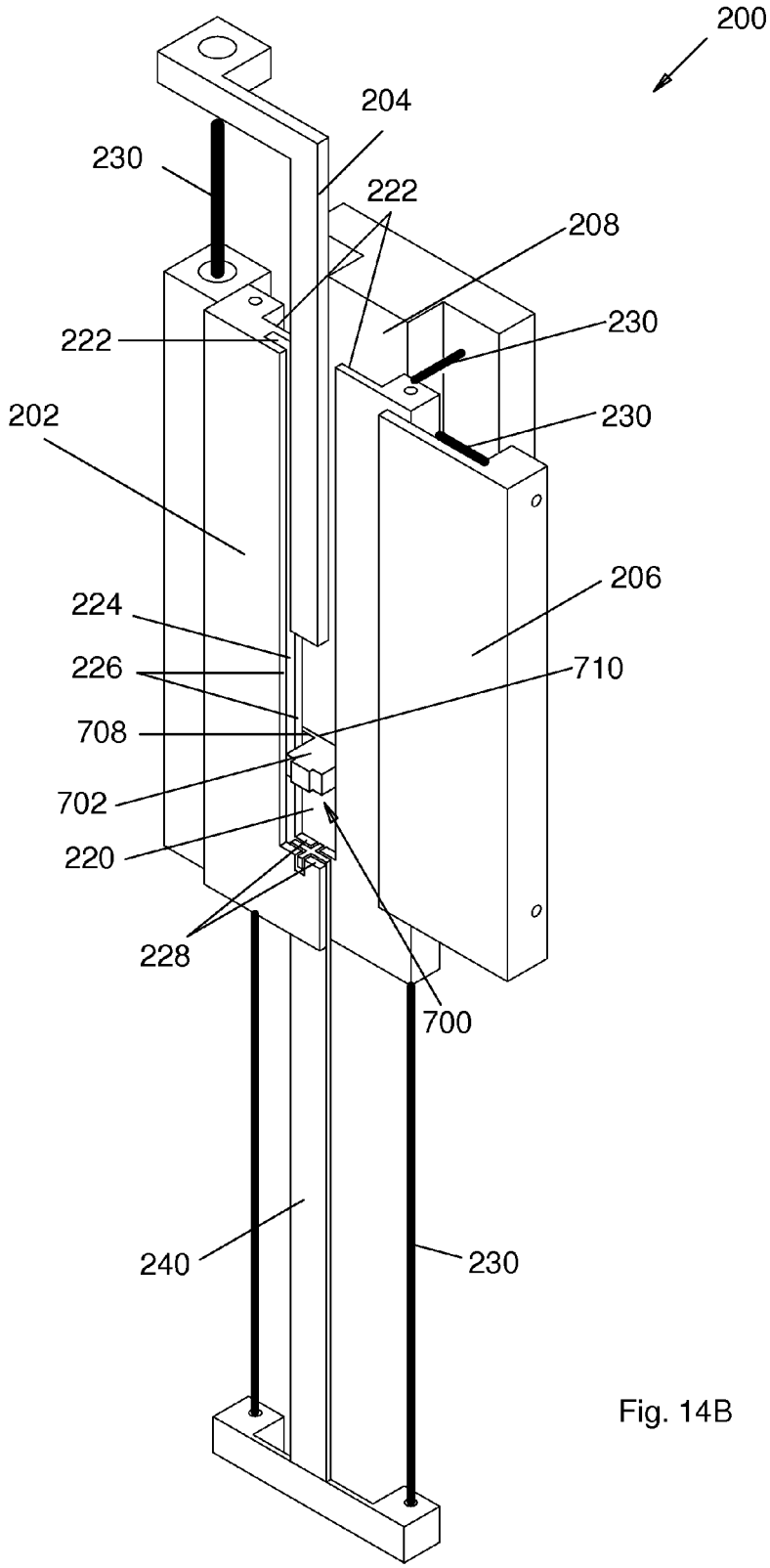
Figure 14C:
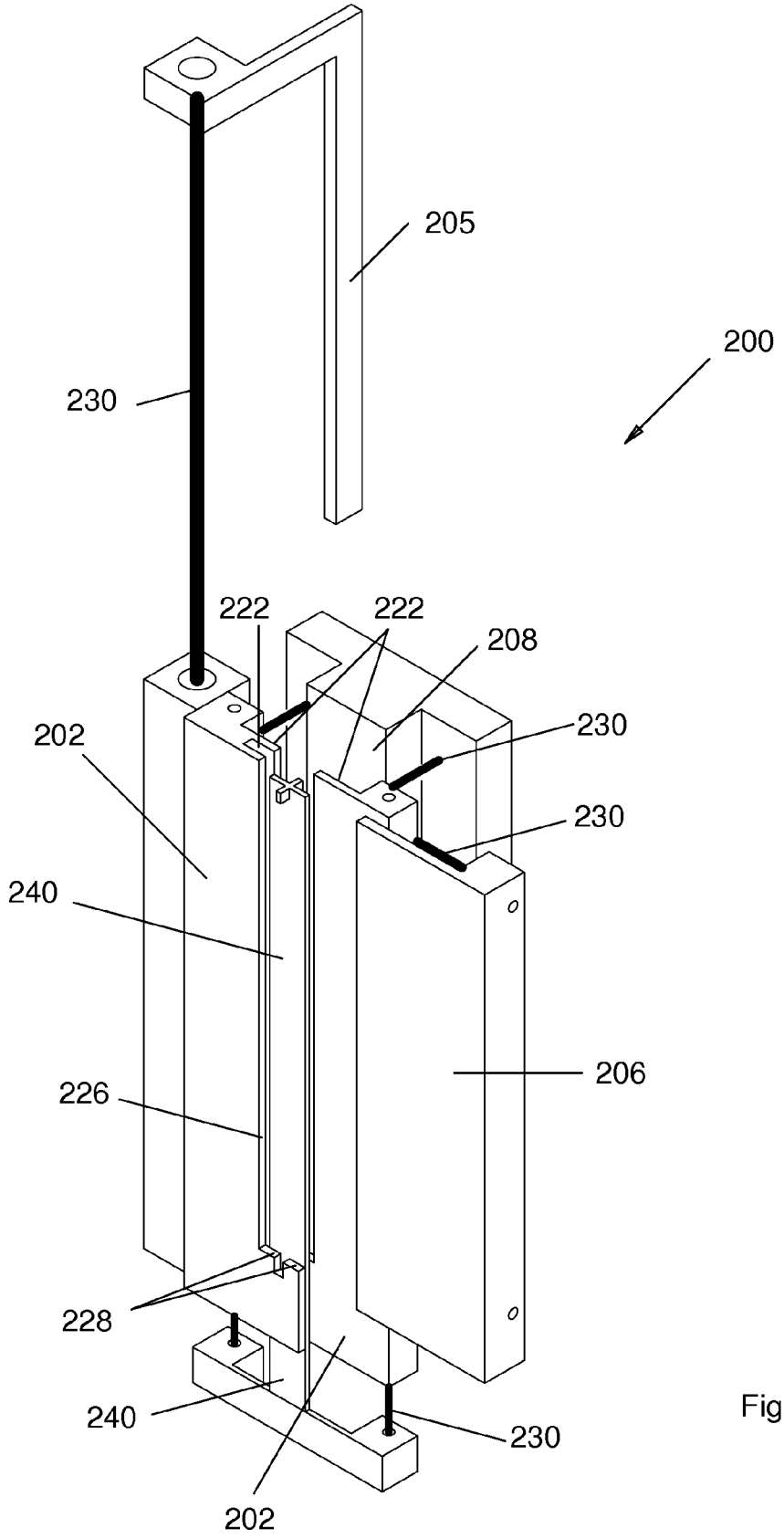

Referring back to FIGS. 14A-14E, the print head 200 is provided with a first clamp 204 and a second clamp 206. As shown in FIGS. 14B, and 14C, the print head 200 may also be provided with a push rod 240. The first clamp 204 functions to bias the print die 700 at one end of the print head opening 220, while the push rod 240 is utilized to move the print die to an opposite end of the print head opening 220 and to a location free from obstacles to allow the pickup head 300 to easily remove the print die 700 from the print head 200. To further facilitate this end, the first clamp 204 may also be adapted to pivot out of the way as shown in FIG. 14C.

Figure 14D:
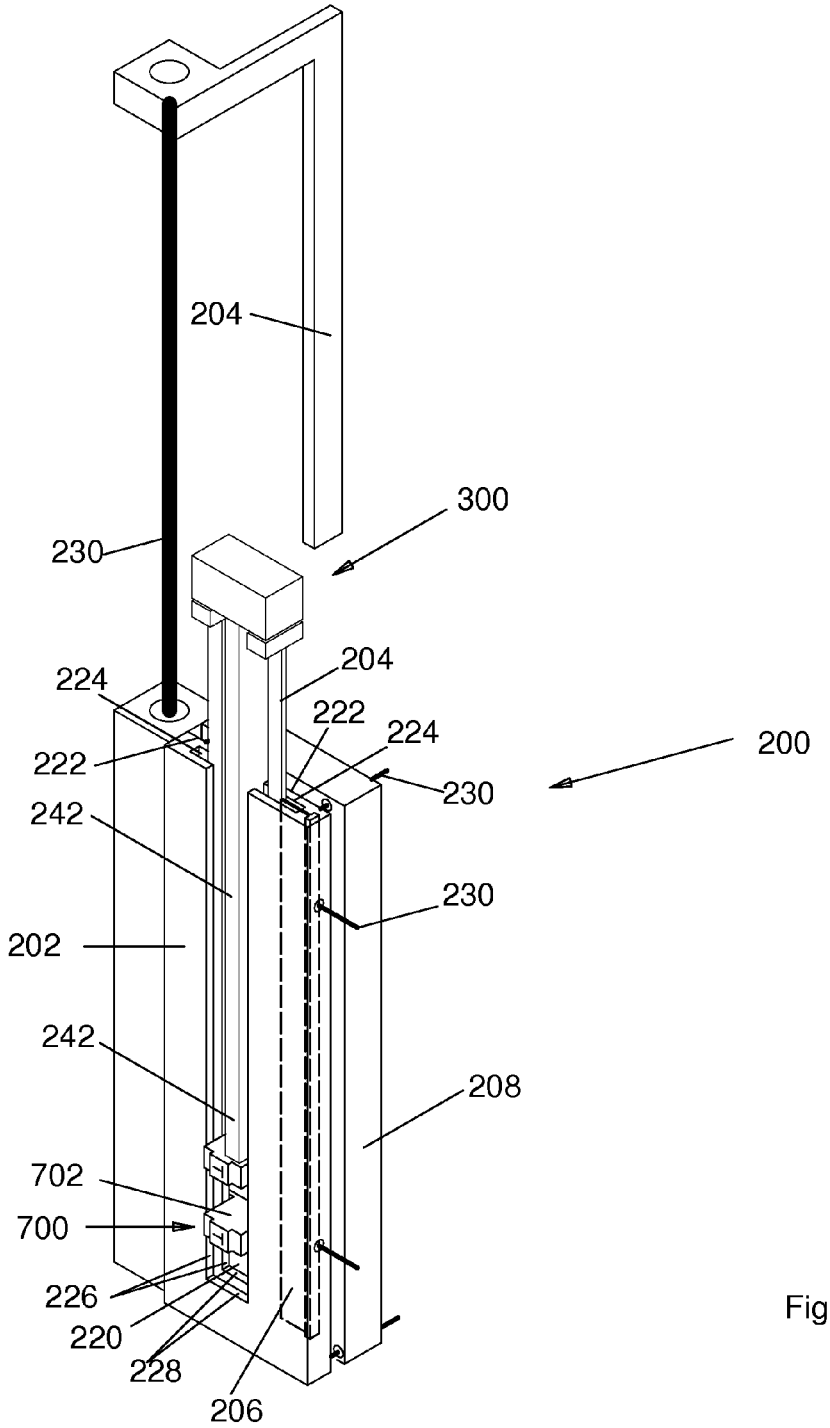
Figure 14E:
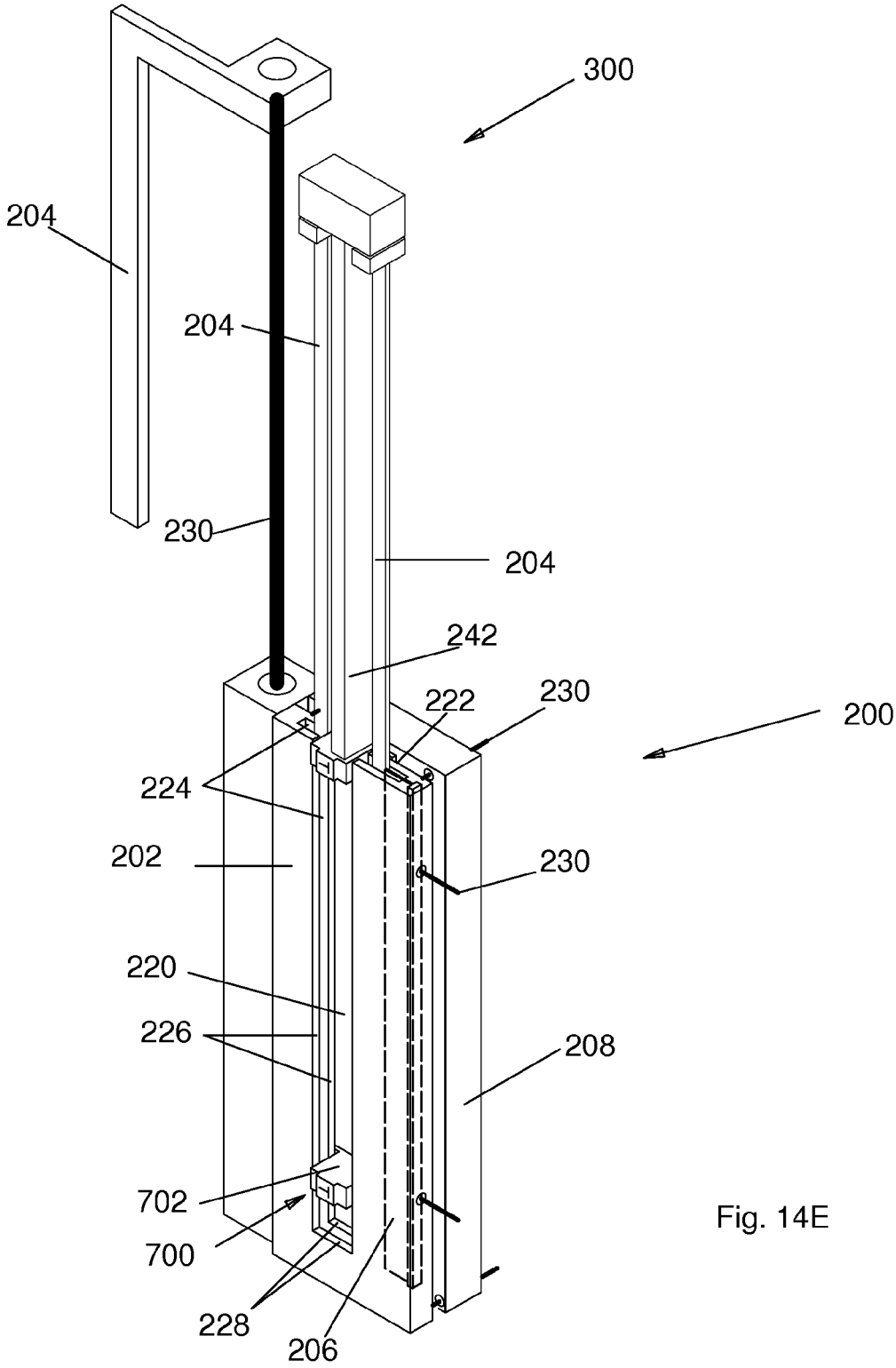

Referring now to FIGS. 14D and 14E, the print head 200 may alternatively be provided with a vacuum 242. The vacuum 242 would be used to pull the print die 700 from that end to an opposite end of the print head opening 220.

Referring to FIGS. 38A-38D, the print head 200 is provided with a support surface 222 for supporting die 700, and vertical surfaces 208 and 228 for biasing the die 700 against. The die 700 used with this print head 200 may be provided with beveled edges 714 to assist the fingers 304, 306 of the pick up head 300 in separating and picking up individual die 700. The fingers may also have thinned distal edges 309 to further assist in separating the die 700. The print head 200 may also be provided with a clamp 204 to secure and bias the print die 700.

Figure 15:
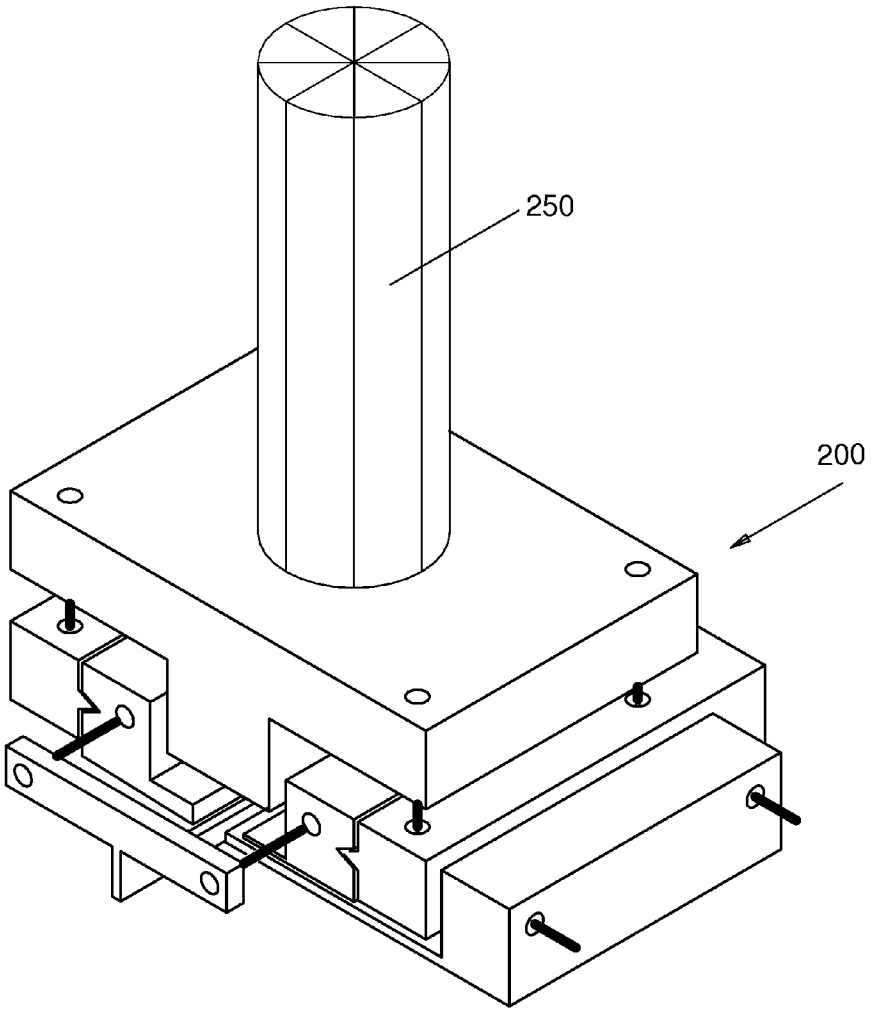
FIG. 15 is an embodiment of a print head for a printing device of the present invention, adapted for rotational movement.
Figure 16:
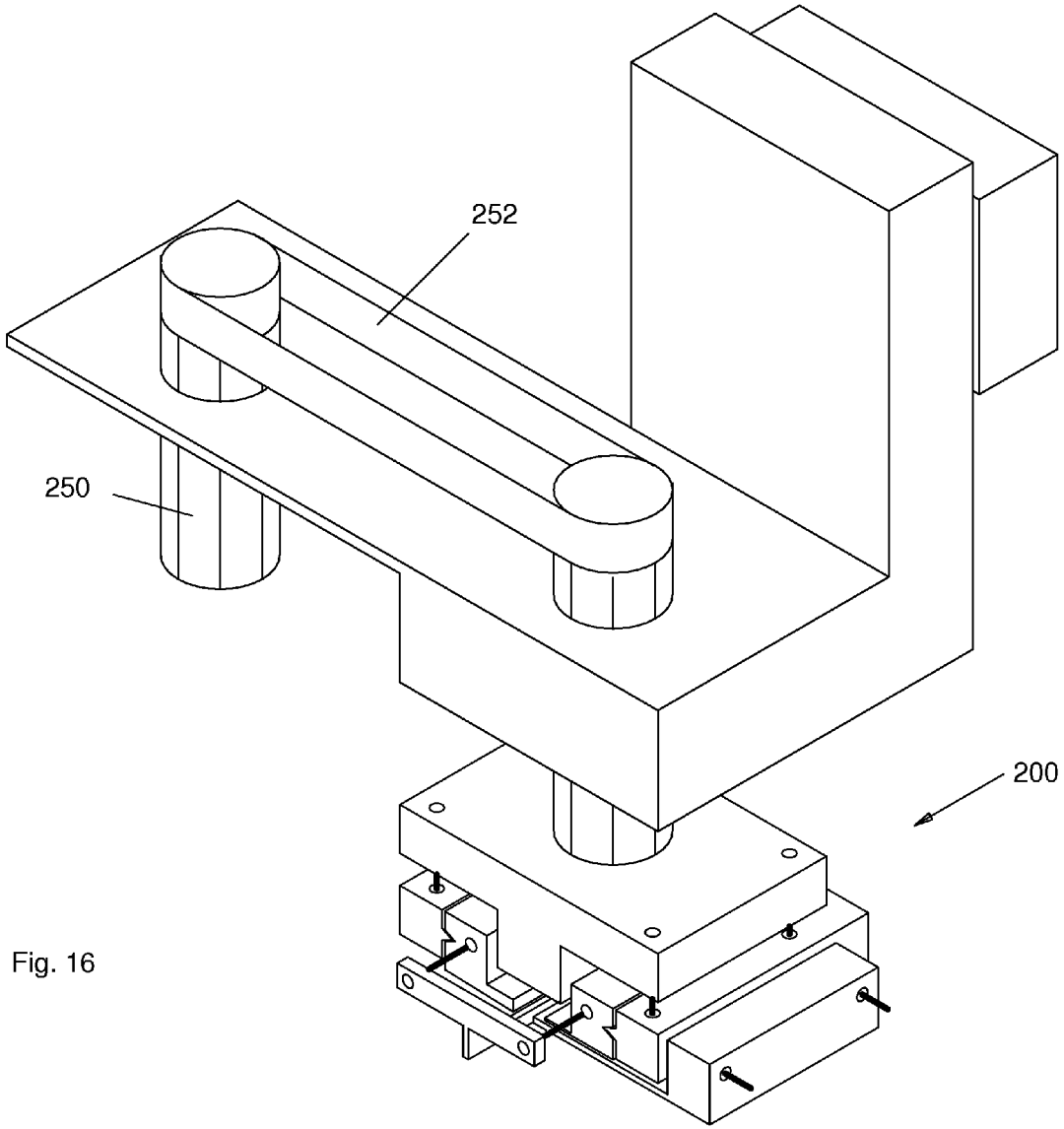
FIG. 16 is another embodiment of a print head for a printing device of the present invention, adapted for rotational movement.
Figure 17B:
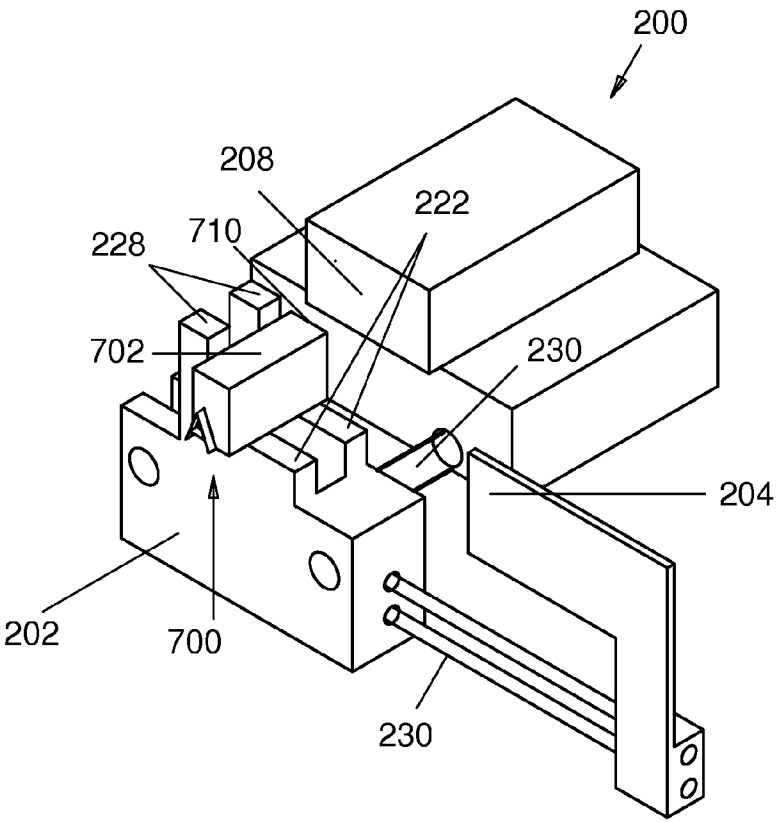
FIGS. 17A-17B is an embodiment of a print head for a printing device of the present invention, adapted for printing on a vertical surface.
Figure 17A:
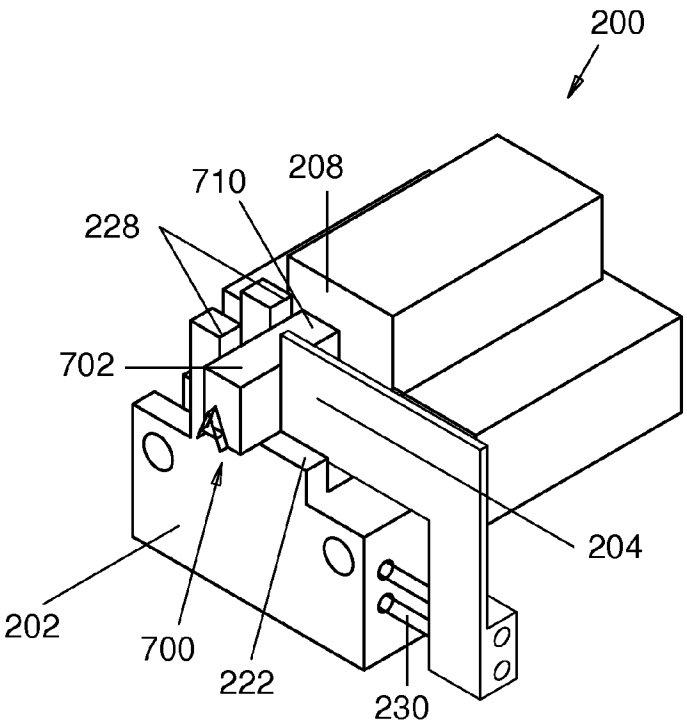

Referring now to FIGS. 15 and 16, any print head 200 described herein may be adapted to rotate about an axis. The print head may be attached to one or many devices 252, either directly or indirectly, such as through a drive belt 252. Such devices that facilitate rotational movement may include, for example, electric motors; pneumatic or hydraulic rotary actuators; linear motors, pneumatic or hydraulic cylinders, or solenoids coupled to a transmission that translates linear motion into rotary motion; any other electrical, mechanical or electro-mechanical means generally known in the art, or any combination thereof.

Figure 18B:
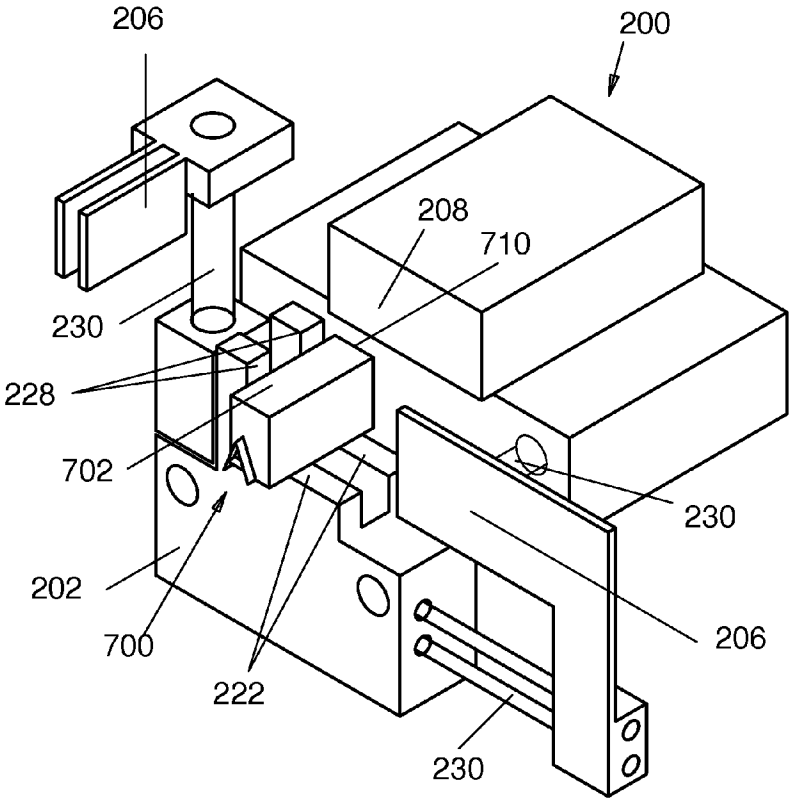
FIG. 18A-18B is another embodiment of a print head for a printing device of the present invention, adapted for printing on a vertical surface.
Figure 18A:
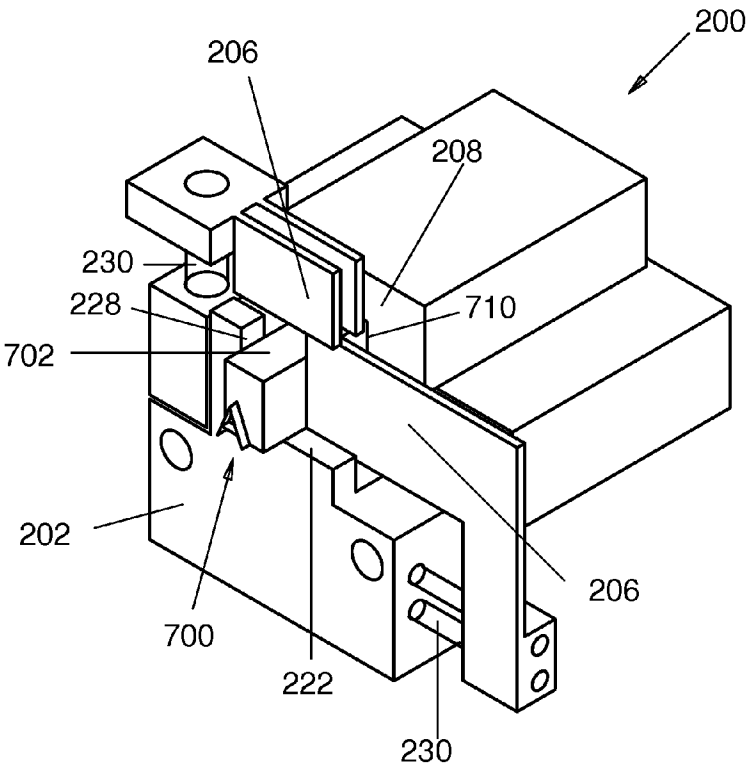

Referring now to FIGS. 17A-18B, embodiments of a print head 200 for printing on a vertical surface. These embodiments are provided with a horizontal surface 222 for a print die 700 to rest against, a first vertical surface 228 to bias the print die against 700, and a vertical backer surface 208. As shown in FIGS. 17A-17D, the vertical print head 200 may also be provided with a first clamp 204 to bias the print die 700 against the first vertical surface 228. As shown in FIGS. 18A and 18B, the print head 200 may also be provided with a second clamp 206, to ensure the print die 700 is properly seated against the horizontal surface 222. The second clamp 206 may also be adapted to rotate about an axis substantially parallel to the first vertical surface 228 and substantially orthogonal to the horizontal surface 222. Rotating the second clamp gives the pickup head 300 better access to retrieve the print die 700. The print die holder 202 may move independently towards and away from the backing surface 208 to accommodate print dies 700 or various sizes.

In contrast, the backer plate 208 may move toward the print die holder 202. The backer plate 208 may be used to set the depth of the stroke as the die contacts the print media 601. If electronic means are used to position the print head 200, rather than mechanical stops, then the point of contact between the backer plate 208 and the print die surface 710 is the reference point on the print head 200 relative to the printing surface 600.

Figure 19:
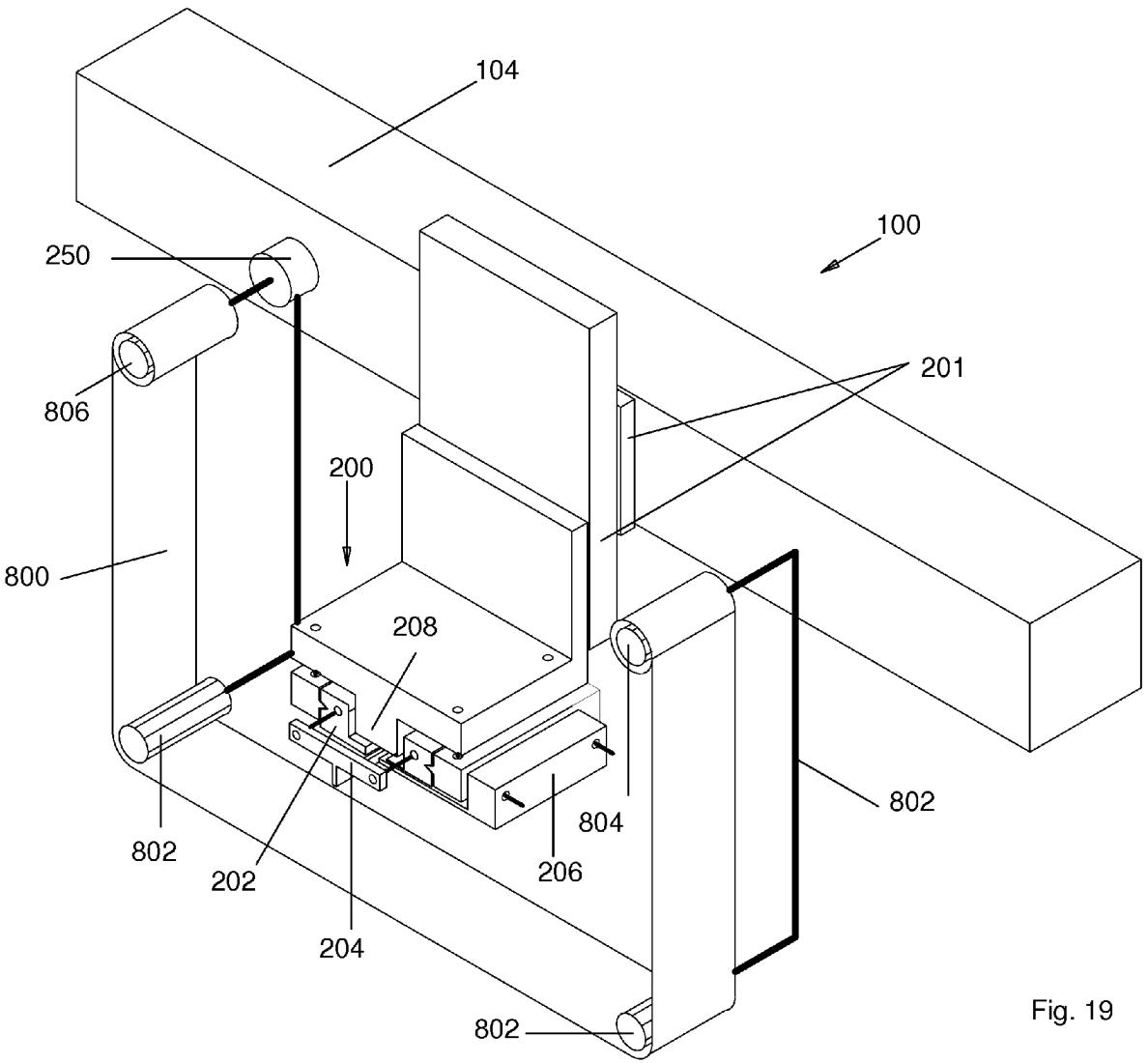
FIG. 19 is an embodiment of a print head for a printing device of the present invention provided with a marking substance delivery system.
Figure 20:
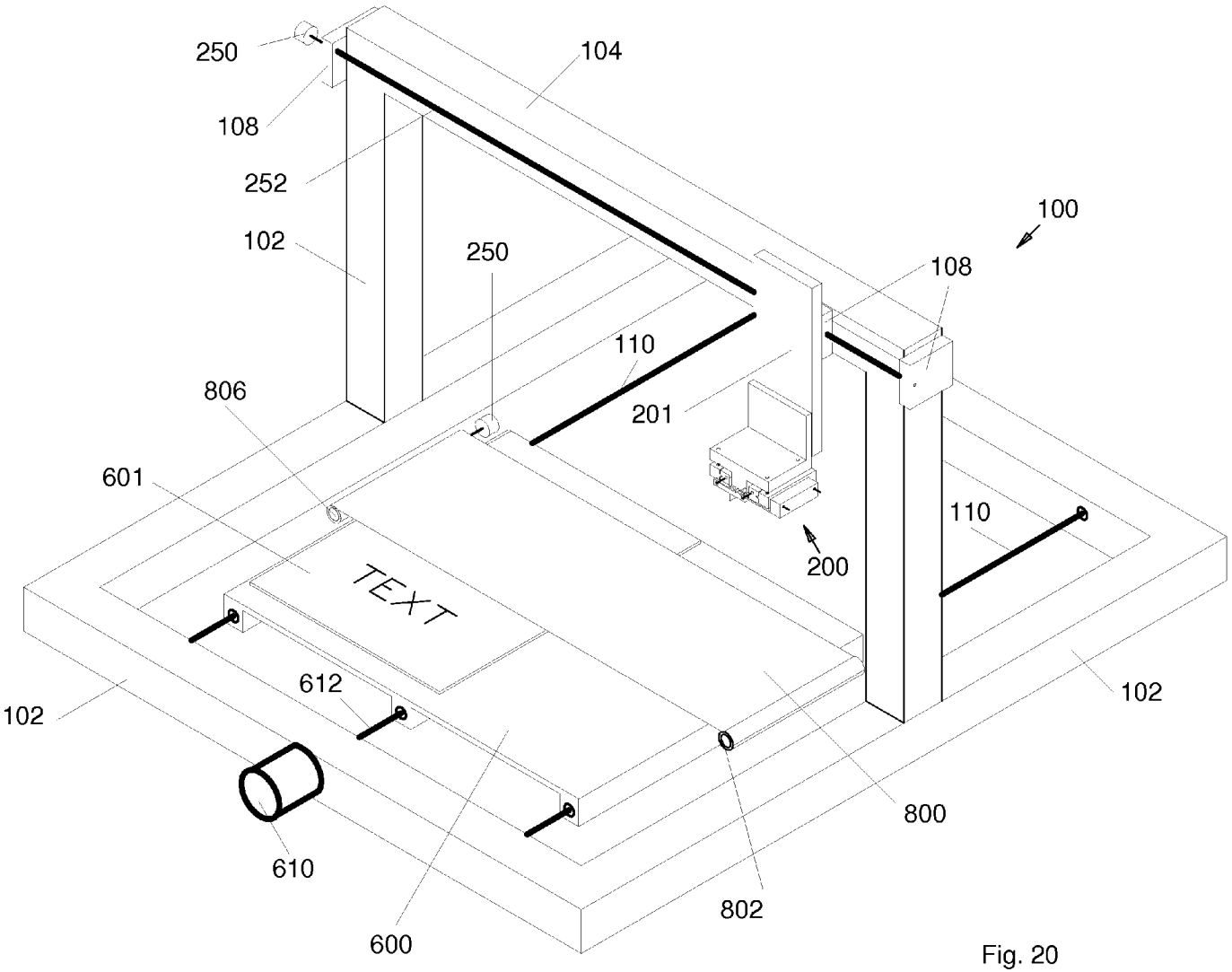
FIG. 20 is an embodiment of a printing device of the present invention provided with a marking substance delivery system.

Referring now to FIGS. 19 and 20, a print head 200 may be provided with an ink or foil ribbon 800 and ribbon carrier mechanism 802. The ribbon carrier mechanism 802 may be supplied with a supply reel 804 and a take-up reel 806. The take up reel 806 may be driven by a stepper motor, or other means generally known, and acts to pull new ribbon 800 off of the supply reel 804. As shown in FIG. 19, the ribbon 800 and ribbon carrier mechanism 802 may be attached to or otherwise supported by a first structure 104 of the printing device 100, or may alternatively be attached to or otherwise supported by the print head 200. As shown in FIG. 20, the ribbon 800 and ribbon carrier mechanism may be attached to or otherwise supported by a printing surface 600 or the printing device 100. FIG. 20 also depicts the printing surface 600 attached to a print surface drive motor 610 attached to a screw drive 612 to move the printing surface in a first direction. The print head drive system 201 is also shown with a motor 250 attached to a screw drive 252 to move the print head 200 in a second direction, orthogonal to the direction of motion of the print surface 600.

Figure 21:
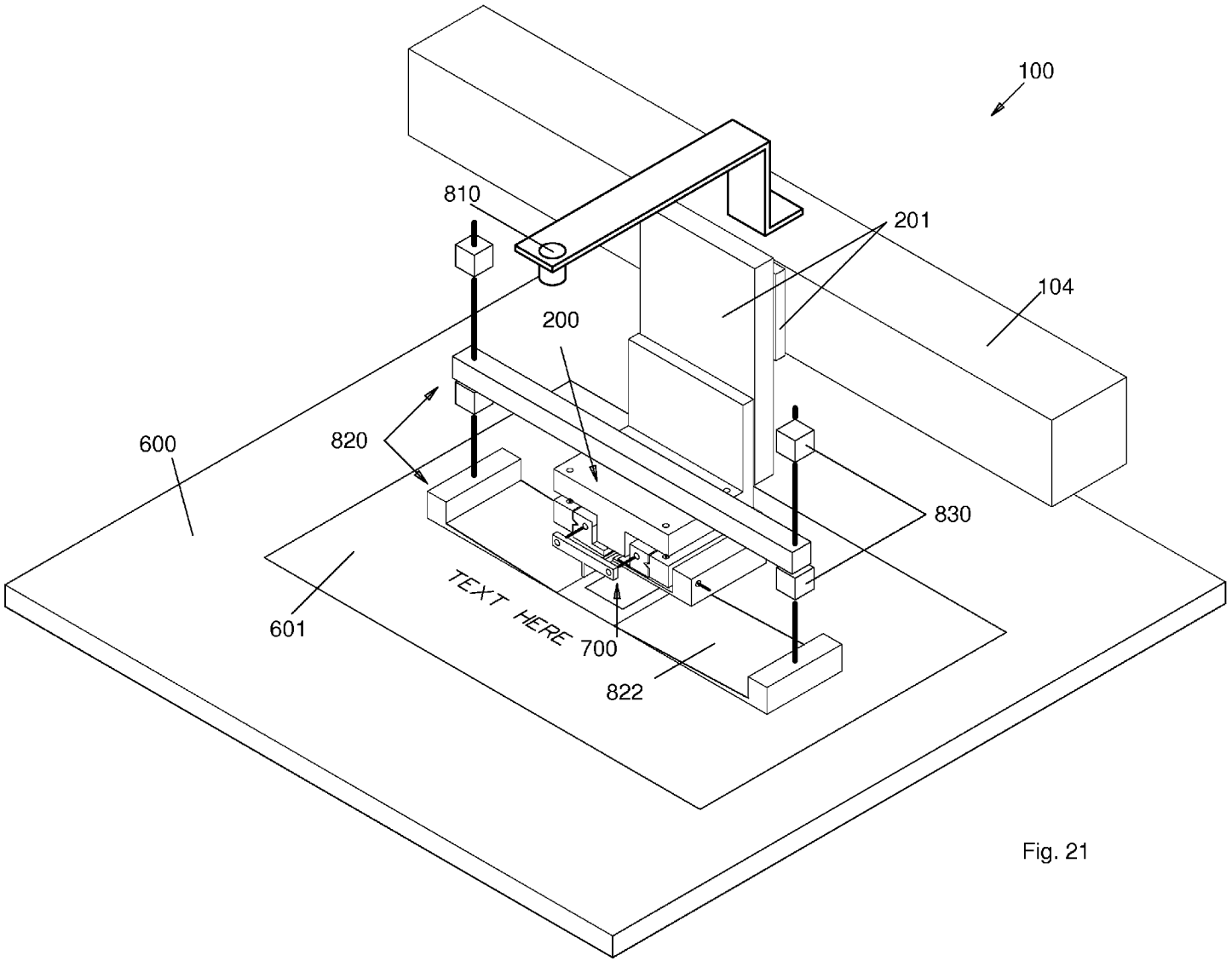
FIG. 21 is an embodiment of a print head for a printing device of the present invention provided with a marking substance delivery system.

Referring now to FIG. 21, the printing device 100 may be provided with a camera 810 or other means to acquire optical data, to ensure accurate placement of the die to the print media 601. The printing device 100 may also be provided with a foot assembly 820. The foot assembly 820 is provided with a foot 822 and mechanical stops 824 for limiting its travel relative to the print head 200. The foot 822 ensures that the print media 601 in a locus around the print die 700 is flat against the print surface 600. If the print media 601 moves or shifts in a locus near the print die 700 during printing, the resultant work product may be smeared or otherwise distorted.

Figure 22:
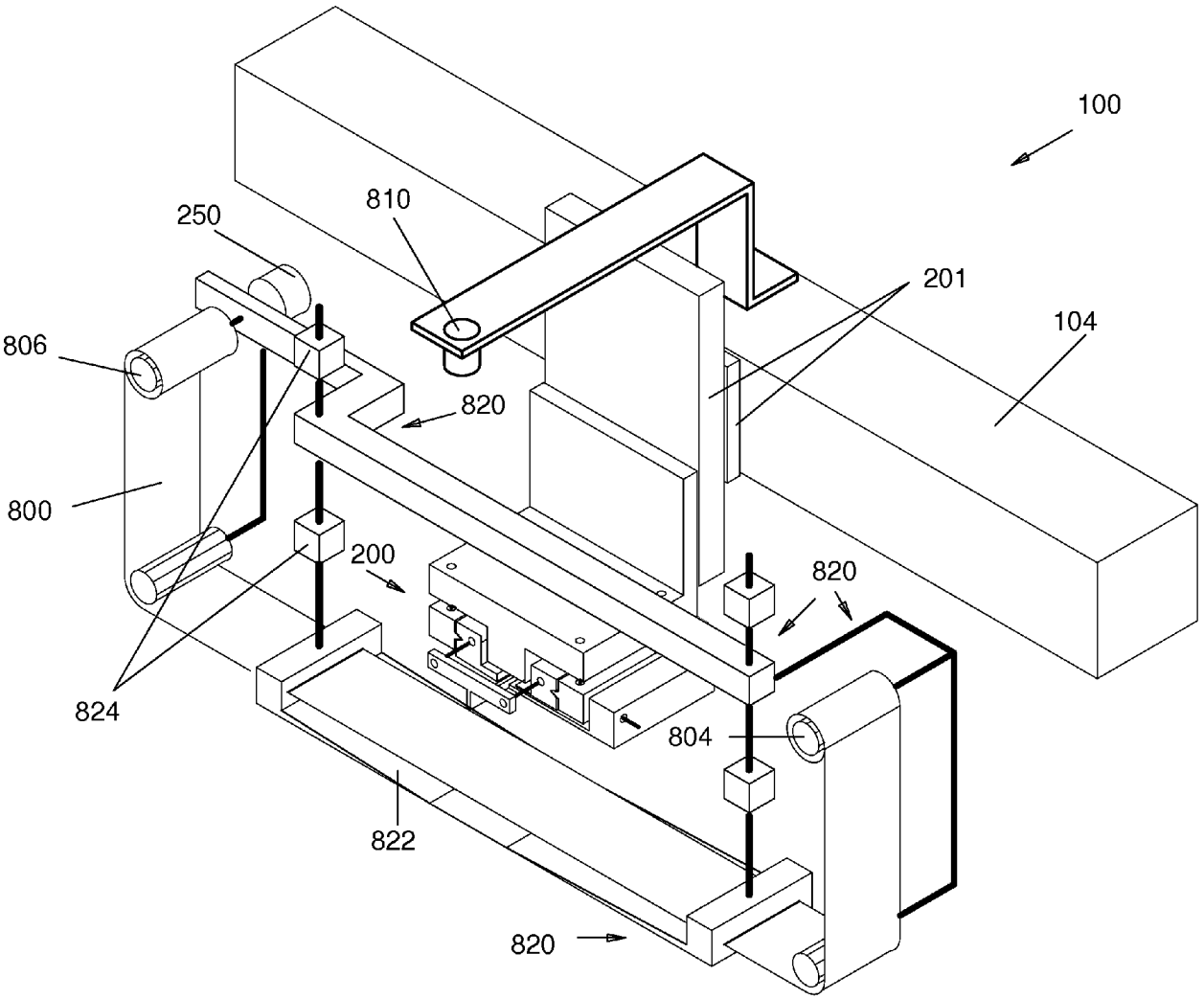
FIG. 22 is another embodiment of a print head for a printing device of the present invention provided with a marking substance delivery system.
Figure 23A:
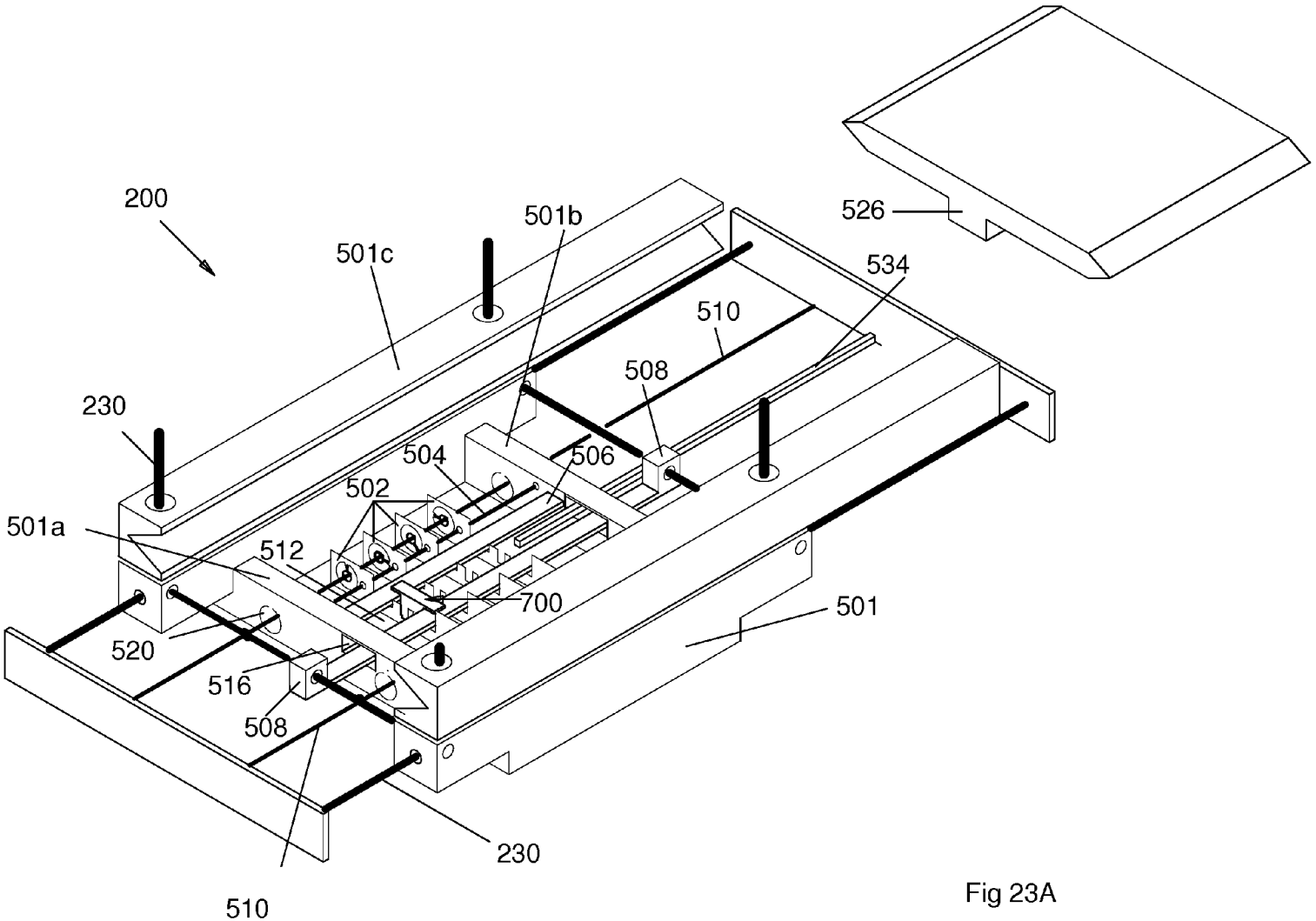
FIGS. 23A-23D are embodiments of an auto-type setter for a printing device of the present invention.
Figure 23B:
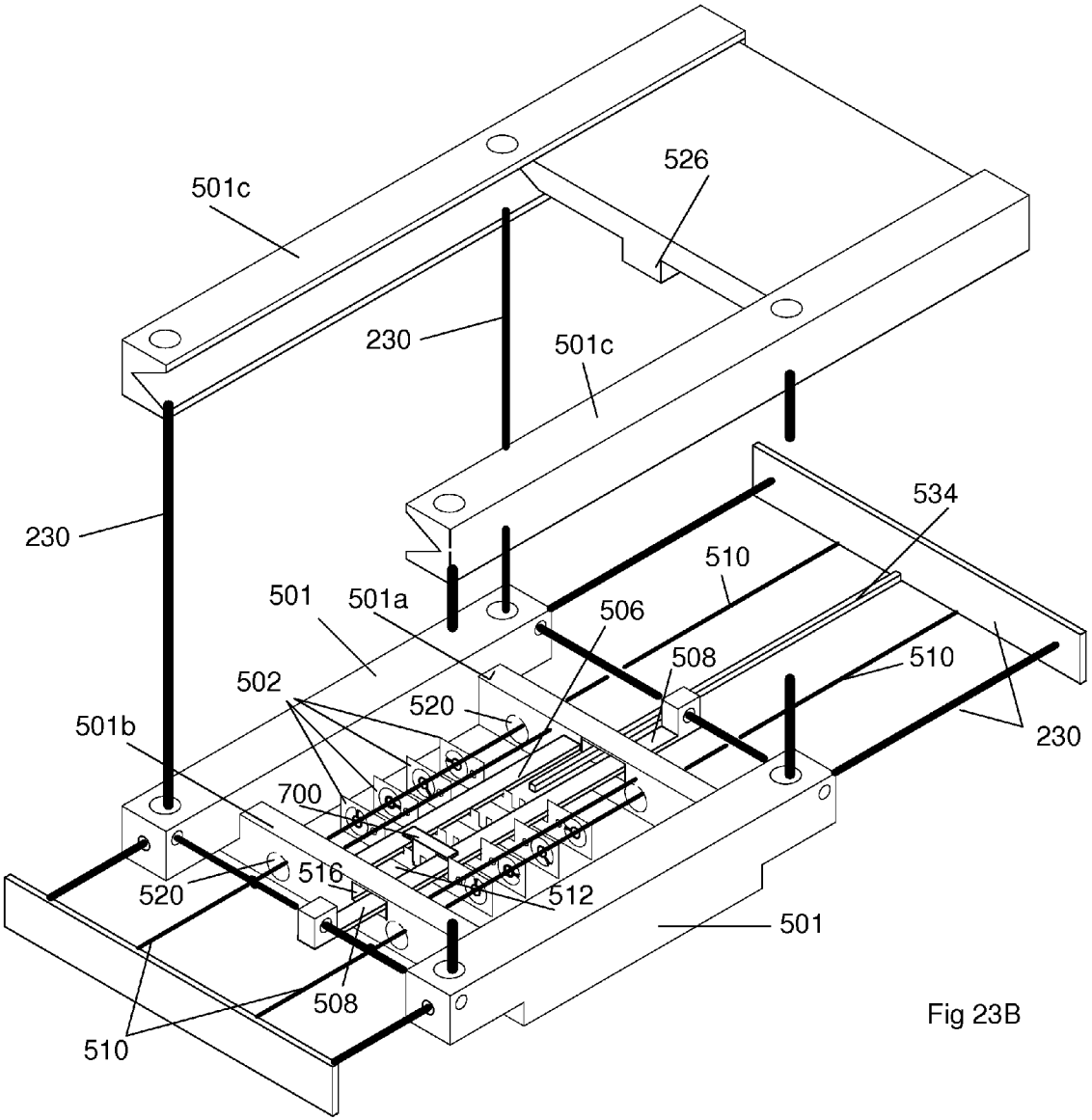
Figure 23C:
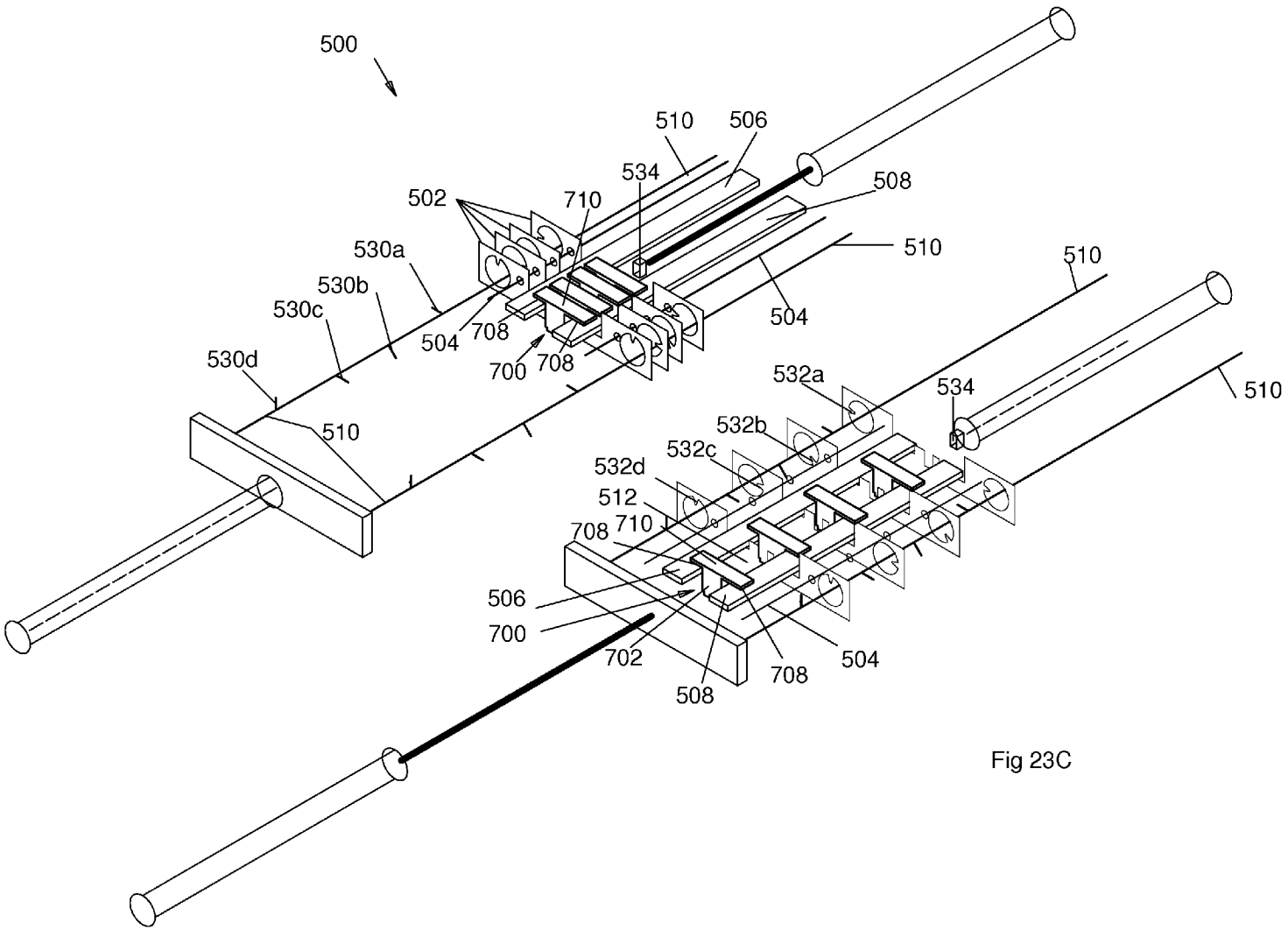
Figure 23D:
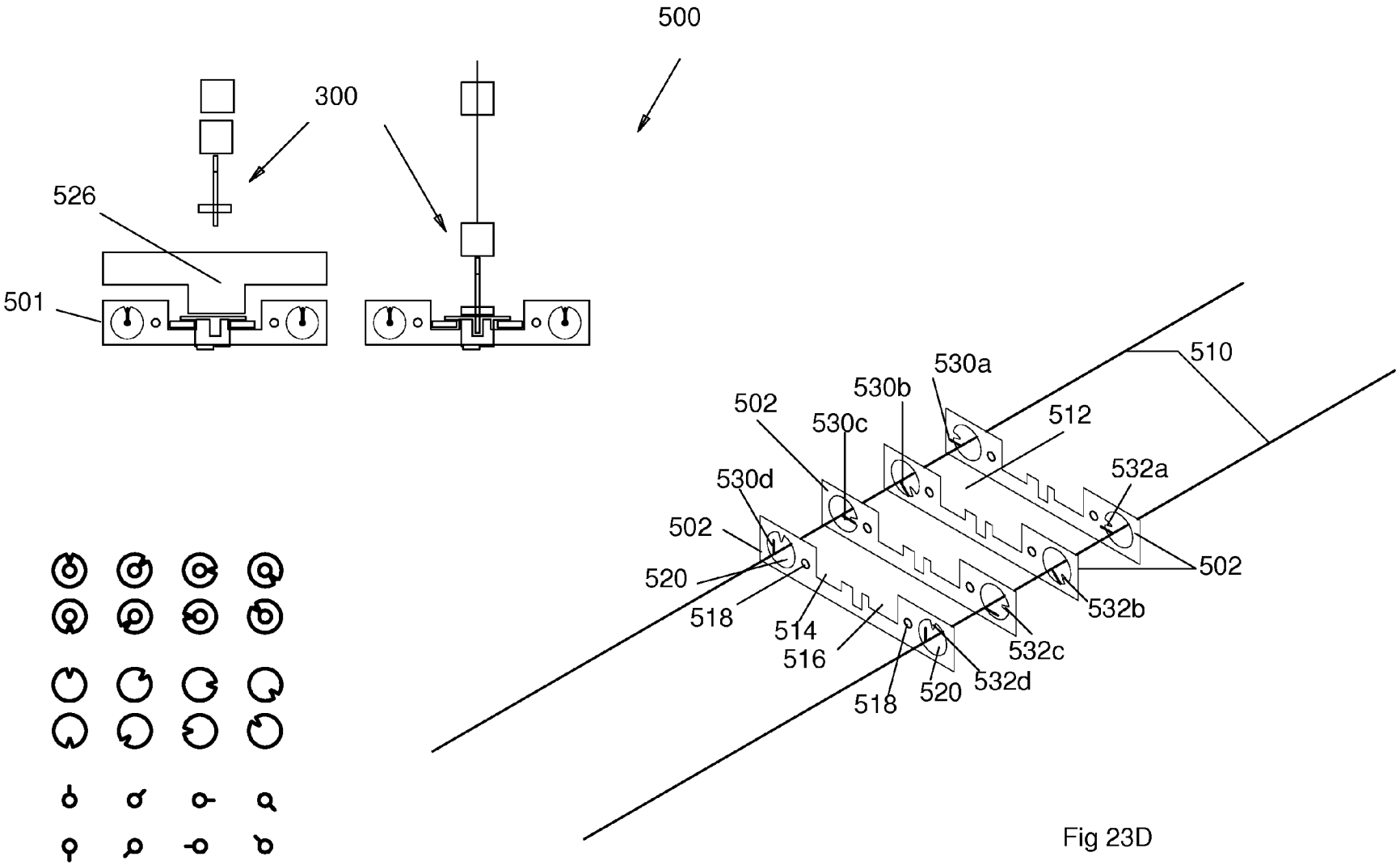
Figure 24B:
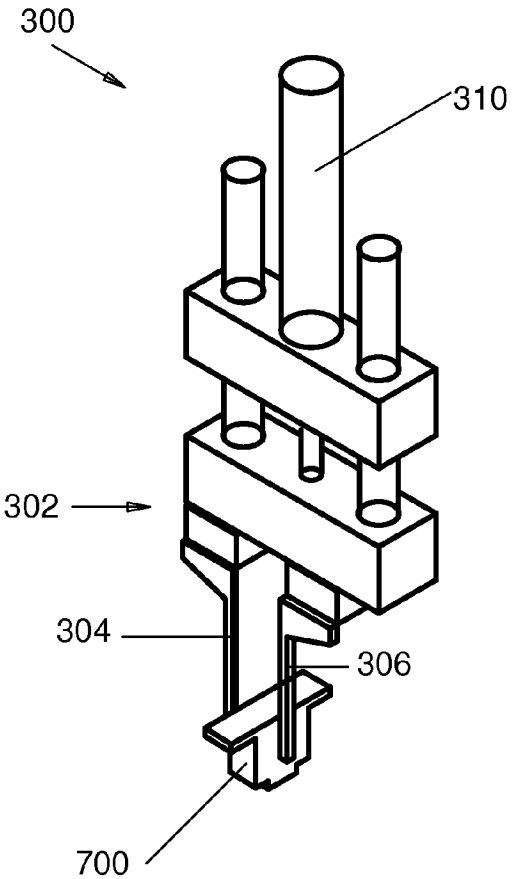
FIGS. 24A-24B are embodiments of pick-up heads for a printing device of the present invention.
Figure 24A:
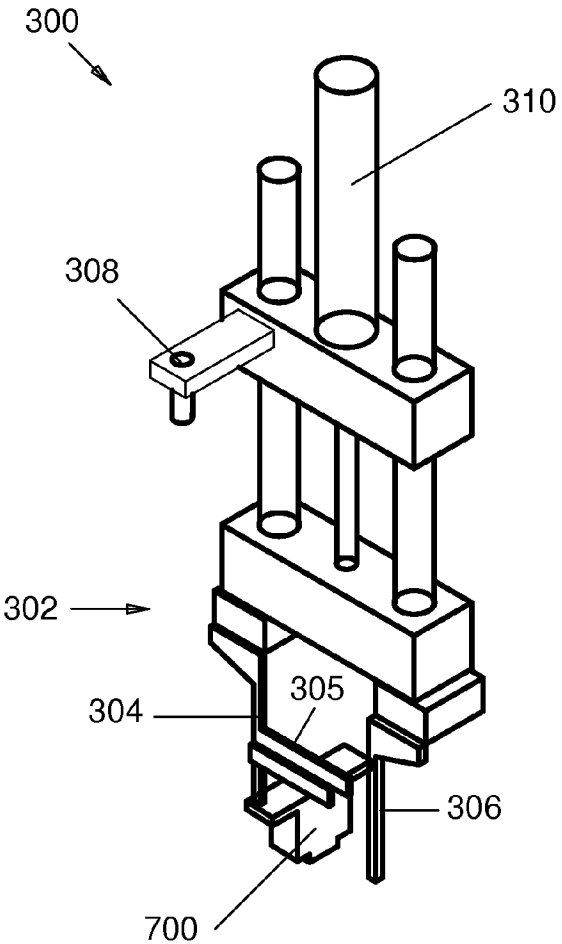

Referring now to FIG. 22, an embodiment of the printing device 100 of the present invention is shown with a ribbon 800, ribbon carrier mechanism 802 in conjunction with a foot assembly 820.

Referring now to FIGS. 23A-23D, the print head 200 may be alternatively provided as an auto-type setter. The auto-type setter provides the printing device 100 with a capability to print multiple print die 700 in a single press of the print head 200. The multiple die 700 may spell whole words or whole lines of text. The auto-type setter 200 is provided with a carriage 501, a series of shims separator plates 502 arranged in a serial parallel fashion, a set of alignment rods 504, a support bar 506, a first clamp bar 508, a set of separator rods 510, a backer plate 526 and a second clamp rod 534. For the sake of simplicity and ease in describing the shown embodiment, only four separator plates 502 are shown in the Figures. However, many more separator plates may be used to accommodate a large number of print die 700.

The carriage 501 may be provided with a first end support 501*a* and a second end support 501*b* are provided at either end of the separator plates. The carriage 501 may also be provided with a set of rails 501*c* to accommodate the backer plate 526 to move in and out of position. The carriage may also be provided with a drive system 230 to accommodate the movement of parts.

The separator plates 502 are provided with a pick up opening 512 positioned in a central location of the plate. On either side of the pickup opening 512, a support bar opening 514 and a first clamp bar opening 516 are provided. On either side of the support bar and first clamp bar openings 514, 516, guide rod openings 518 and separator rod openings 520 are provided. The pick up opening provides the pickup head 300 access to placing and retrieving print die 700 in the auto-type setter 200. The guide rods 504 provide support for the separator plates 502. The separator plates 502 slide on the guide rods 504. The guide rods 504 are removably or fixedly mounted in the end supports 501*a*, 501*b*. The guide rods 504 may be removed to insert longer rods to accommodate more separator plates 502 and more die 700.

The separator rods 510 are provided with pushing protuberances 530 along a longitudinal direction of the separator rods 510. Each protuberance 530 is positioned at a different and unique angular orientation about a longitudinal axis of the separator rod 510. Each separator rod protuberance 530*a*, 530*b*, 530*c*, 530*d* corresponds to a plate protuberance 532*a*, 532*b*, 532*c*, 532*d*.

As the separator rods 510 move linearly, the separator rod protuberances 530*a*, 530*b*, 530*c*, 530*d* engages and pushes against its corresponding plate protuberance 532*a*, 532*b*, 532*c*, 532*d*. The protuberances are oriented, so that first rod protuberance 530*a* at an end, will not contact any other plate protuberance 532*b*, 532*c*, 532*d*, until it reaches its corresponding plate protuberance 532*a*. For the sake of simplicity, only 5 plates are shown, and thus only four protuberance orientations are shown. Each rod protuberance 530*a*, 530*b*, 530*c*, 530*d* and corresponding plate protuberance 532*a*, 532*b*, 532*c*, 532*d* is offset by 90°. However to accommodate more plates, and ensure that a single rod protuberance will only contact its corresponding 530 plate protuberance 532, the protuberances 530, 532 may be offset at small intervals and more separator rods 510 and separator rod openings 520 may be incorporated into the auto-type setter 500.

In use, the backer plate 526 would slide to the side away from the carriage 501 to give access to the pickup head 300. The separator rods 510 would then move linearly. Each rod protuberance 530*a*, 530*b*, 530*c*, 530*d* then engages its corresponding plate protuberance 532*a*, 532*b*, 532*c*, 532*d*, pushing and separating the separator plates 502, leaving a gap for the die 700 to be inserted between them. With the separator plates 502 separated, the pickup head would place multiple die 700 in the appropriate positions between the plates 502. The aligned die 700 may spell a whole word or line of text. The print die planar extensions 708 may rest on horizontal top surfaces of the support bar 506 and the first clamp bar 508. The separator rods 510 then retract from the type-setter 200. The first clamp bar 508 then moves laterally to bias the die 700 against the support bar 506. With the die 700 in place, the second clamp bar 534 would then push and bias the separator plates 502, with the die 700 sandwiched between them, toward and against the first end support 501*a*. The backer plate 526 then moves back over the carriage 501. The carriage 501 may be adapted to move vertically to provide clearance for the backer plate 526 to move to the side. The carriage 501 and backer plate 526 then move relative to each other to bias the die 700 against the backer plate 526. The auto-type setter 200 is now ready to move relative to print media to print.

After the auto-type setter 200 has printed, the backer plate 526 then moves to the side to provide access to the print die 700 for the pickup head 300. The first clamp bar 508 pulls away from the die, and the second clamp bar 534 pulls away from the separator plates 502. The separator rods 510 would then move linearly. Each rod protuberance 530*a*, 530*b*, 530*c*, 530*d* then engages its corresponding plate protuberance 532*a*, 532*b*, 532*c*, 532*d*, pushing and separating the separator plates 502, leaving a gap for the die 700 to be retrieved. This provides the pickup head 300 access to pick up and remove the print die 700, one by one.

The printing device 100 may be configured so as to allow interchangeability between a print head 200 with single die capabilities, as described in FIGS. 11A-22, and an auto-type setter 400 print head, as described in FIGS. 23A-23D.

Referring now to FIGS. 24A-31E, details of the various pickup head 300 embodiments will now be described. The pickup head 300 is provided with a jaw assembly 303 having a first jaw 304 and a second jaw 306. The first and second jaws 304, 306 are actuated toward and away from each other by, for example, pneumatic cylinders, hydraulic cylinders, linear motors, solenoids, rotary motors coupled to a transmission that translates rotary motion into linear motion, any other electrical, mechanical or electro-mechanical means generally known in the art, or any combination thereof. The pickup head 300 may also be provided with a camera 304 or other means of optical data acquisition, such as a bar code scanner. The ability for optical data acquisition ensures that the pickup head 300 is retrieving the proper print die 700 from the storage rack 400 and to ensure the pickup head 300 is replacing the print die 700 in its proper place in the storage rack 400. The pickup head 300 may also be provided with a pneumatic cylinder 310, or an equivalent device, to move the jaw assembly 302 in a vertical direction.

Referring now to FIGS. 25A-25G, the first and second jaws 304, 306 may be provided with cross-stabilizers 305. The cross stabilizer(s) 305 are typically attached to one jaw 304 and move relative to the other jaw 306. The first and/or second jaws 302, 304 may be provided with grip enhancing features 312 such as a roughened surface, or rubber pads. Rubber pads may be preferred as they are less likely to damage any datum surfaces on the print die 700.

Figure 25F:
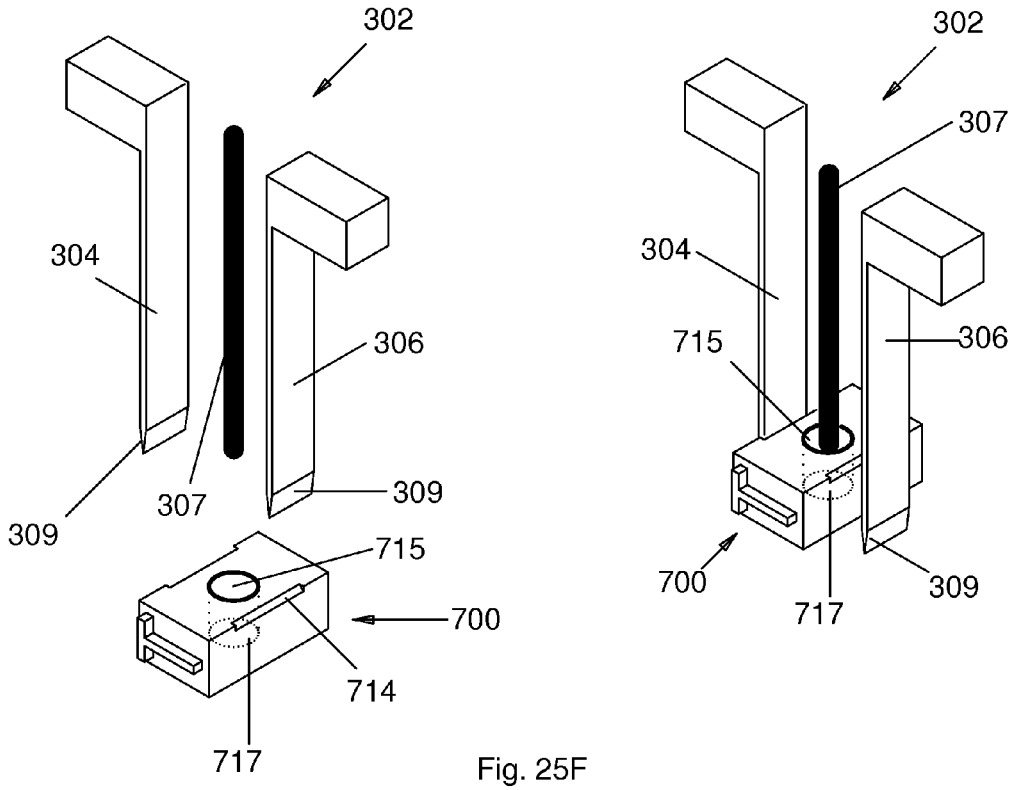

Referring now to FIG. 25F, the jaw assembly 302 may be provided with a sensing finger 307 that may provide tactile feedback to the CPU controller. This sensing finger 307 may also be used in conjunction with a die 700 having an opening 715 with a reference surface 717 at the bottom of the opening 715. This reference surface may be at the same depth relative to the print head 200 or storage rack 400 for each die 700, regardless of the size of the die 700. The jaw assembly 302 may also be provided with jaws 304, 306 having distal tips 309 that are thinner than the rest of the jaw. This may assist the jaw when being inserted between die 700.

Figure 25G:
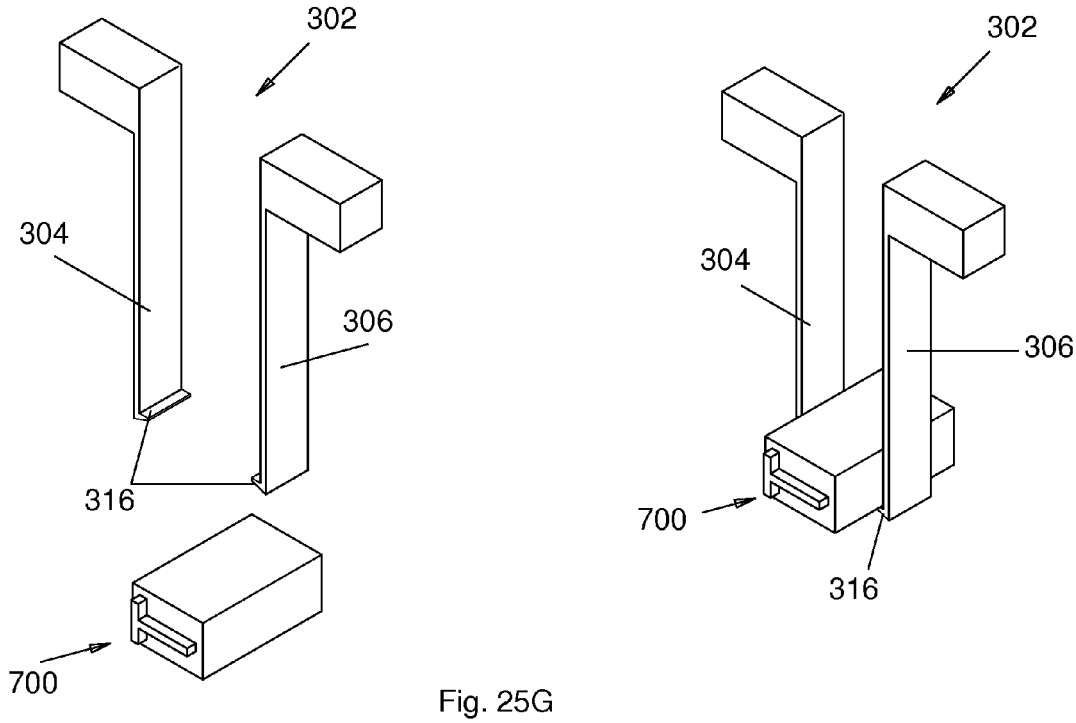

Referring to FIG. 25G, the jaw assembly 302 may be provided with jaws 304, 306 having a tooth or hook structure 316 at the distal tip. This may provide a surface for the die 700 to rest on when the jaw assembly 302 lifts the die 700.

Figure 26A:
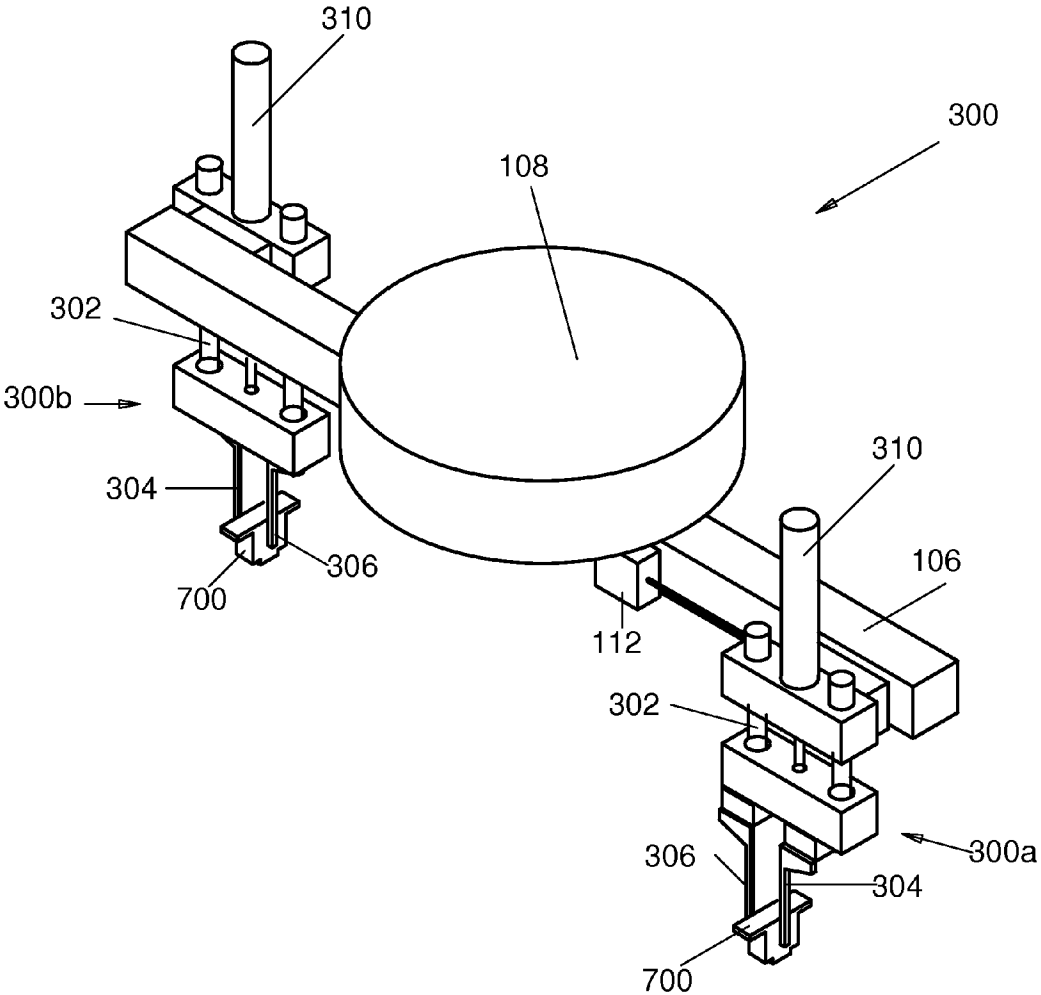
FIGS. 26A-26C are embodiments of rotationally moving pick-up heads for a printing device of the present invention.
Figure 26B:
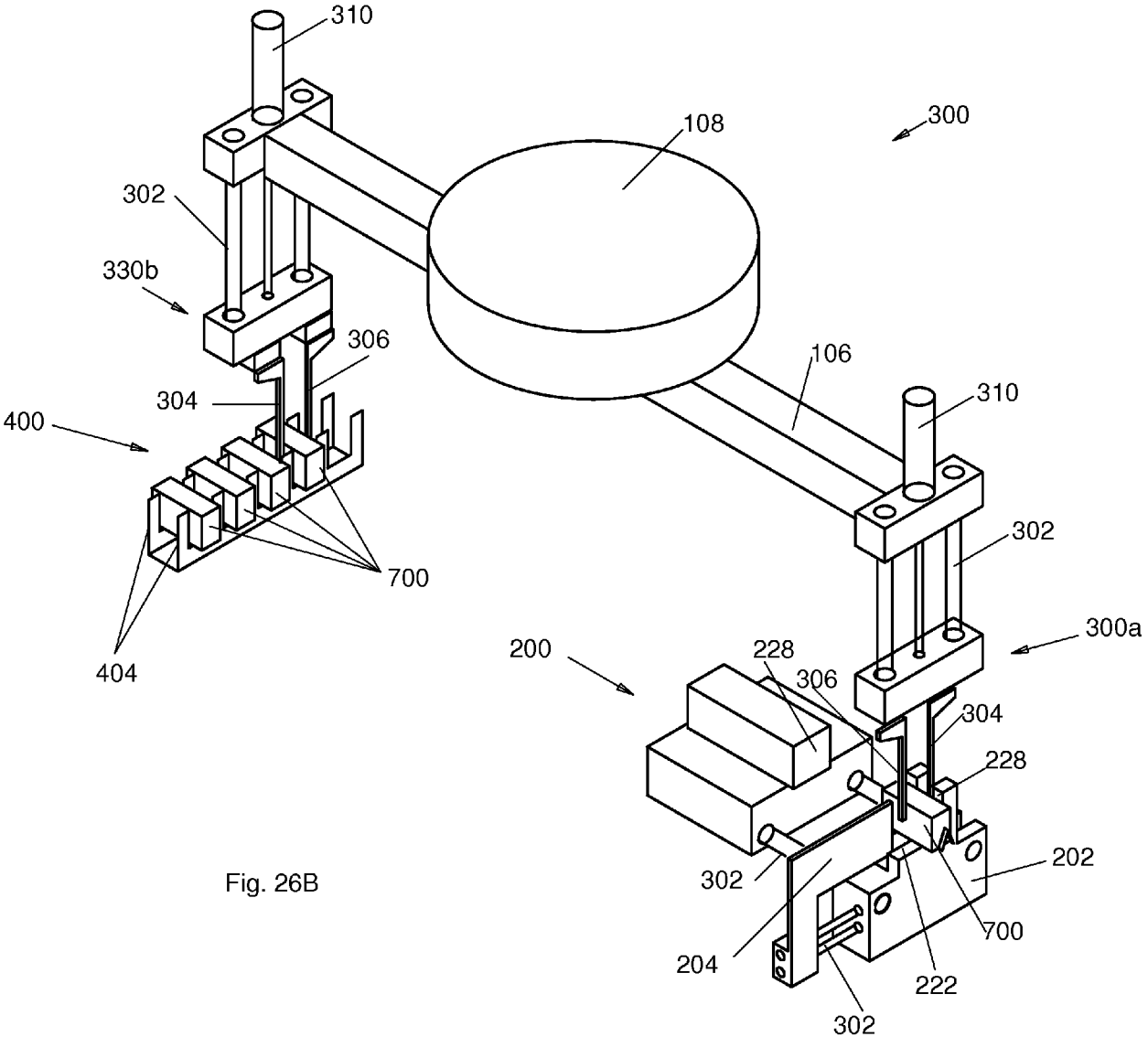
Figure 26C:
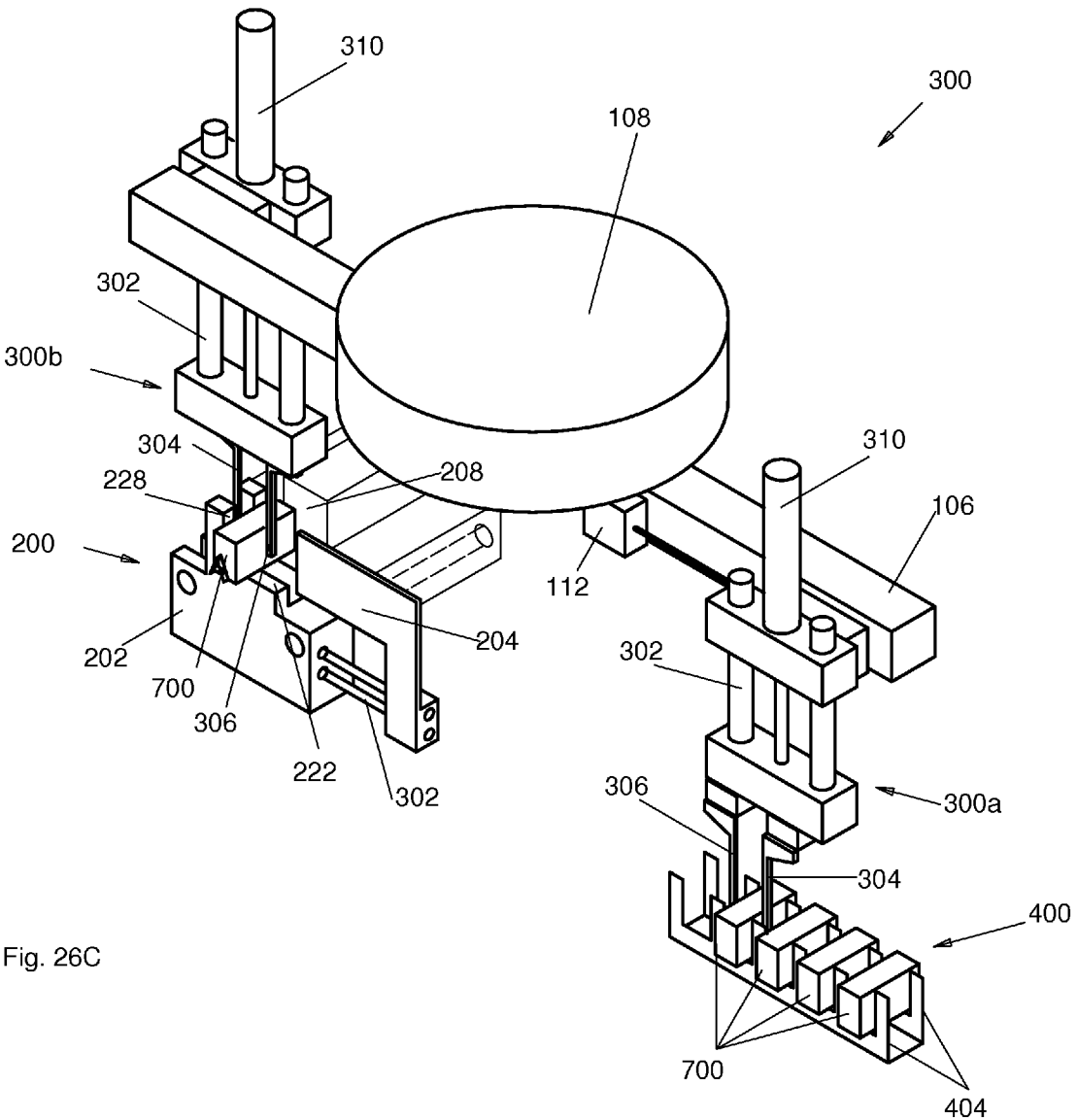

Referring to FIGS. 26A-26D, the printing device may be provided with multiple pickup heads. As shown in FIGS. 26A-26C, the printing device may be provided with a first pickup head 300*a*, and a second pickup head 300*b*. The first pickup head 300*a* may be delivering a print die 700 to a print head 200, while the second pickup head may be returning and/or retrieving a print die 700 to/from the storage rack 400.

Figure 31:
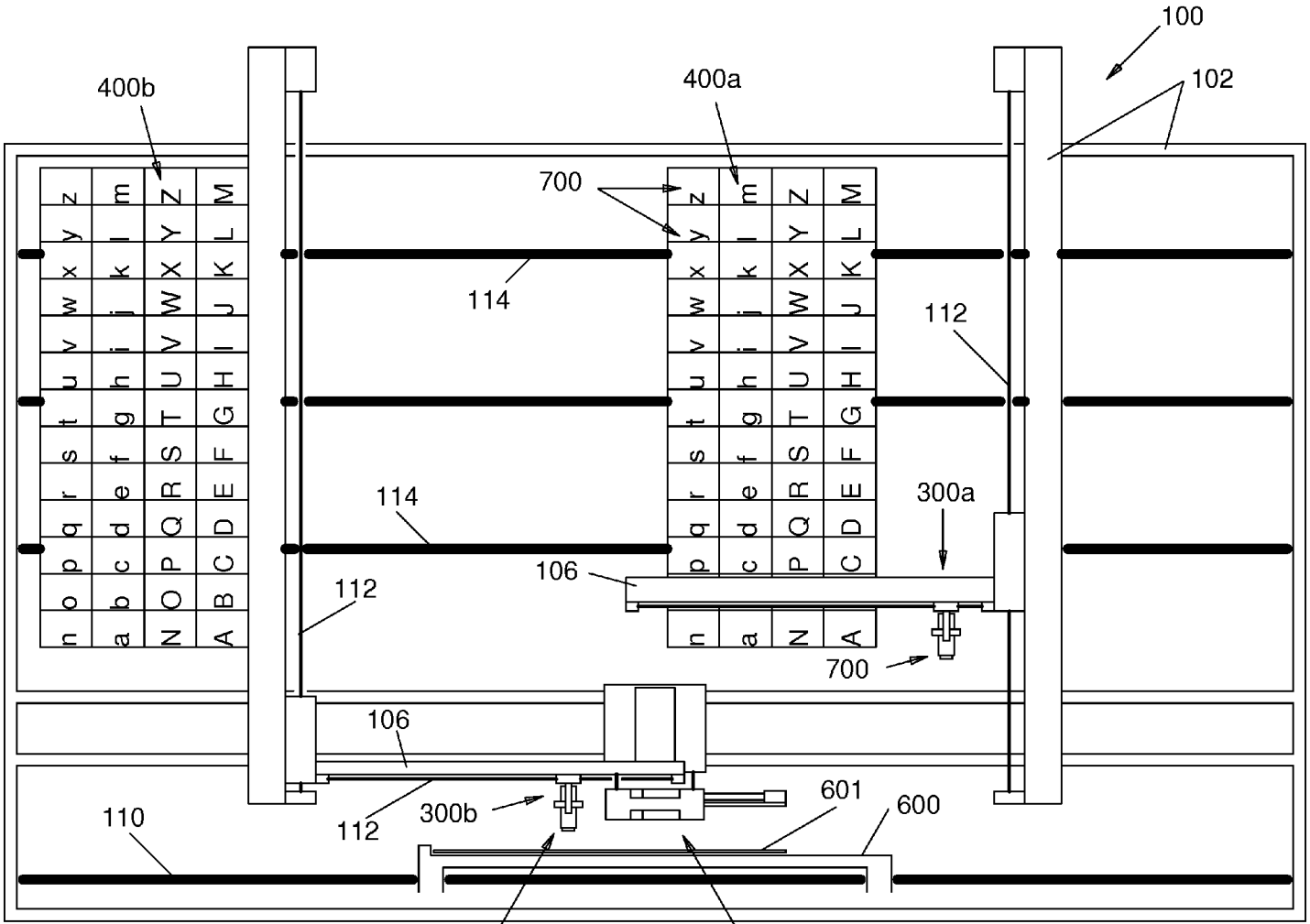
FIGS. 31-32 show print heads of the present invention utilizing multiple storage racks.
Figure 32:
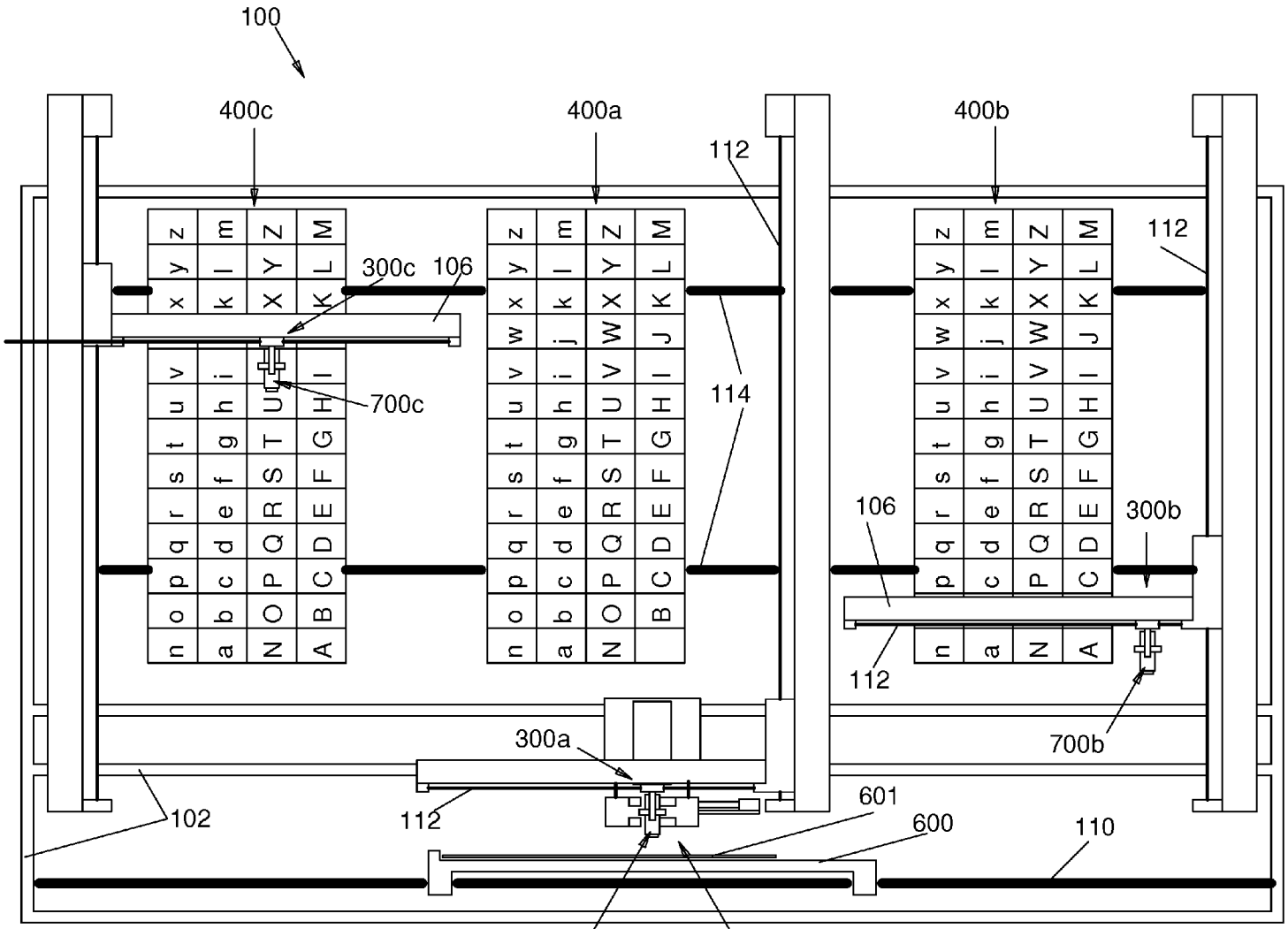
Figure 33A:
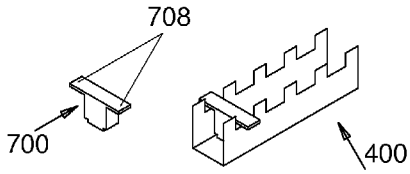
FIGS. 33A-34C depict various ways to manage different types of print die.
Figure 33B:
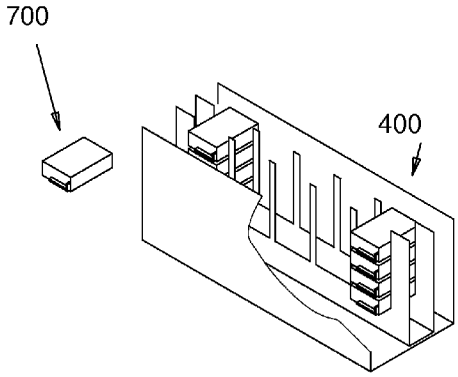
Figure 33C:
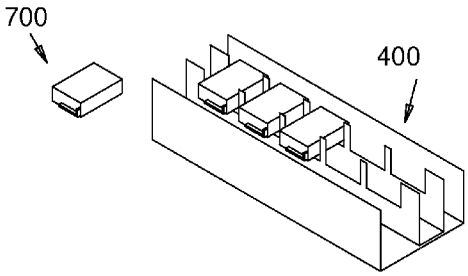
Figure 33D:
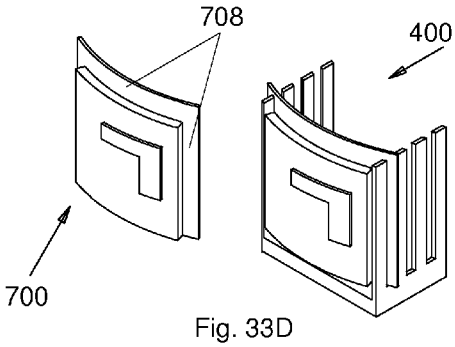
Figure 33E:
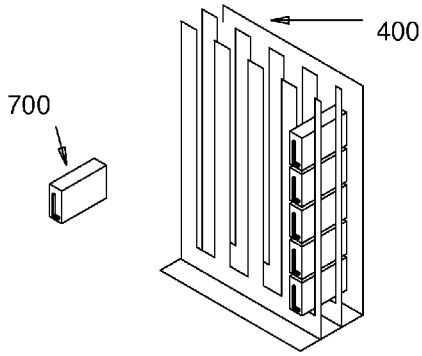
Figure 33F:
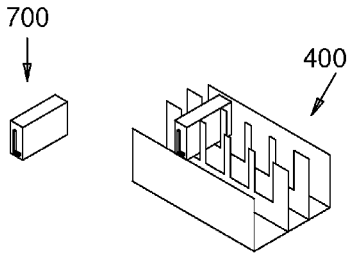
Figure 33G:
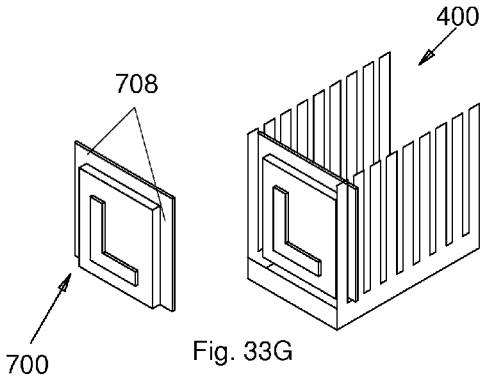
Figure 34A:
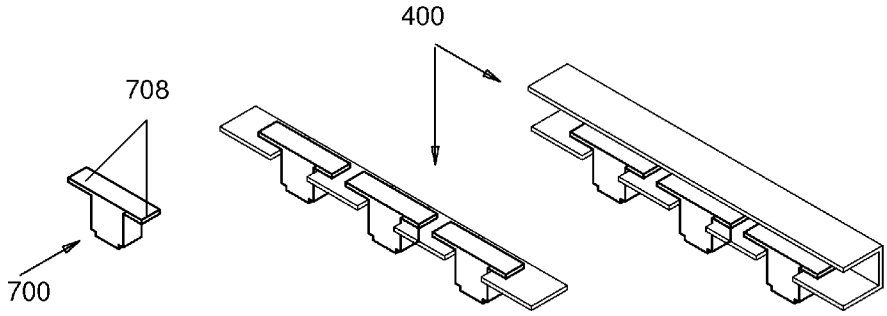
Figure 34B:
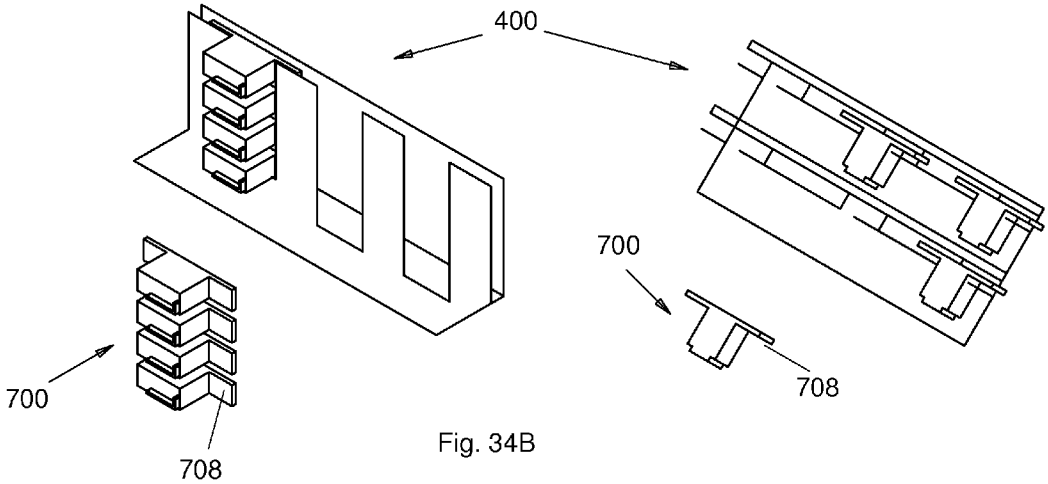
Figure 34C:
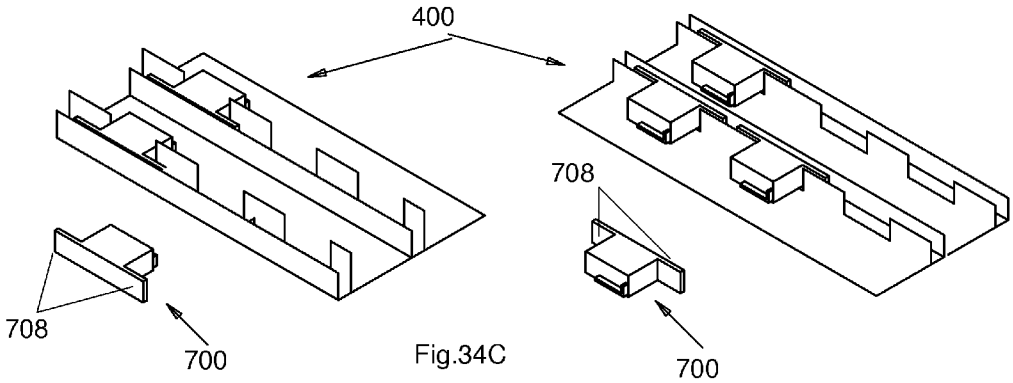

FIGS. 31 and 32 represent a print head 200 that may receive print die 700 from multiple storage racks 400*a*, 400*b*, 400*c*. This gives the printing device the capability to print multiple fonts and font sizes on the same print media.

Because print die 700 may be retrieved from or returned to separate and distinct, possibly distant, locations in the storage rack 400. It may be desirable to provide the printing device 100 with a third pickup head 300*c*. As shown in FIG. 32, a first pickup head 300*a* may be delivering a first print die 700*a* to a print head 200, while the second pickup head 300*b* may be retrieving a second print die 700*b* from the storage rack 400, while the third pickup head 300*c* may be returning a third print die 700*c* to the storage rack 400. It is important to note that each pickup head 300*a*, 300*b*, 300*c* would likely cycle through the three duties of delivering, retrieving, and returning. Thus, after the first print die 700*a* was printed; the first pickup head 300*a* may return the first print die 700*a* to the storage rack 400, while the second pickup head 300*b* delivered the second print die 700*b* to the print head 200, and the third pickup head 300*c* retrieved a fourth print die 700*d* from the storage rack 400. Then after the print head 200 printed the second print die 700*b*; the first pickup head 300*a* may retrieve a fifth print die 700*e* from the storage rack 400, while the second pickup head 300*b* returned the second print die 700*b* to the storage rack 400, and the third pickup head 300*c* delivered to the fourth print die 700*d* to the print head 200. This cycle would be repeated as long as necessary to print the desired text.

Figure 40A:
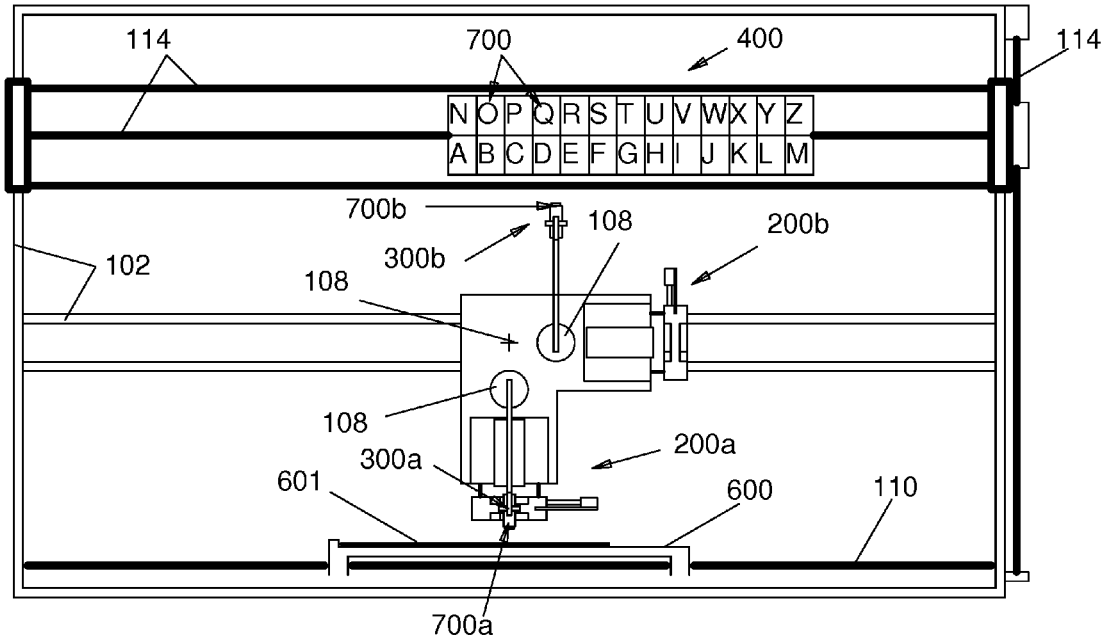
FIGS. 40A-41 illustrate a particular embodiment of a printing device of the present invention having multiple printheads.
Figure 40B:
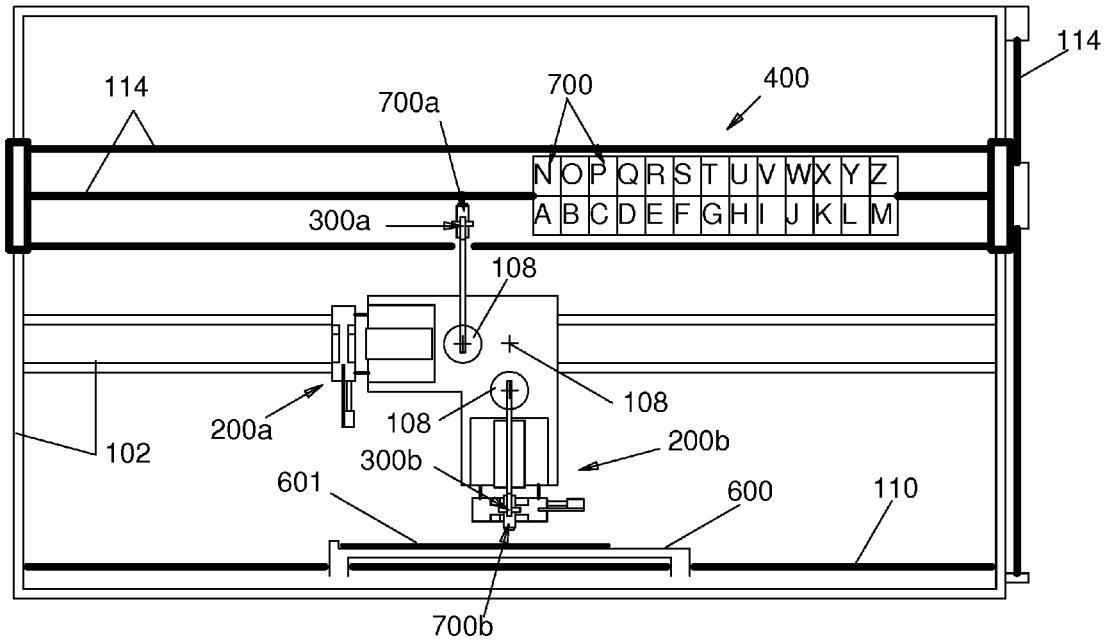
Figure 41:
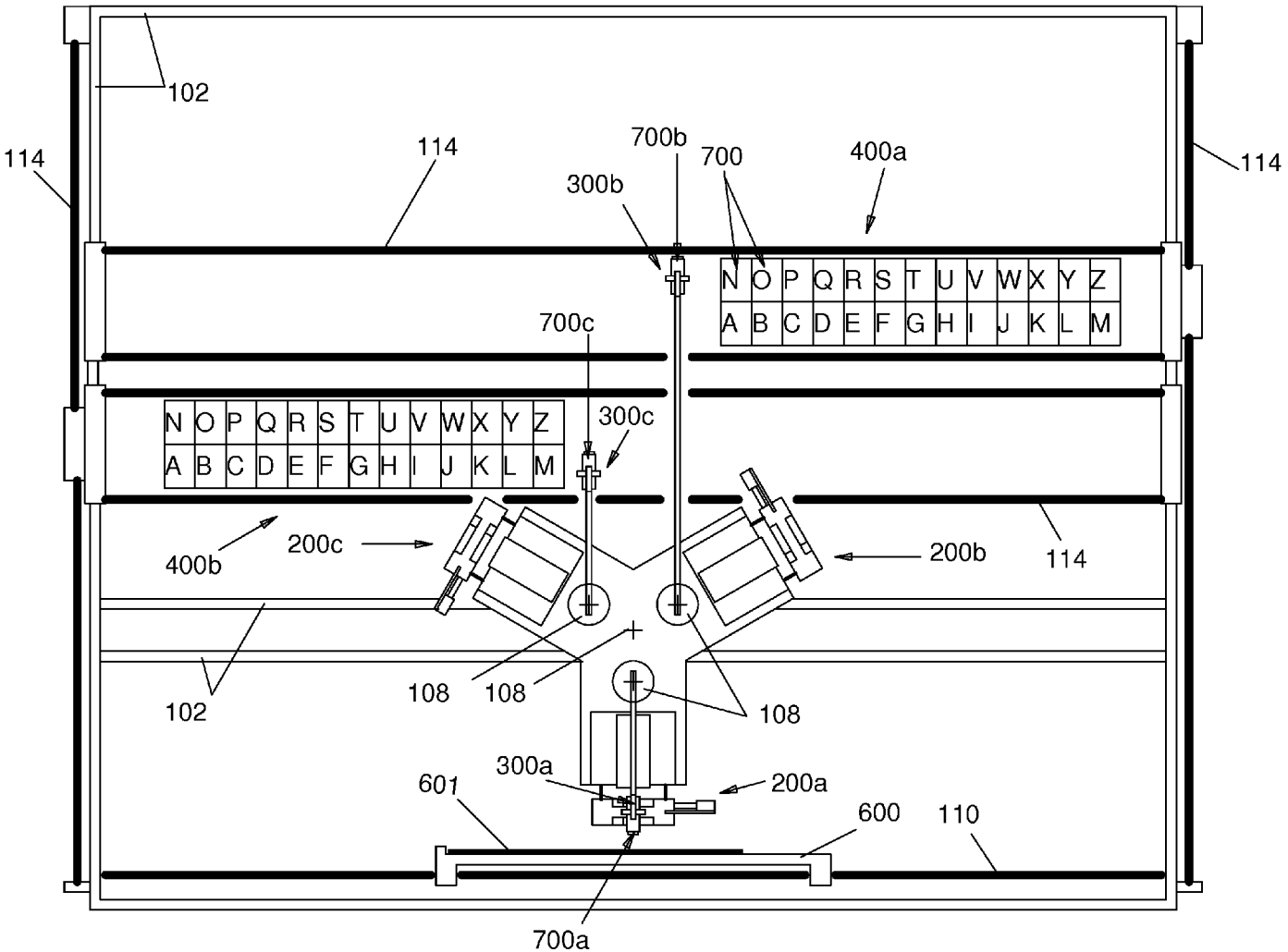

Referring now to FIGS. 40A-41, a printing device 100 is provided with multiple print heads. FIGS. 40A and 40B depict a printing device 100 with two printheads 200*a*, 200*b* and FIG. 41 depicts a printing device 100 with three printheads 200*a*, 200*b*, 200*c*. Each printhead 200*a*, 200*b*, 200*c* is provided with its own pickup head 300*a*, 300*b*, 300*c*. A first printhead 200*a* may be printing while the other printhead(s) are being loaded or unloaded with print die 700. The printheads 200*a*, 200*b*, 200*c* rotate about an axis depicted by the "+" symbol.

Referring now to FIGS. 27A-27I, a description of the use of the pickup head 300 will now be explained. As shown in FIG. 27A, the pickup head 300 is positioned above the storage rack 400 with its jaw assembly 302 open. As shown in FIG. 27B, the pickup head 300 is lowered to the storage rack 400. FIG. 27C shows the lowered pickup head 300 clamping on a print die 700. FIG. 27D depicts the pickup head 300 lifting a print die 700 out of the storage rack 400. FIGS. 27E and 27F show the pickup head 300 translating over to and lowering the print die 700 into the print head 200. FIGS. 27G-27I depict the pickup head 300 opening, raising above the print head 200, and the print head 200 clamping the print die 700, respectively. To return the print die to the storage rack, the process is reversed. Further, when the pickup head jaw assembly 302 opens and closes, only one or both jaws 304, 306 may move.

Figure 28:
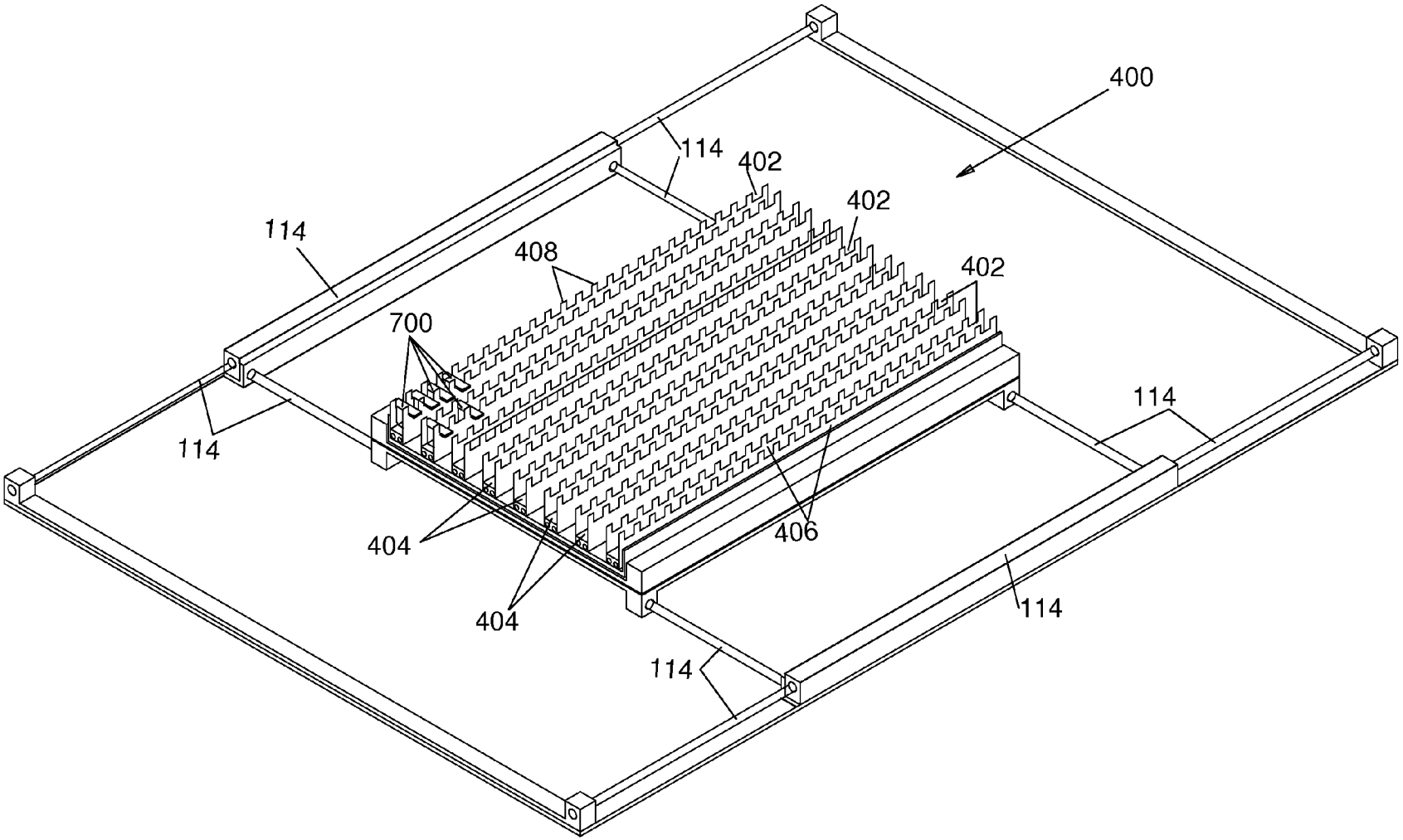
FIG. 28 is a perspective view of a print die storage rack of the present invention.

Referring now to FIG. 28, the die storage rack 400 is provided with a plurality of storage compartments 402 for multiple die 700. Storage compartments 402 are arranged in linear rows 404, each row 404 comprises two side walls 406, and the top portion of each side wall 406 is provided with dividers 408. The die planar extensions 708 rest on top of the side walls 406 in between the dividers 408, allowing the main body 703 and raised lettering 704 to hang down between the side walls 406 free of any physical contact. Storing the print die 700 in this position prevents any damage from occurring to the raised lettering surface 704 and also inhibits dust and dirt from settling on the die 700 while they are not in use.

Figure 29:
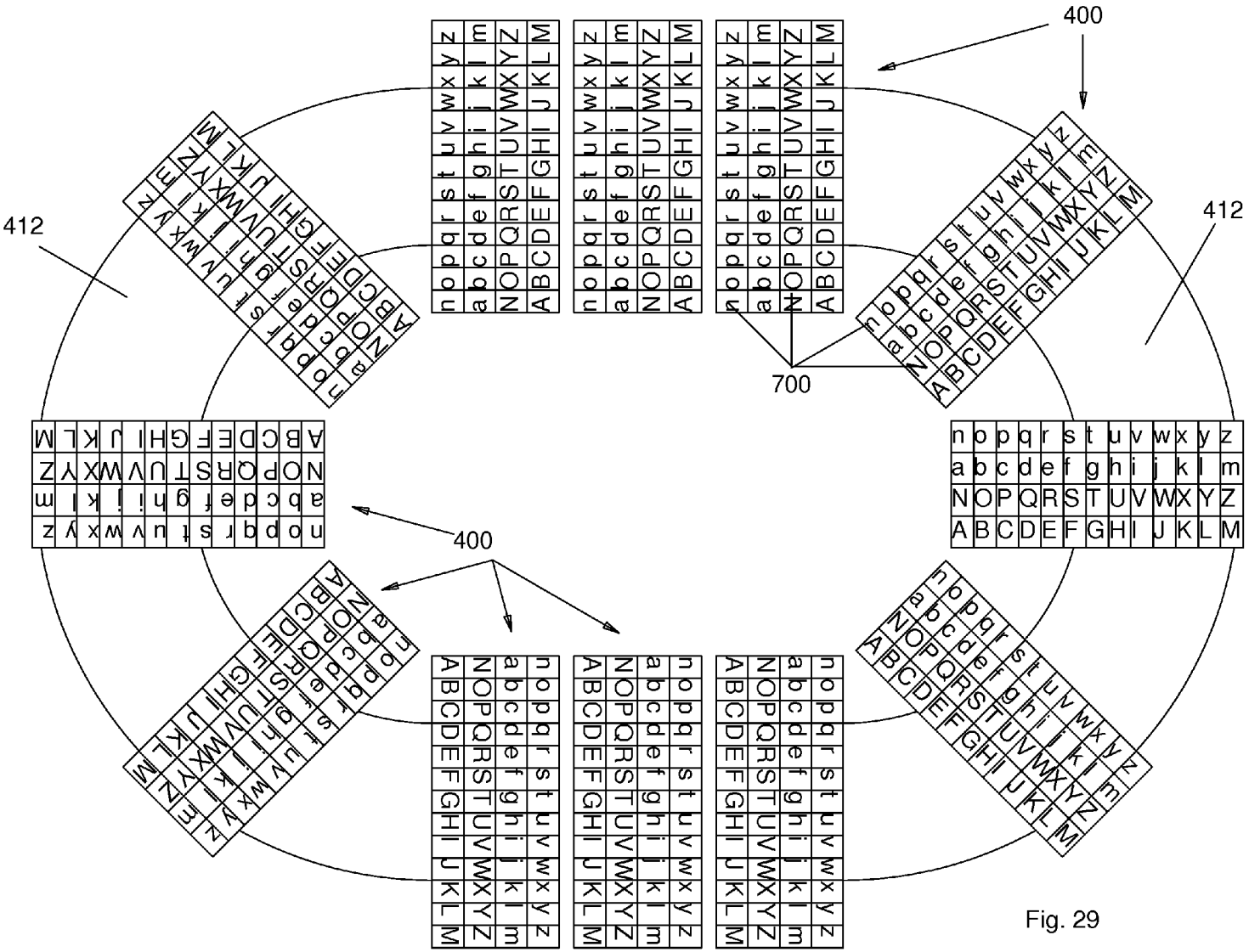
FIGS. 29-30 depict various ways to manage multiple storage racks.
Figure 30:
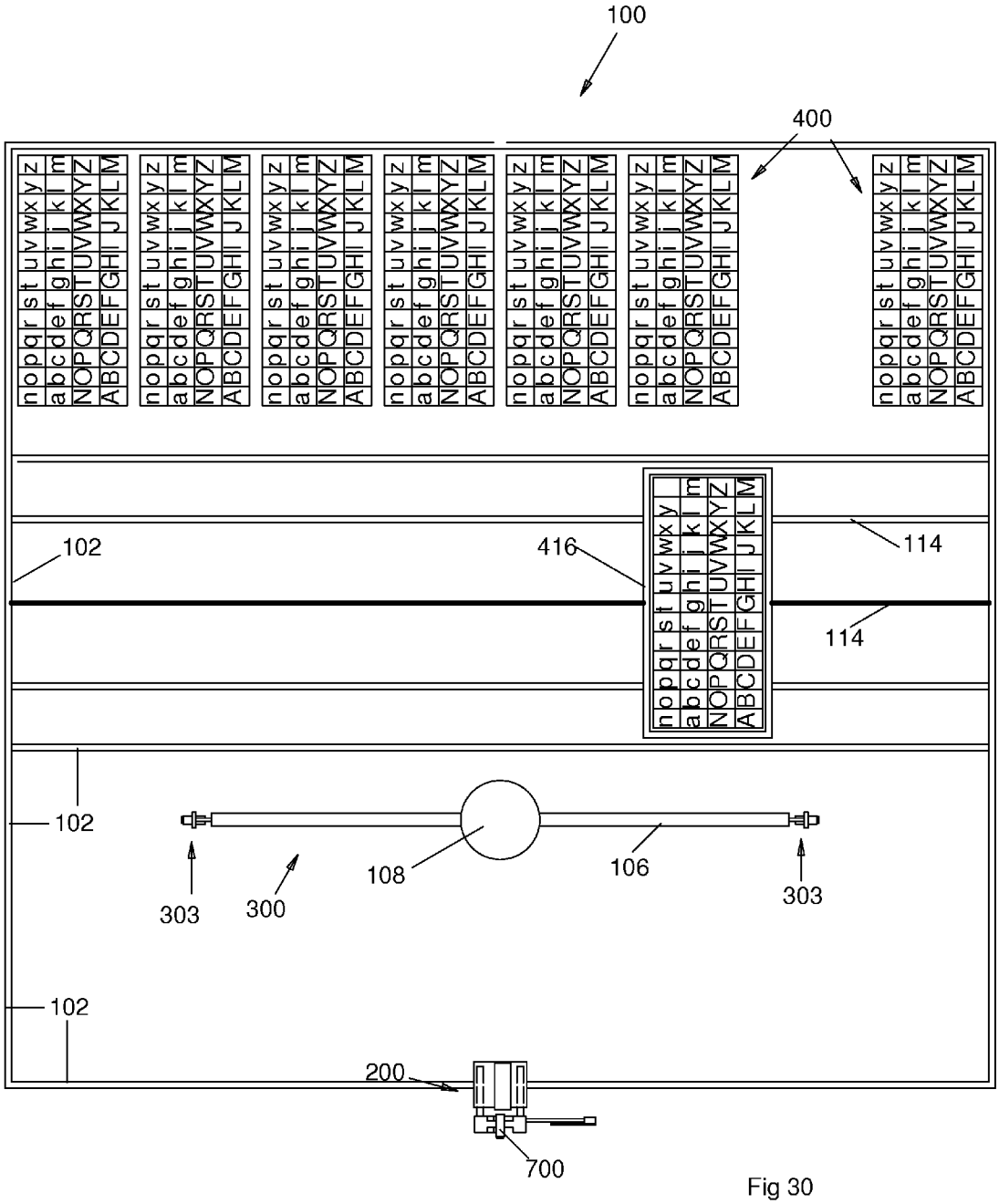

Multiple storage racks 400 may be utilized with the printing device 100. Multiple storage racks 400 provide the printing device 100 with the capability to print with multiple fonts and font sizes. FIGS. 29 and 30 depict an arrangement of multiple storage racks 400 arranged on a conveyor belt 412. The conveyor belt 410 may bring one or more storage racks 400 into range for the pickup head 300 to retrieve and return print die 700.

FIGS. 33A-34C depict various storage rack 400 configurations. These racks 400 are designed to accommodate storing and stacking print die 700 with and without planar extensions 708, as well as oversized and curved die (FIG. 33D).

Figure 35:
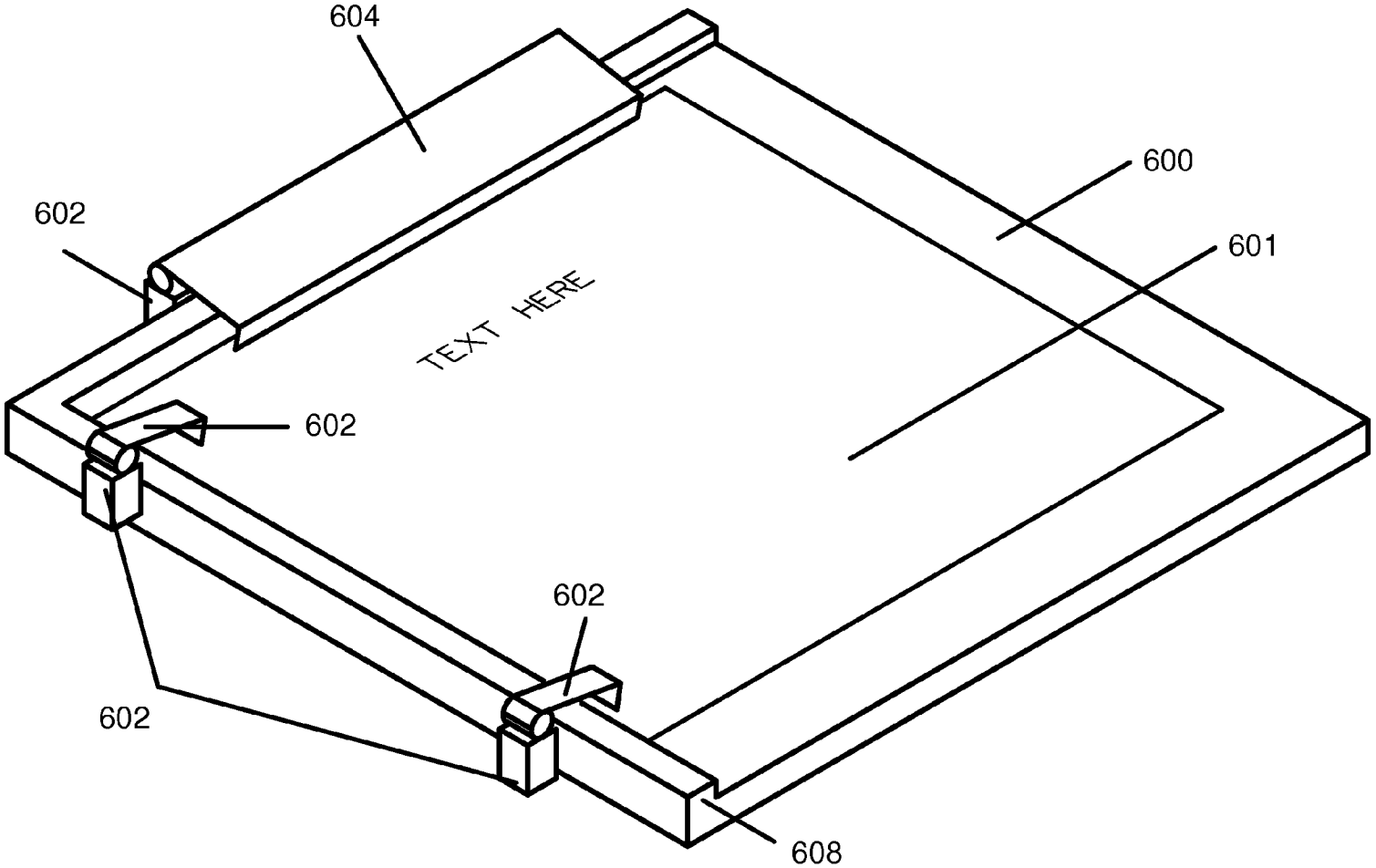
FIG. 35 is a horizontal printing surface for print media.
Figure 36:
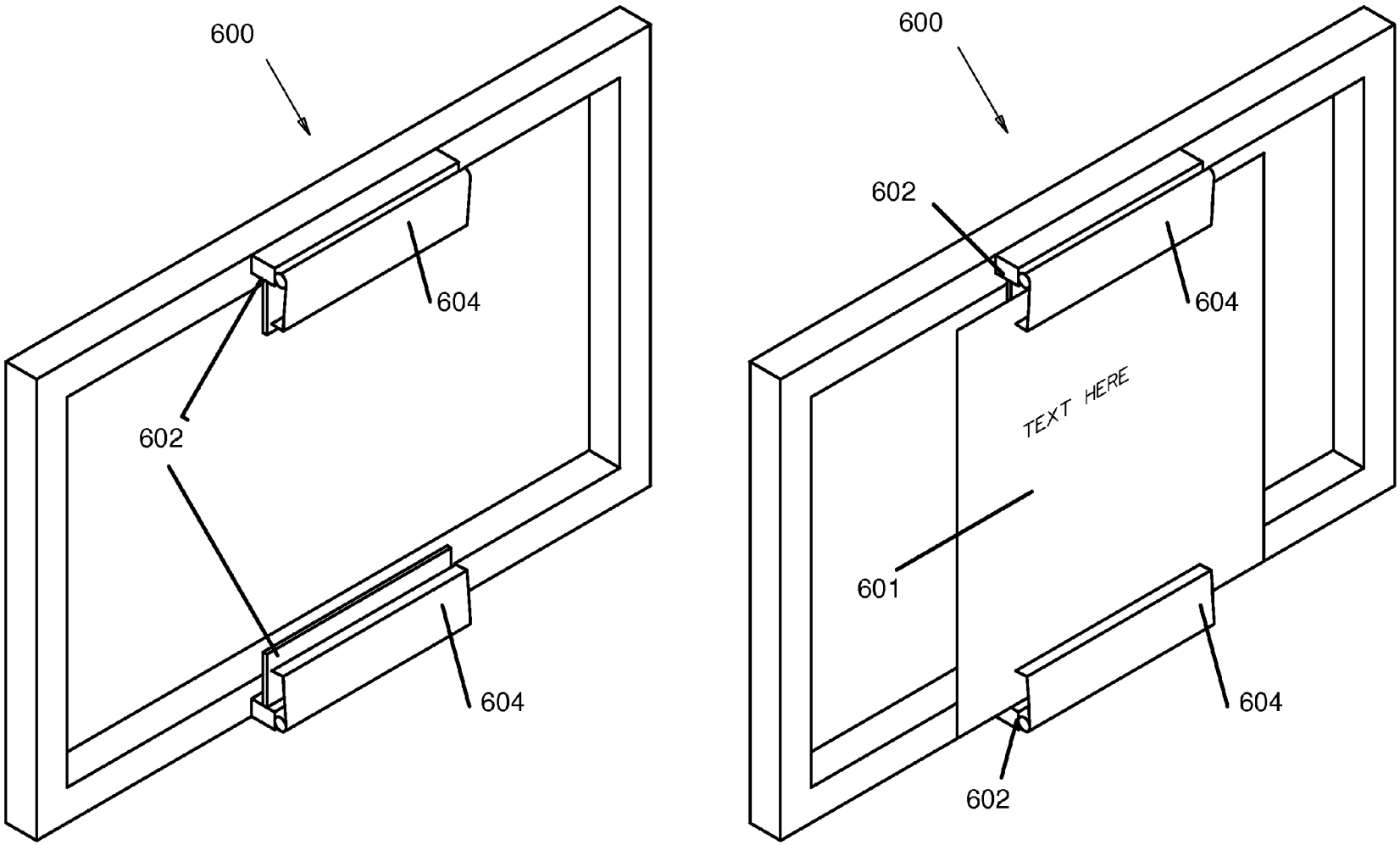
FIG. 36 is a vertical printing surface for print media.
Figure 38A:
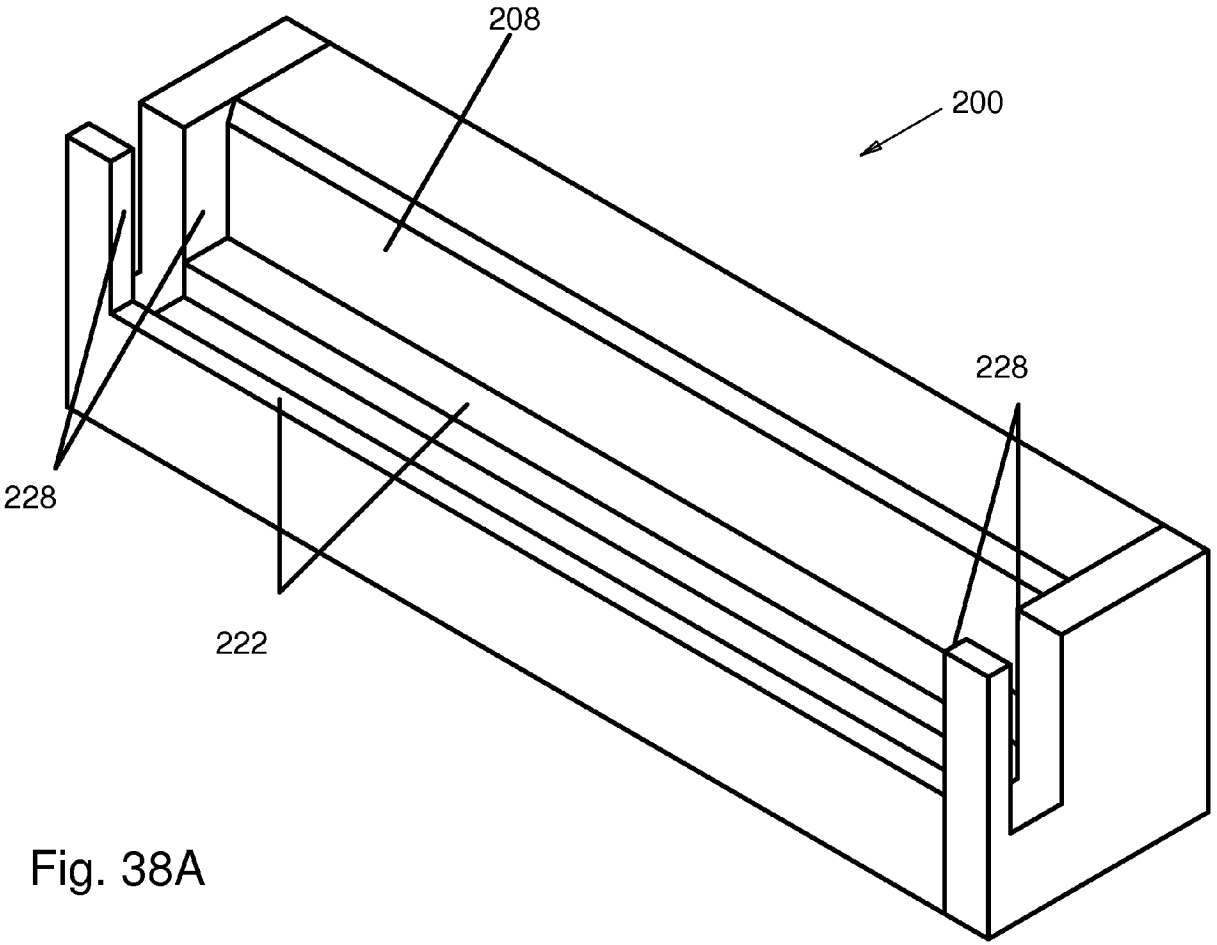
FIGS. 38A-38D show an embodiment of a print head for a printing device of the present invention, adapted to print with multiple print die.
Figure 38B:
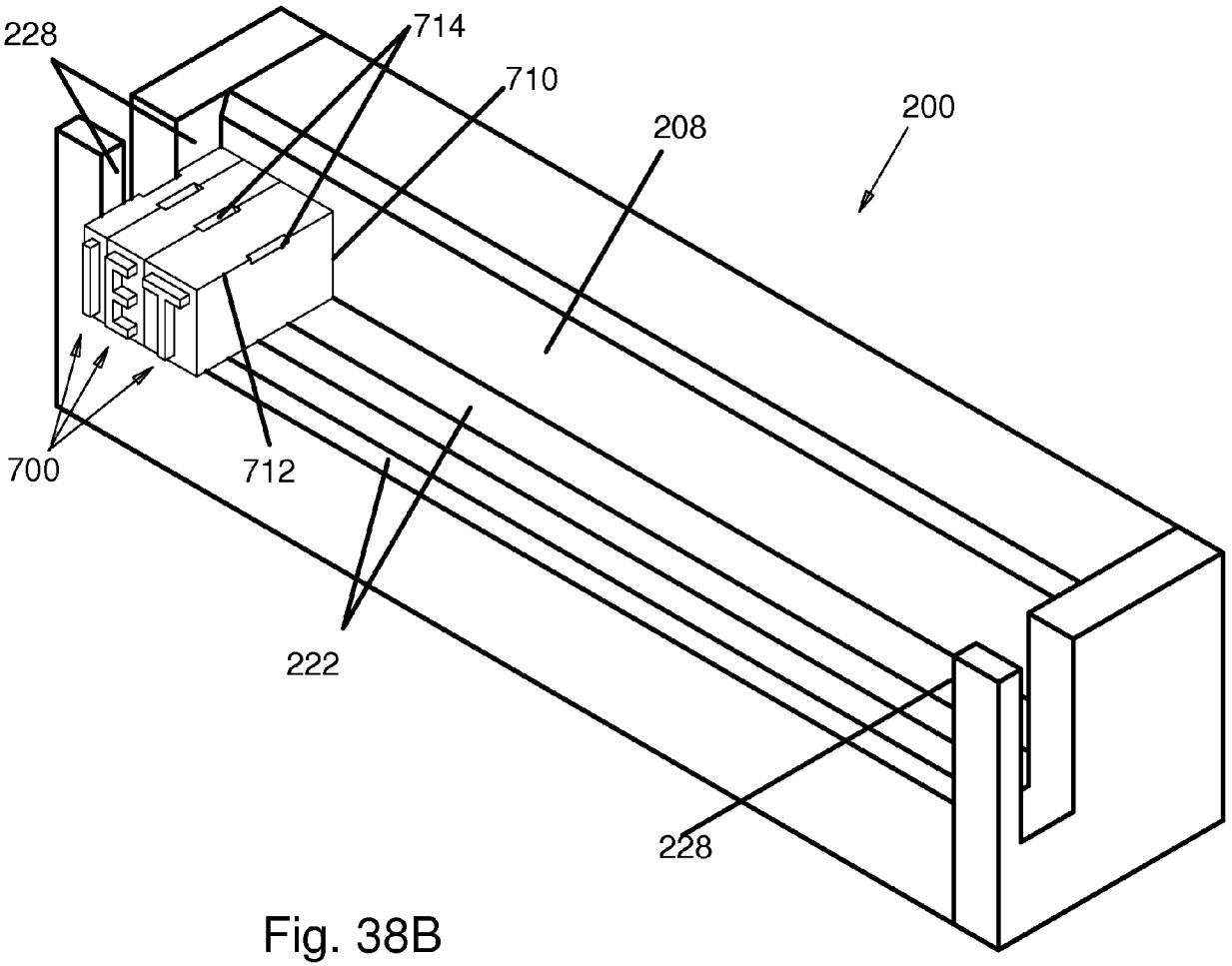
Figure 38D:
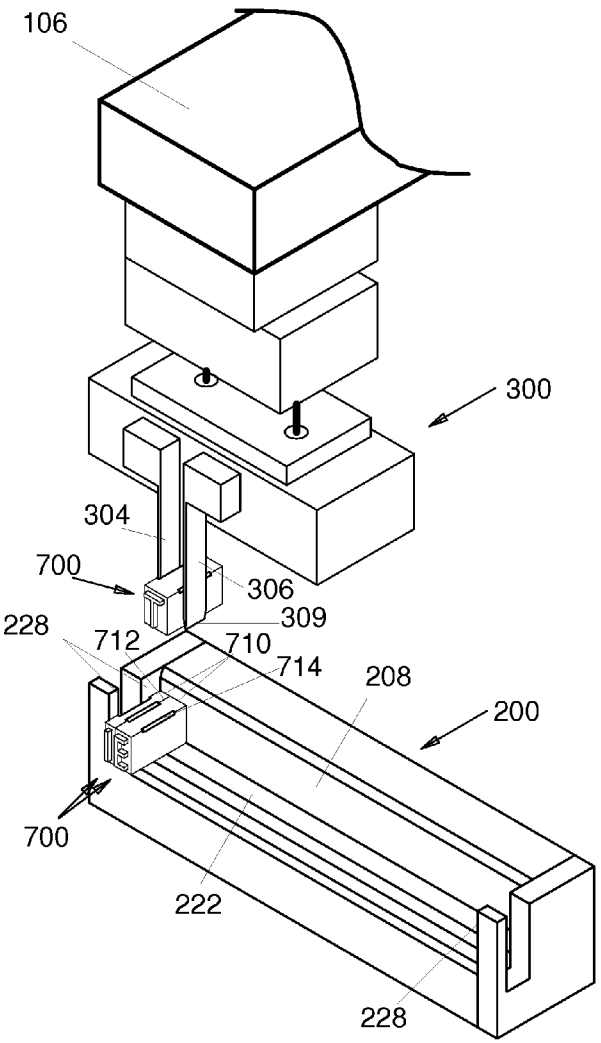
Figure 38C:
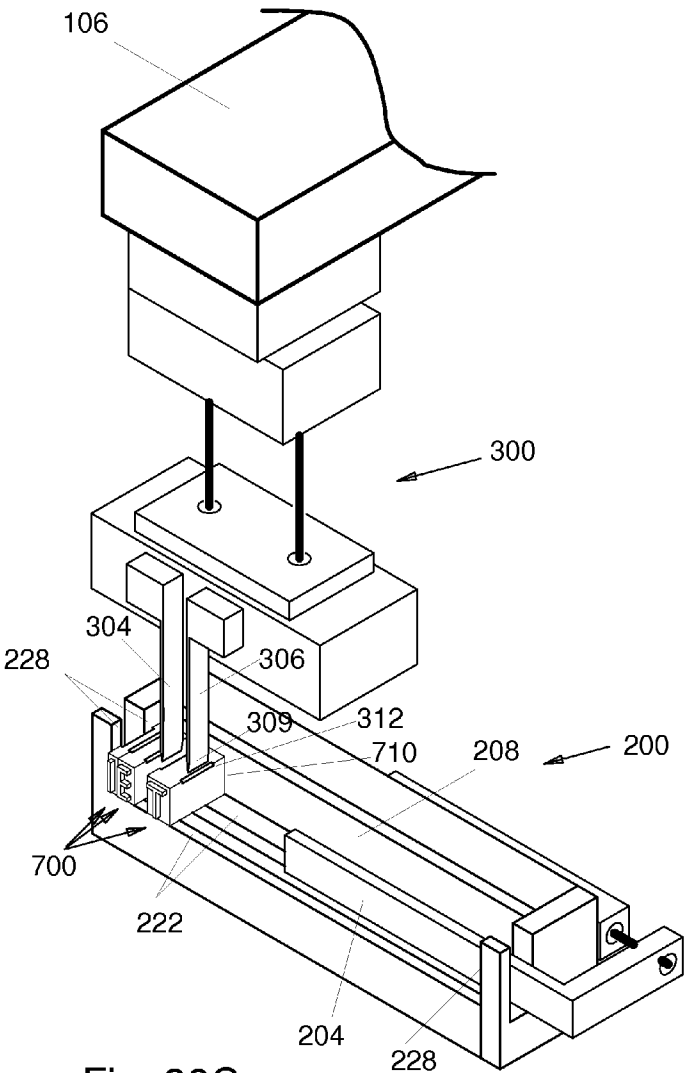

Referring now to FIGS. 35 and 36, the printing surface 600 is provided with a clamping system 602 for securing the print media 601. The clamping system 602 may be provided with adjustable clamps 605 that may be tightened by threaded fasteners or may alternatively, or in addition to, be spring loaded. The clamping system 602 may instead be a vacuum system to hold the print media to the printing surface. Further, the clamping system may be combination of both the adjustable clamps 605 and vacuum system. Also, the clamping system 600, may also be provided with datums 606, 608 to bias the print media against. These datums 606, 608 may be a physical edge to abut the media against, or may simply be a system of lines to provide visual references by which to position the print media 601.

Referring back to FIGS. 1-4, an operator using the printing device 100, may enter text into software on a computer associated with the printing device 100. The operator may enter the text, in any known manner, such as by typing, importing a *.txt file or equivalent, by optical character recognition, or any other means generally known, or any combination thereof.

The software may then parse the information and output a *.cnc file or equivalent. Thus, allowing the device to be a computer numerical controlled device and providing control over moving and positioning the various components, while taking into consideration the various motion, position, and safety sensing equipment that may be associated with the device 100.

The print media 601 may be manually loaded onto the printing surface 600, or the device 100 may be equipped with other means to pick and place individual sheet on the printing surface 600. Alternatively, the print media 601 may be fed to the printing surface 600 via feed and take-up rollers, or any other means generally known.

With the print media 601 loaded and secured to the printing surface 600 and the text to be printed entered into an associated computer, the printing device 100 is now ready to stamp or print work product. The pickup head drive system 112 and the storage rack drive system 114 provide movement generally parallel to three axes. The drive systems 112, 114 move the pickup head 300 relative to the storage rack 400 and place them 300, 400 in a position allowing the pickup head 300 to grasp a die 700 from the storage rack 400. The pickup head drive 112 then lifts the pickup head 300, with the die 700 in its grasp, from the storage rack 400. The pickup head 300 then moves parallel to the y axis to a hand-off position. In the hand off position, the pickup head 300 is aligned above the print head 200. The jaw assembly 302 may then open to release the die 700 into the print head 200. The die 700 can then be clamped in the print head 200, substantially as explained herein. The print head 200 then uses the die 700 to print.

The print head drive system 108 and the printing surface drive system 110 provide movement generally parallel to three axes. The print head drive system 108 and the printing surface drive system 110 move the print head 200 relative to the printing surface 600. This movement may place the print head 200 in a position to press the die 700 in an appropriate spot on the print media 601. Once the print head 200 finishes printing, it moves back to the hand off station where the pickup head 300, not having moved during the printing process, is aligned above the print head 200. The pickup head 300 can move down and grasp the die 700 in its jaw assembly 302 and lift the die 700 out of the print head 200 opening. The pickup head drive system 112 and the storage rack drive system 114 then move the pickup head 300 to the original storage rack position of the die 700. The pickup head 300 then releases the die into the storage rack 400. This process is repeated until printing is finished.

In addition, the location of each die 700 in the storage rack 400 may be preprogrammed into the computer associated with the printing device 100. A camera 308 or other device for acquiring optical data may then verify that the pickup head is in a proper position with a quick scan of the die 700.

Furthermore, as described herein, the printing device 100 may comprise more than one print head 200 or pickup head 300, or both. In addition, instead of remaining stationary while the print head 200 prints, the pickup head 300 may move with the print head 200 and become an integrated part of the print head clamping features. The pickup head 300 and print head 200, may take the form of any of the embodiments described herein.

Referring now to FIGS. 37A and 37B, when printing a text string the printing device 100 may a single letter at each location in which it occurs. For Example, to print the text string "THE AWARD WORKS THEATER," the printing device 100 would first print a "T" at all three locations that it occurs in the phrase. The device 100 would then print "H" at both locations that it occurs in the phrase, and could then print "E" at all three locations that it occurs. FIG. 37 shows the letter printed in the left column what the phrase reads at that point in the printing process. Printing in this serial manner reduces the number of processes that the printing device 100 needs to make in picking and delivering print die 700 to and from the storage rack 400 and print head 200, thus increasing the speed and efficiency of the device 100 as compared to printing each letter in sequential order. As shown in FIG. 37B, a die for the text string "THE" may be used to spell the entire word "THE" as well as a portion of the word "THEATER."

The print head motion controlled drive system 108 and the print surface drive system 110 provide at least three axes of movement of the print head relative to the print media. In other configurations, the drive systems 108, 110 may further provide a fourth and/or a fifth axis of motion of the print head relative to the print media. The first, second, and third axis will generally provide relative movement in the x, y, and z directions, as denoted by the arrows in FIG. 1, between the print media and the print head. Optionally, movement about a fourth axis that is orthogonal to a plane of the print media may be provided to adjust the angular orientation of the lettering relative to the print media. In addition, movement may also optionally be provided about an axis that is generally parallel to the plane of the print media. Motion about this optional fifth axis provides the capability of roll printing, roll the die as it is being pressed into the print media.

While there has been described and illustrated particular embodiments of a single character printing device and method of printing, it will be apparent to those skilled in the art that variations and modifications may be possible without deviating from the broad spirit and principle of the present invention, which shall be limited solely by the scope of the claims appended hereto.

The invention claimed is:

1. A printing device comprising:

a generally planar print die storage rack adapted to hold a plurality of print dies, said plurality of print dies having a first printing surface;

a print head adapted to hold one or more of said plurality of print dies and transport said one or more of said plurality of print dies to a generally planar printing station;

a pickup head adapted to hold one or more of said plurality of print dies and transport said one or more of said plurality of print dies between said print die storage rack and said print head;

said generally planar printing station adapted to hold and secure a print media having a second printing surface on which said print head prints; and said print head being rotatable relative to said printing station about an axis generally perpendicular to said second printing surface of said print media held by said printing station.

2. The printing device of claim 1, wherein one or more of said print die storage rack, said print head, said pickup head, and said printing surface is adapted to move along one or more axes.

3. The printing device of claim 1, wherein one or more of said print die storage rack, said print head, said pickup head, and said printing surface is adapted to rotate about one or more axes.

4. The printing device of claim 1, further comprising an ink delivery system.

5. The printing device of claim 1, wherein said printing device is adapted for printing on a vertical surface or horizontal surface.

6. The printing device of claim 1, wherein said print dies have a first position in said generally planar print die storage rack and a second position in said print head.

7. The printing device of claim 6, wherein in said first position of said print dies, said first printing surface is generally parallel to said second printing surface.

8. The printing device of claim 6, wherein in said second position of said print dies, said first printing surface is generally parallel to said second printing surface.

9. The printing device of claim 1, wherein said print die storage rack is generally planar, and wherein said generally planar printing station is parallel to said generally planar print die storage rack.

10. A system for printing comprising:

a plurality of print dies;

a print head;

at least one pickup head; and a generally planar printing station adapted to securely hold a print media, wherein said print media has a generally planar printing surface on which said print head prints;

said print head adapted to hold and move one or more of said plurality of print dies between said pickup head and said printing station, and wherein said print head is adapted to pivot relative to said printing station about a first axis being generally perpendicular to said generally planar printing surface of said print media held by said printing station; and said at least one pickup head adapted to hold and move said one or more of said plurality of print dies to and from said print head.

11. A printing device comprising:

a plurality of movable print dies each comprising a first printing surface;

a generally planar printing station comprising a generally flat surface and capable of securing a print media having a second printing surface;

a print die storage rack comprising one or more holding stations holding at least some of said plurality of movable print dies;

a print head capable of holding and releasably securing one or more of said plurality of movable print dies, wherein said print head is capable of moving said one or more of said plurality of movable print dies to said printing station such that said first printing surface contacts said second printing surface, and wherein said print head is rotatable relative to said printing station about an axis generally perpendicular to said second printing surface of said print media held by said printing station;

a movable pickup head adapted to hold and releasably secure said one or more of said plurality of movable print dies, and having a first position at said print die storage rack and a second position at said print head, wherein said movable pick up head is capable of moving from said first position to said second position;

wherein at said first position, said pick up head is capable of picking up, holding and releasably securing said one or more of said plurality of movable print dies;

wherein at said second position, said pick up head is capable of releasing said one or more of said plurality of movable print dies.

12. The printing device of claim 11, wherein said first printing surface and said second printing surface are generally parallel to a common plane when said plurality of moveable print dies are in said print die storage rack.

13. The printing device of claim 11, wherein said first printing surface and said second printing surface are generally parallel to a common plane when said one or more of said plurality of movable print dies are being held and releasably secured by said movable pickup head.

14. The printing device of claim 11, wherein said print die storage rack is generally planar, and wherein said generally planar printing station is parallel to said print die storage rack.

15. A printing device comprising:

one or more print dies comprising a first print surface;

a print die storage rack adapted to hold said one or more print dies;

one or more print heads;

a generally planar printing station capable of holding a print media comprising a second print surface on which said one or more print heads print; and one or more pickup heads pivotable relative to said print die storage rack about a first axis generally perpendicular to said second print surface of said print media held by said printing station;

wherein said one or more print heads are adapted to hold said one or more print dies and transport said one or more print dies between one of said one or more pickup heads and said printing station; and wherein said one or more pickup heads are adapted to hold said one or more print dies and transport said one or more print dies to and from said one or more print heads;

wherein said first print surface and said second print surface are always generally parallel to a common plane during transport of said one or more print dies.

* * * * *